US008759272B2

(12) United States Patent
Man et al.

(10) Patent No.: US 8,759,272 B2
(45) **Date of Patent: *Jun. 24, 2014**

(54) TREATMENT OF NON-TRANS FATS, FATTY ACIDS AND SUNSCREEN STAINS WITH A CHELATING AGENT

(71) Applicant: Ecolab USA Inc., St. Paul, MN (US)

(72) Inventors: Victor F. Man, St. Paul, MN (US); Yvonne M. Killeen, South St. Paul, MN (US); Stephen B. Christensen, Inver Grove Heights, MN (US); Joanna A. Pham, Blaine, MN (US); Dawn Lock, Inver Grove Heights, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/717,078

(22) Filed: Dec. 17, 2012

(65) Prior Publication Data

US 2013/0104319 A1 May 2, 2013

Related U.S. Application Data

(62) Division of application No. 12/956,705, filed on Nov. 30, 2010, now Pat. No. 8,361,950, which is a division of application No. 12/884,422, filed on Sep. 17, 2010, now Pat. No. 8,513,178.

(60) Provisional application No. 61/243,634, filed on Sep. 18, 2009.

(51) Int. Cl.

| | |
|---|---|
| ***C11D 1/00*** | (2006.01) |
| ***C11D 3/33*** | (2006.01) |
| ***C11D 3/36*** | (2006.01) |
| ***C11D 17/04*** | (2006.01) |
| ***C11D 3/00*** | (2006.01) |
| ***C11D 11/00*** | (2006.01) |

(52) U.S. Cl.

CPC ..... *C11D 11/0064* (2013.01); *C11D 3/33* (2013.01); *C11D 3/36* (2013.01); *C11D 17/041* (2013.01); *C11D 3/0036* (2013.01)

USPC ..... 510/278; 510/281; 510/363; 510/453

(58) Field of Classification Search

None

See application file for complete search history.

(56) References Cited

U.S. PATENT DOCUMENTS

| | | | |
|---|---|---|---|
| 5,306,444 | A | 4/1994 | Kitamura et al. |
| 5,369,126 | A | 11/1994 | Doran et al. |
| 5,919,745 | A | 7/1999 | Cala et al. |
| 5,929,006 | A | 7/1999 | Saito et al. |
| 5,986,118 | A | 11/1999 | Fehr et al. |

(Continued)

FOREIGN PATENT DOCUMENTS

| | | | |
|---|---|---|---|
| WO | WO 2007/004622 | A1 | 1/2007 |
| WO | WO 2008/065109 | A1 | 6/2008 |

OTHER PUBLICATIONS

Süd-Chemie AG, "Tonsil® Highly Active Bleaching Earths", 10 pages.

*Primary Examiner* — Necholus Ogden, Jr.

(74) *Attorney, Agent, or Firm* — Amy J. Hoffman

(57) ABSTRACT

The invention relates to methods and compositions for treating non-trans fats, fatty acids and sunscreen stains with a chelating agent. The invention also relates to methods for reducing the frequency of laundry fires with a chelating agent.

5 Claims, 42 Drawing Sheets

(56) References Cited

U.S. PATENT DOCUMENTS

| | | | | |
|---|---|---|---|---|
| 6,004,922 | A * | 12/1999 | Watson et al. | 510/476 |
| 6,225,485 | B1 | 5/2001 | Bertz et al. | |
| 6,274,541 | B1 | 8/2001 | Man | |
| 6,376,443 | B1 | 4/2002 | Julemont | |
| 6,384,003 | B1 | 5/2002 | Julemont | |
| 6,479,453 | B2 | 11/2002 | Man | |
| 6,903,060 | B1 | 6/2005 | Dykstra et al. | |
| 7,037,884 | B2 | 5/2006 | Man | |
| 7,098,181 | B2 | 8/2006 | Inoue et al. | |
| 7,645,731 | B1 | 1/2010 | Silvernail et al. | |
| 7,723,281 | B1 | 5/2010 | Herdt et al. | |
| 7,825,079 | B2 | 11/2010 | Suzuki et al. | |
| 2002/0151452 | A1 | 10/2002 | Bullock et al. | |
| 2003/0216273 | A1 | 11/2003 | Mitra et al. | |
| 2004/0028794 | A1 | 2/2004 | Van Buuren et al. | |
| 2006/0205628 | A1 | 9/2006 | Deinhammer et al. | |
| 2006/0211593 | A1 * | 9/2006 | Smith et al. | 510/424 |
| 2008/0276973 | A1 | 11/2008 | Miralles et al. | |
| 2009/0119847 | A1 | 5/2009 | Arai et al. | |
| 2009/0264329 | A1 | 10/2009 | Underwood et al. | |
| 2010/0229897 | A1 | 9/2010 | Miralles et al. | |

* cited by examiner (Oleic Acid)

(Linoleic Acid)

DSC (Linolenic Acid)

DSC (Unsoiled cotton-terry swatch, no soybean oil, no treatment)

(Soybean oil only, no treatment)

(Soybean oil soiled swatch treated with EDTA) DSC (Soybean oil soiled swatch treated with MGDA)

DSC (Soybean oil soiled swatch treated with GLDA) DSC (Soybean oil spiked with 0.5 ppm iron) DSC (Soybean oil spiked with 1 ppm iron)

(Soybean oil spiked with 2 ppm iron)

(Soybean oil spiked with 0.5 ppm iron and treated with 0.5 grams active EDTA)

DSC (Soybean oil spiked with 1.0 ppm iron and treated with 0.5 grams active EDTA)

(Soybean oil spiked with 2.0 ppm iron and treated with 0.5 grams active EDTA)

(Soybean oil spiked with 0.5 ppm copper)

(Soybean oil spiked with 1.0 ppm copper) DSC (Soybean oil spiked with 2.0 ppm copper)

(Soybean oil spiked with 0.5 ppm copper and treated with 0.5 grams active EDTA)

(Soybean oil spiked with 1.0 ppm copper and treated with 0.5 grams active EDTA)

(Soybean oil spiked with 2.0 ppm copper and treated with 0.5 grams active EDTA)

Figure 23

CHELATION TREATMENT OF NON-TRANS FAT IN LAUNDRY

TERGOTOMETER TEST in 150°F DI WATER
SOYBEAN OIL SOIL LOAD, dosed on swatches = 9000 ppm
COMMERCIAL DETERGENT A, ACTIVE SURFACTANT = 53 ppm

| | % SOIL REMOVAL BY WEIGHT | AREA OF EXOTHERM, J/g | TIME OF PEAK, min |
|---|---|---|---|
| NO CHELATOR | | 33 | 26 |
| | | 19 | 11 |
| | | 24 | 9 |
| | | 83 | 9 |
| | | 34 | 10 |
| | 88 | 16 | 10 |
| | 88 | 16 | 10 |
| | 88 | 17 | 9 |
| | | 7 | 29 |
| | | 8 | 7 |
| | | 37 | 22 |

Figure 24

CHELATION TREATMENT OF NON-TRANS FAT IN LAUNDRY

TERGOTOMETER TEST in 150°F DI WATER
SOYBEAN OIL SOIL LOAD, dosed on swatches = 9000 ppm
COMMERCIAL DETERGENT A, ACTIVE SURFACTANT = 53 ppm

| | % SOIL REMOVAL BY WEIGHT | AREA OF EXOTHERM, J/g | TIME OF PEAK, min |
|---|---|---|---|
| GLDA | | | |
| 19 ppm | | 25 | 54 |
| | | 27 | 52 |
| | | 23 | 53 |
| 38 ppm | | 16 | 61 |
| | | 9 | 40 |
| | | 22 | 54 |
| 100 ppm | | 22 | 60 |
| | | 20 | 57 |
| | | 17 | 35 |
| | | 18 | 36 |
| | | 32 | 37 |
| | 93 | 13 | 32 |
| | 93 | 12 | 29 |
| | 93 | 21 | 36 |
| 500 ppm | | 11 | 43 |
| | | 28 | 42 |
| | | 11 | 36 |
| | 92 | 19 | 26 |
| | 92 | 15 | 35 |
| | | 25 | 64 |
| | | 26 | 73 |
| | | 19 | 51 |

Figure 25

CHELATION TREATMENT OF NON-TRANS FAT IN LAUNDRY

TERGOTOMETER TEST in 150°F DI WATER
SOYBEAN OIL SOIL LOAD, dosed on swatches = 9000 ppm
COMMERCIAL DETERGENT A, ACTIVE SURFACTANT = 53 ppm

| | % SOIL REMOVAL BY WEIGHT | AREA OF EXOTHERM, J/g | TIME OF PEAK, min |
|---|---|---|---|
| EDTA | | | |
| 30 ppm | | 23 | 32 |
| | | 21 | 32 |
| 40 ppm | | 13 | 40 |
| | | 22 | 24 |
| | | 26 | 28 |
| 50 ppm | | 14 | 7 |
| | | 36 | 39 |
| | | 25 | 36 |
| | | 8 | 7 |
| | | 23 | 41 |
| 100 ppm | 91 | 16 | 18 |
| | 91 | 12 | 15 |
| 500 ppm | 93 | 13 | 31 |
| | 93 | 31 | 32 |

Figure 26

CHELATION TREATMENT OF NON-TRANS FAT IN LAUNDRY

TERGOTOMETER TEST in 150°F DI WATER
SOYBEAN OIL SOIL LOAD, dosed on swatches = 9000 ppm
COMMERCIAL DETERGENT A, ACTIVE SURFACTANT = 53 ppm

| | % SOIL REMOVAL BY WEIGHT | AREA OF EXOTHERM, J/g | TIME OF PEAK, min |
|---|---|---|---|
| MGDA | | | |
| 20 ppm | | 22 | 34 |
| | | 22 | 34 |
| | | 33 | 33 |
| 30 ppm | | 22 | 34 |
| | | 29 | 35 |
| 40 ppm | | 34 | 32 |
| | | 21 | 31 |
| | | 33 | 36 |
| 100 ppm | | 22 | 60 |
| | | 17 | 60 |
| | | 23 | 53 |
| 500 ppm | | 21 | 43 |
| | | 15 | 47 |

Figure 27

CHELATION TREATMENT OF NON-TRANS FAT IN LAUNDRY

TERGOTOMETER TEST in 150°F DI WATER
SPENT SOYBEAN OIL SOIL LOAD, dosed on swatches = 9000 ppm
COMMERCIAL DETERGENT A = 53 ppm Active Surfactant
COMMERCIAL DETERGENT B = 79 ppm Active Surfactant
μEM = 48 ppm Active Surfactant

| | % SOIL REMOVAL BY WEIGHT | AREA OF EXOTHERM, J/g | TIME OF PEAK, min | DETERGENT |
|---|---|---|---|---|
| NO CHELATOR | | 27 | 4 | Commercial Detergent A |
| | | 17 | 5 | |
| | | 4 | 4 | |
| | | 26 | 5 | |
| | | 29 | 5 | |
| | | 28 | 4 | |
| | 95 | 20 | 10 | |
| | 95 | 29 | 15 | |
| | | 30 | 18 | |

Figure 28

CHELATION TREATMENT OF NON-TRANS FAT IN LAUNDRY

TERGOTOMETER TEST in 150°F DI WATER
SPENT SOYBEAN OIL SOIL LOAD, dosed on swatches = 9000 ppm
COMMERCIAL DETERGENT A = 53 ppm Active Surfactant
COMMERCIAL DETERGENT B = 79 ppm Active Surfactant
μEM = 48 ppm Active Surfactant

| | % SOIL REMOVAL BY WEIGHT | AREA OF EXOTHERM, J/g | TIME OF PEAK, min | DETERGENT |
|---|---|---|---|---|
| GLDA 19 ppm | 92 | 22 | 27 | uEM #7 |
| | 92 | 17 | 8 | |
| 38 ppm | 93 | 38 | 20 | uEM #8 |
| | 93 | 7 | 6 | |
| 100 ppm | | 15 | 20 | Commercial Detergent A |
| | | 34 | 21 | |
| | | 31 | 26 | |
| | | 37 | 15 | |
| | | 28 | 12 | |
| | | 25 | 14 | |
| 500 ppm | | 28 | 35 | Commercial Detergent A |
| | | 22 | 29 | |
| | | 21 | 21 | |
| | | 23 | 22 | |
| | | 22 | 22 | |

Figure 29

CHELATION TREATMENT OF NON-TRANS FAT IN LAUNDRY

TERGOTOMETER TEST in 150°F DI WATER
SPENT SOYBEAN OIL SOIL LOAD, dosed on swatches = 9000 ppm
COMMERCIAL DETERGENT A = 53 ppm Active Surfactant
COMMERCIAL DETERGENT B = 79 ppm Active Surfactant
μEM = 48 ppm Active Surfactant

| | % SOIL REMOVAL BY WEIGHT | AREA OF EXOTHERM, J/g | TIME OF PEAK, min | DETERGENT |
|---|---|---|---|---|
| EDTA | | | | |
| 40 ppm | 92 | 38 | 39 | uEM #2 |
| 50 ppm | 93 | 12 | 26 | uEM #3 |
| | 93 | 11 | 30 | |
| 100 ppm | | 23 | 27 | Commercial |
| | | 30 | 22 | Detergent A |
| | | 29 | 41 | |
| 500 ppm | | 24 | 35 | Commercial |
| | | 25 | 35 | Detergent A |

Figure 30

CHELATION TREATMENT OF NON-TRANS FAT IN LAUNDRY

TERGOTOMETER TEST in 150°F DI WATER
SPENT SOYBEAN OIL SOIL LOAD, dosed on swatches = 9000 ppm
COMMERCIAL DETERGENT A = 53 ppm Active Surfactant
COMMERCIAL DETERGENT B = 79 ppm Active Surfactant
μEM = 48 ppm Active Surfactant

| | % SOIL REMOVAL BY WEIGHT | AREA OF EXOTHERM, J/g | TIME OF PEAK, min | DETERGENT |
|---|---|---|---|---|
| MGDA | | | | |
| 20 ppm | 92 | 26 | 25 | uEM #4 |
| | 92 | 33 | 23 | |
| | 92 | 27 | 23 | |
| 30 ppm | 93 | 23 | 27 | uEM #5 |
| | 93 | 13 | 25 | |
| | 93 | 11 | 9 | |
| 40 ppm | 93 | 13 | 20 | uEM #6 |
| 100 ppm | | 17 | 18 | Commercial |
| | | 18 | 13 | Detergent A |
| | | 12 | 10 | |
| 500 ppm | | 18 | 27 | Commercial |
| | | 18 | 24 | Detergent A |
| | | 18 | 25 | |

CHELATION TREATMENT OF NON-TRANS FAT IN LAUNDRY
TERGOTOMETER TEST in ONE LITER of 150°F DI WATER
Swatch Soiled with 3.0 grams Fresh Soybean Oil (3 swatches per conditon)
Washed with Commercial Detergent A at 53 ppm active surfactant or , uEM at 48 ppm active surfactant CHELATION AGENT AND ALKALINITY TREATMENT of NON-TRANS FAT IN LAUNDRY
TERGOTOMETER TEST in ONE LITER of 150°F DI WATER
Swatch Soiled with 2.0 grams Fresh "Sodexo" Soybean Oil (3 swatches per conditon)
53 ppm Active Commerical Detergent A CHELATION AGENT AND ALKALINITY TREATMENT of NON-TRANS FAT IN LAUNDRY
TERGOTOMETER TEST in ONE LITER of 150°F DI WATER
Swatch Soiled with 2.0 grams Spent KFC Soybean Oil (3 swatches per conditon)
53 ppm Active Commerical Detergent A CHELATION TREATMENT OF NON-TRANS FAT IN LAUNDRY
IMMPRGANTION TEST
TERGOTOMETER TEST in ONE LITER of 150°F DI WATER
Swatch Impregnated with 0.21 grams Chelant (3 swatches per condition)and Dried then
Swatch was Soiled with 0.55 grams Fresh Soybean Oil (3 swatches per conditon)
Washed Immediately with Commercial Detergent A or B at 53 ppm active surfactant FIGURE 36 CHELATION TREATMENT of NON-TRANS FAT IN LAUNDRY IMPREGNATION TERGOTOMETER TEST in ONE LITER of 150°F DI WATER Swatch impregnated with 0.21 grams Chelant (3 swatches per condition) and dried then Swatch soiled with 0.55 grams Fresh Soybean oil (3 swatches per condition)

Let stand one hour before washing with Commerical detergent A or at 53 ppm active surfactant

CHELATION TREATMENT of FREE FATTY ACIDS

Swatch soiled with 1.0 grams Fatty Acid

Let Stand Overnight – Run DSC

CHELATING AGENT AND ALKALINITY TREATMENT OF NON-TRANS FAT IN LAUNDRY TERGOTOMETER TEST in ONE LITER of 150°F WATER

Swatch Soiled with 2.0 grams Fresh Bakers Chef Soybean Oil (3 swatches per condition)
Wash with Commercial Detergent A at 53 ppm active surfactant

Figure 42

CHELATING AGENT and MEA TREATMENT of NON-TRANS FAT IN LAUNDRY
With uEM FORMING FOMRULA
TERGOTOMETER TEST in ONE LITER of 140°F – 150°F DI WATER
Swatch Soiled with 2.0 grams Fresh Bakers Chef Soybean Oil (3 swatches per condition)

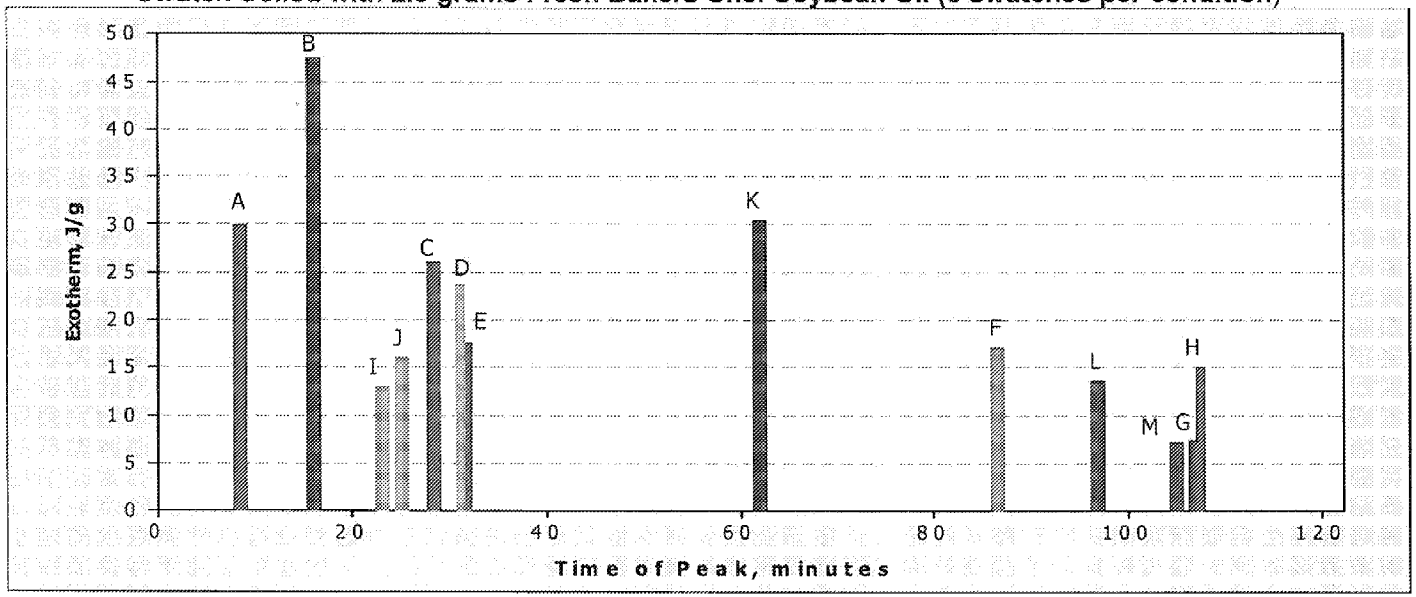

A = Bakers Chef fresh soy oil

B = Commercial Detergent B: 370 ppm surfactant, 0 ppm chelant, 0 ppm alkalinity

C = uEM #12: 185 ppm EH-6 + Tegin Linker

D = uEM #12: 370 ppm EH-6 + Tegin Linker

E = uEM #13: 370 ppm EH-6, no Tegin Linker

F = uEM #11: 93 ppm surfactant, 76 ppm chelant, 96 ppm MEA

G = uEM #11: 370 ppm surfactant, 304 ppm chelant, 385 ppm MEA

H = uEM #11: 185 ppm surfactant, 152 ppm chelant, 193 ppm MEA

I = Commercial Detergent A: 265 ppm surfactant, 0 ppm chelant, 0 ppm alkalinity

J = Commercial Detergent A: 265 ppm surfactant, 0 ppm chelant, 50 ppm MEA

K = uEM #9: 48 ppm surfactant, 39 ppm chelant, 0 ppm alkalinity

L = uEM #10: 48 ppm surfactant, 39 ppm chelant, 25 ppm MEA

TREATMENT OF NON-TRANS FATS, FATTY ACIDS AND SUNSCREEN STAINS WITH A CHELATING AGENT

CROSS-REFERENCES TO RELATED APPLICATIONS

This application claims the benefit of U.S. Provisional Patent Application Ser. No. 61/243, 634, filed on Sep. 18, 2009 and is a divisional application of U.S. patent application Ser. No. 12/956,705, filed on Nov. 30, 2010, now U.S. Pat. No. 8,361,950 issued on Jan. 29, 2013, which is a divisional application of U.S. patent application Ser. No. 12/884,422, filed on Sep. 17, 2010, now U.S. Pat. No. 8,513,178 issued on Aug. 20, 2013, in which the disclosures are incorporated herein within their entireties.

FIELD OF THE INVENTION

The invention relates to methods and compositions for treating non-trans fats, fatty acids and sunscreen stains with a chelating agent. The invention also relates to methods for reducing the frequency of laundry fires with a chelating agent.

BACKGROUND OF THE INVENTION

Health authorities have recently recommended that trans fats be reduced or eliminated in diets because they present health risks. In response, the food industry has largely replaced the use of trans fats with non-trans fats. However, the replacement of trans fats with non-trans fats poses new concerns over the need and ability to clean and remove such soils from a variety of surfaces. Non-trans fat soils and other soils form thickened liquid, semi-solid or solid soils on a variety of surfaces, presenting soils which are very difficult to remove from surfaces. After replacing the use of trans fats with non-trans fats, the food industry has also experienced an unexplained higher frequency of laundry fires. Formulas and methods of cleaning to better remove non-trans fats, are prone to cause fire due to their substantial heat of polymerization. Non-trans fats have conjugated double bonds that can polymerize and the substantial heat of polymerization involved can cause spontaneous combustion or fire, for example, in a pile of rags used to mop up these non-trans fat soils.

Similarly another cleaning challenge presented has been the drastically increased use by consumers of sunscreens. Medical organizations such as the American Cancer Society recommend the use of sunscreen because it prevents the squamous cell carcinoma and the basal cell carcinoma which may be caused by ultraviolet radiation from the sun. Many of these sunscreens contain components such as avobenzones and oxybenzones. These chemicals, while not visible prior to wash, typically appear on fabrics as yellow patches after washing with detergent-builder combinations at high pH. Current methods to treat these types of stains have included bleach, and other traditional pretreatments, all to no avail.

As can be seen, there is a need in the industry for improvement of cleaning compositions, such as hard surface and laundry detergents so that difficult soils such as non-trans fat soils and sunscreen stains can be removed in a safe, environmentally friendly, and effective manner.

SUMMARY OF THE INVENTION

The invention meets the needs above by incorporating an effective amount of a chelating agent. The chelating agent can be used alone as a pretreatment, in combination with traditional cleaning compositions, as a part of a laundry detergent or rinse treatment, or as a hard surface cleaner or as a component to form emulsions and microemulsions. The chelating agent is capable of hindering polymerization of non-trans fats and fatty acids as well as facilitate the removal and destaining of sunscreen components.

The invention has many uses and applications, which include but are not limited to laundry cleaning, reduction of laundry fires due to non-trans fats, hard surface cleaning such as manual pot-n-pan cleaning, machine warewashing, all purpose cleaning, floor cleaning, CIP cleaning, open facility cleaning, foam cleaning, vehicle cleaning, etc. The invention is also relevant to non-cleaning related uses and applications such as dry lubes, tire dressings, polishes, etc. as well as triglyceride based lotions such as suntan lotions.

In one embodiment a soil release composition is disclosed which includes a chelating agent in an effective amount to hinder polymerization of non-trans fat soils. This composition can be used in formulations for laundry detergents, hard surface cleaners, whether alkali or acid based or even by itself as a pre-spotting agent.

In another embodiment a method of preventing fire in an article that is contacted with a non-trans fat soil is disclosed wherein an effective amount of chelating agent is added to the article to hinder polymerization of the non-trans fat soil and therefore prevent spontaneous combustion or fire of the article.

In a further embodiment a method of laundering an article that is contacted with a non-trans fat soil or a sunscreen stain is disclosed, the method includes the steps of washing, rinsing and drying the article and includes a further step of treating the article with an effective amount of chelating agent during or after the article is laundered in the washing step.

In yet another aspect of the present invention, a laundry detergent composition is provided which includes a surfactant system, a water carrier, an effective amount of chelating agent, and other detergent components such as a builder. The laundry detergent product being adapted to readily dissolve and disperse non-trans fats and is particularly suited for removal of stains caused by sunscreen components such as oxybenzone and avobenzone in commercial, industrial and personal laundry washing processes.

These and other objects, features and attendant advantages of the present invention will become apparent to those skilled in the art from a reading of the following detailed description of the preferred embodiment and the appended claims.

BRIEF DESCRIPTION OF THE DRAWINGS

FIG. 23 is a chart showing percentage soil removal, area of exotherm and time of peak values for cotton terry swatches soiled with fresh soybean oil and washed in a detergent solution with no chelating agent.

FIG. 24 is a chart showing percentage soil removal, area of exotherm and time of peak values for cotton terry swatches soiled with fresh soybean oil and washed in a detergent solution with different concentrations of GLDA.

FIG. 25 is a chart showing percentage soil removal, area of exotherm and time of peak values for cotton terry swatches soiled with fresh soybean oil and washed in a detergent solution with different concentrations of EDTA.

FIG. 26 is a chart showing percentage soil removal, area of exotherm and time of peak values for cotton terry swatches soiled with fresh soybean oil and washed in a detergent solution with different concentrations of MGDA.

FIG. 27 is a chart showing percentage soil removal, area of exotherm and time of peak values for cotton terry swatches soiled with spent soybean oil and washed in a detergent solution with no chelating agent.

FIG. 28 is a chart showing percentage soil removal, area of exotherm and time of peak values for cotton terry swatches soiled with spent soybean oil and washed in a detergent solution with different concentrations of GLDA.

FIG. 29 is a chart showing percentage soil removal, area of exotherm and time of peak values for cotton terry swatches soiled with spent soybean oil and washed in a detergent solution with different concentrations of EDTA.

FIG. 30 is a chart showing percentage soil removal, area of exotherm and time of peak values for cotton terry swatches soiled with spent soybean oil and washed in a detergent solution with different concentrations of MGDA.

FIG. 42 is a graph showing area of exotherm and time of peak values for cotton terry swatches soiled with fresh soybean oil, and washed in a μEM forming formula containing various concentrations of chelating agent and monoethanolamine.

DETAILED DESCRIPTION OF THE INVENTION

Figure 1:
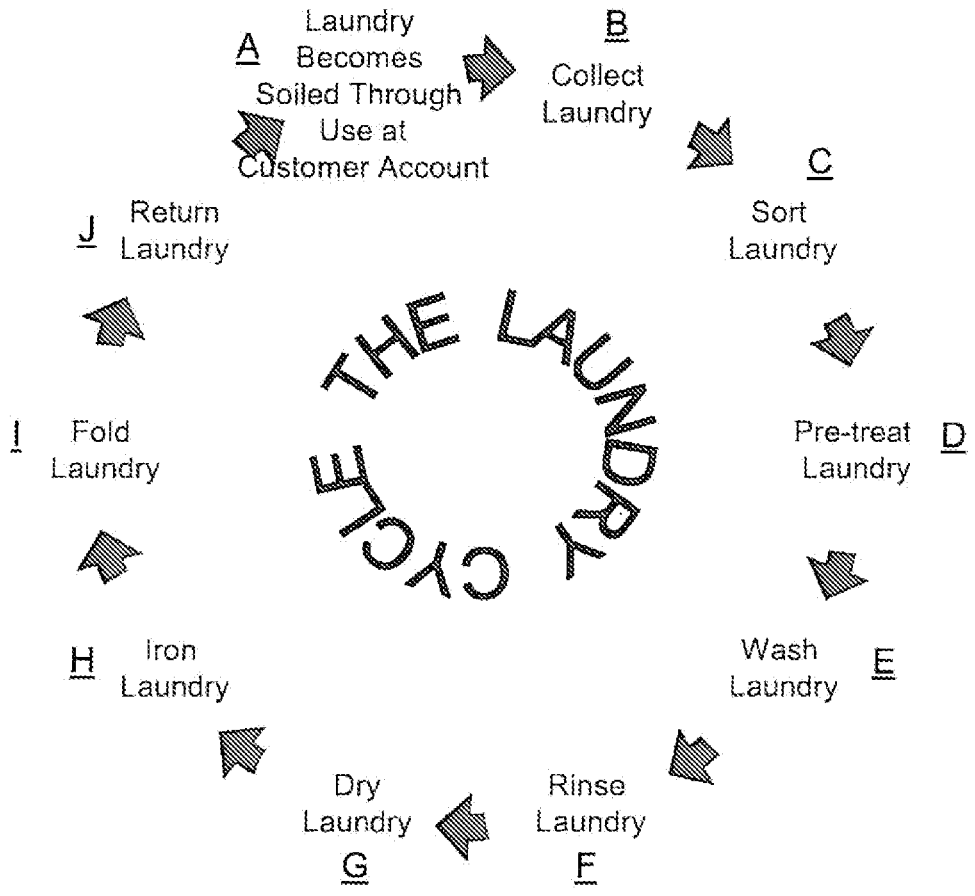
FIG. 1 is a flowchart of a typical laundry process in the food industry.

So that the invention maybe more readily understood, certain terms are first defined and certain test methods are described.

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

As used herein, the term "about" refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

The term "hard surface" refers to a solid, substantially non-flexible surface such as a counter top, tile, floor, wall, panel, window, plumbing fixture, kitchen and bathroom furniture, appliance, engine, circuit board, and dish.

The term "soft surface" refers to a softer, highly flexible material such as fabric, carpet, hair, and skin.

As used herein, the term "cleaning" refers to a method used to facilitate or aid in soil removal, bleaching, microbial population reduction, and any combination thereof. "Soil" or "stain" refers to a non-polar oily substance which may or may not contain particulate matter such as mineral clays, sand, natural mineral matter, carbon black, graphite, kaolin, environmental dust, etc.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated.

Exemplary treated fibers include those treated for flame retardancy. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

Chelating Agents

The discovery of the link between non-trans fats and laundry fires resulted in the present invention for compositions for treating non-trans fat soils. Due to the significant risk of thermal polymerization resulting in fires, compositions preventing the polymerization of non-trans fats are needed to prevent such risk of fires and represent ideal compositions for cleaning non-trans fat soiled surfaces. Polymerization of non-trans fats results from the unsaturated bonds of the fats, generating significant amount of heat. The higher energy state of the trans configuration causes heat from one double bond to heat the next double bond, resulting in a chain reaction.

According to a preferred embodiment of the invention, the inclusion of a chelating agent to reduce heavy metals in surfaces soiled with non-trans fats (namely textiles) such as soybean oil, to impede polymerization of the non-trans fats, results in a reduction of spontaneous combustion.

The chelating agent or combination of agents of the soil release composition is capable of hindering or reducing the polymerization of the non-trans fats. The chelating agent is also capable of hindering metal complexation by forming chelation complexes with metal ions. Non-trans fat oils contain heavy metal ions that act as oxidative catalysts in the polymerization of the oils; further, the cooking process of non-trans fat oils also results in the addition of heavy metal ions due to the oils often being cooked in metal surfaces (e.g. metal pots and pans). Accordingly, the chelating agent of the soil release composition must be capable of chelating the metal ions of the non-trans fat soil on the pretreated surface to relieve the heavy metals as well as hinder polymerization of the non-trans fat soils according to the methods of the invention.

In some cases, the chelating agent is selected from the group comprising of DTPA, EDTA, MGDA and GLDA. Exemplary commercially available chelating agents include, but are not limited to: sodium gluconate (e.g. granular) and sodium tripolyphosphate (available from Innophos); Trilon A® available from BASF; Versene 100®, Low NTA Versene®, Versene Powder®, and Versenol 120® all available from Dow; GLDA D-40 available from BASF; and sodium citrate.

In some embodiments, an organic chelating/sequestering agent can be used. Organic chelating agents include both polymeric and small molecule chelating agents. Organic small molecule chelating agents are typically organocarboxylate compounds or organophosphate chelating agents. Polymeric chelating agents commonly include polyanionic compositions such as polyacrylic acid compounds. Small molecule organic chelating agents include N-hydroxyethylenediaminetriacetic acid (HEDTA), ethylenediaminetetraacetic acid (EDTA), nitrilotriaacetic acid (NTA), diethylenetriaminepentaacetic acid (DTPA), ethylenediaminetetraproprionic acid triethylenetetraaminehexaacetic acid (TTHA), and the respective alkali metal, ammonium and substituted ammonium salts thereof. Phosphates and aminophosphonates are also suitable for use as chelating agents and include ethylenediaminetetramethylene phosphonates, nitrilotrismethylene phosphonates, 1-hydroxy ethylidene-1,1-diphophonates, diethylenetriamine-(pentamethylene phosphonate, and 2-phosphonobutane-1,2,4-tricarboxylates for example. These aminophosphonates commonly contain alkyl or alkenyl groups with less than 8 carbon atoms.

Other suitable chelating agents include water soluble polycarboxylate polymers. Such homopolymeric and copolymeric chelating agents include polymeric compositions with pendant (—CO2H) carboxylic acid groups and include polyacrylic acid, polymethacrylic acid, polymaleic acid, acrylic acid-methacrylic acid copolymers, acrylic-maleic copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers or copolymers such as their respective alkali metal (for example, sodium or potassium) or ammonium salts can also be used. The weight average molecular weight of the polymers is from about 4000 to about 12,000. As previously mentioned, the chelating agent should be present in an effective amount to hinder metal complexation of free fatty acid salts.

Cleaning Compositions Comprising Chelating Agents

The chelating agent of the invention may be used alone, as a pre-treatment composition in combination with a traditional detergent or cleaner, or may be incorporated within a cleaning composition. The invention comprises both hard surface and soft surface cleaning compositions.

In one embodiment, the invention employs the chelating agent of the invention and water to make a hard surface cleaner which will be effective at removing greasy and oily soils from surfaces such as showers, sinks, toilets, bathtubs, countertops, windows, mirrors, transportation vehicles, floors, and the like. These surfaces can be those typified as "hard surfaces" (such as walls, floors, bed-pans).

In a further embodiment, a cleaning article is provided having a chelating agent incorporated into, the chelating agent being in an effective amount to hinder polymerization of non-trans fats and/or to hinder metal complexation of free fatty acid salts. For example, the chelating agent can be spray-dried onto the cleaning article. Examples of suitable cleaning articles include any type of mop or textile.

A method of preventing fire in a cleaning article is also provided, which includes the steps of providing a cleaning article bearing a non-trans fat and applying an effective amount of chelating agent to said cleaning article, wherein the effective amount is an amount that hinders polymerization of said non-trans fat. In various embodiments the chelating agent should be applied to a cleaning article by applying a solution to the cleaning article. In various embodiments, the chelating agent is present in a solution in an amount of about 10 ppm to about 2,000 ppm. In other embodiments the chelating agent should be present in solution in an amount of about 50 ppm to about 600 ppm. In one embodiment the inclusion of about 100 ppm of chelating agent in a solution is preferred. In other embodiments the chelating agent may be included in the manufacture of the cleaning article.

In yet another embodiment, a chelating agent can be applied to a cleaning article at any stage A through J of the laundry process illustrated in FIG. 1. Chelating agents can also treat non-trans fats in a wide range of temperatures. For example, a chelating agent can be applied during the pre-treating stage D, wherein the cleaning article will be closer to 25° F. In one example, the chelating agent can be applied during the pretreating stage by including it in a pre-treating solution. It can also be applied during the washing stage E, wherein washing commonly occurs at 150° F. In one embodiment, when the chelating agent is applied at the washing stage E, it can be included in a detergent formulation. In some embodiments, the chelating agent is applied after the washing stage E. When the chelating agent is applied after the washing stage E, it can be included in a formulation such as a fabric softener or static guard. In certain embodiments, the chelating agent is applied at all stages A through J.

In a laundry detergent formulation the compositions of the invention typically include the chelating agent of the invention, and a builder, an extended surfactant system, and a water carrier. Examples of such standard laundry detergent ingredients, which are well known to those skilled in the art, are provided in the following paragraphs.

In another embodiment of the invention, the chelating agent of the present invention may be used for removal of other difficult soils including those caused by the ingredients found in many sunscreens. According to the invention between, 350 ppm to 600 ppm of chelating agent added to a detergent with a builder during the wash step of a laundry cycle is effective at removing stains caused by components of sunscreens such as avobenzone and oxybenzone. These stains are not visible until after drying or washing with a high pH product and result in a yellow colored stain on resulting towels, sheets, and the like. The chelating agents may be in combination with a detergent or incorporated with a detergent composition.

The detergent may contain an inorganic or organic detergent builder which counteracts the effects of calcium, or other ion, water hardness. Examples include the alkali metal citrates, succinates, malonates, carboxymethyl succinates, carboxylates, polycarboxylates and polyacetyl carboxylate; or sodium, potassium and lithium salts of oxydisuccinic acid, mellitic acid, benzene polycarboxylic acids, and citric acid; or citric acid and citrate salts. Organic phosphonate type sequestering agents such as DEQUEST® by Monsanto and alkanehydroxy phosphonates are useful. Other organic builders include higher molecular weight polymers and copolymers, e.g., polyacrylic acid, polymaleic acid, and polyacrylic/polymaleic acid copolymers and their salts, such as SOKALAN® by BASF. Generally, the builder may be up to 30%, or from about 1% to about 20%, or from abut 3% to about 10%.

The compositions may also contain from about 0.01% to about 10%, or from about 2% to about 7%, or from about 3% to about 5% of a $C_{8-20}$ fatty acid as a builder. The fatty acid can also contain from about 1 to about 10 EO units. Suitable fatty acids are saturated and/or unsaturated and can be obtained from natural sources such a plant or animal esters (e.g., palm kernel oil, palm oil, coconut oil, babassu oil, safflower oil, tall oil, tallow and fish oils, grease, and mixtures thereof), or synthetically prepared (e.g., via the oxidation of petroleum or by hydrogenation of carbon monoxide via the Fisher Tropsch process). Useful fatty acids are saturated $C_{12}$ fatty acid, saturated $C_{12-14}$ fatty acids, saturated or unsaturated $C_{12-18}$ fatty acids, and a mixture thereof. Examples of suitable saturated fatty acids include captic, lauric, myristic, palmitic, stearic, arachidic and behenic acid. Suitable unsaturated fatty acids include: palmitoleic, oleic, linoleic, linolenic and ricinoleic acid.

Extended Surfactant System

The detergent composition of the present invention may include a surfactant system which includes one or more extended chain surfactants. In one embodiment, the extended chain surfactants suitable for use are compounds of the general formula (1): $R\text{-}[L]_x\text{-}[O\text{—}CH_2\text{—}CH_2]_y\text{—}O\text{—}SO_3A$ (I) where R is a linear or branched, saturated or unsaturated, substituted or unsubstituted, aliphatic or aromatic hydrocarbon radical having from about 8 to 20 carbon atoms; L is a linking group, such as a block of poly-propylene oxide, or a block of poly-ethylene oxide, or a block of poly-butylene oxide or a mixture thereof; A is any cationic species present for charge neutrality such as hydrogen, an alkali metal, alkaline earth metal, ammonium and ammonium ions which may be substituted with one or more organic groups; x is the chain length of the linking group ranging from 5-15; and y is the average degree of ethoxylation ranging from 1-5.

In another embodiment, the extended chain surfactant has a general formula (II): where R is a linear or branched, saturated or unsaturated, substituted or unsubstituted aliphatic hydrocarbon radical having from about 8 to 20 carbon atoms; x is the average degree of propoxylation ranging from 5-15; and y is the average degree of ethoxylation ranging from 1-5.

The extended chain surfactants of formula (II) may be derived by, for example, by the propoxylation, ethoxylation and sulfation of an appropriate alcohol, such as Ziegler, Oxo or natural alcohol of varying chain length and alkyl chain distributions ranging from about 8 to 20 carbon atoms. Examples of appropriate alcohols include commercially available alcohols such as ALFOL® (Vista Chem. Co.), SAFOL® (Sasol Ltd.), NEODOL® (Shell), LOROL® (Henkel), etc.

Suitable chemical processes for preparing the extended chain surfactants of formula (II) include the reaction of the appropriate alcohol with propylene oxide and ethylene oxide in the presence of a base catalyst, such as sodium hydroxide, potassium hydroxide or sodium methoxide, to produce an alkoxylated alcohol. The alkoxylated alcohol may then be reacted with chlorosulfonic acid or $SO_3$ and neutralized to produce the extended chain surfactant.

In a preferred embodiment for greasy and oily soils, the extended chain surfactant is an anionic extended chain surfactant.

Many extended chain anionic surfactants useful for the present invention are commercially available from a number of sources. Table 1 is a representative, nonlimiting listing several examples of the same.

TABLE 1

| Extended Surfactants | Source | % Active | Structure |
|---|---|---|---|
| Plurafac SL-42 | BASF | 100 | $C_{6-10}$-$(PO)_3(EO)_6$ |
| Plurafac SL-62 | BASF | 100 | $C_{6-10}$-$(PO)_3(EO)_8$ |
| Lutensol XL-40 | BASF | 100 | $C_{10}$-$(PO)_a(EO)_b$ series |
| Lutensol XL-50 | BASF | 100 | |
| Lutensol XL-60 | BASF | 100 | |
| Lutensol XL-70 | BASF | 100 | |
| Lutensol XL-79 | BASF | 85 | |
| Lutensol XL-80 | BASF | 100 | |
| Lutensol XL-89 | BASF | 80 | |
| Lutensol XL-90 | BASF | 100 | |
| Lutensol XL-99 | BASF | 80 | |
| Lutensol XL-100 | BASF | 100 | |
| Lutensol XL-140 | BASF | 100 | |
| Ecosurf EH-3 | Dow | 100 | 2-Ethyl Hexyl |
| Ecosurf EH-6 | Dow | 100 | $(PO)_m(EO)_n$ series |
| Ecosurf EH-9 | Dow | 100 | |
| Ecosurf SA-4 | Dow | 100 | $C_{6-12}$ $(PO)_{3-4}$ $(EO)_4$ |
| Ecosurf SA-7 | Dow | 100 | $C_{6-12}$ $(PO)_{3-4}$ $(EO)_7$ |
| Ecosurf SA-9 | Dow | 100 | $C_{6-12}$ $(PO)_{3-4}$ $(EO)_9$ |
| Surfonic PEA-25 | Huntsman | 100 | |
| X-AES | Huntsman | 23 | $C_{12-14}$-$(PO)_{16}$-$(EO)_2$-sulfate |
| X-LAE | Huntsman | 100 | $C_{12-14}$-$(PO)_{16}(EO)_{12}$ |
| Alfoterra 123-4S | Sasol | 30 | $C_{12-13}$-$(PO)_4$-sulfate |
| Alfoterra 123-8S | Sasol | 30 | $C_{12-13}$-$(PO)_8$-sulfate |
| Marlowet 4561 | Sasol | 90 | $C_{16}$-$C_{18}$-alcohol polyalkylene glycol ether carboxylic acids |
| Marlowet 4560 | Sasol | 90 | $C_{16}$-$C_{18}$-alcohol polyalkylene glycol ether carboxylic acids |
| Marlowet 4539 | Sasol | 90 | $C_9$-alcohol polyethylene glycol ether liquid carboxylic acids |

Formation of Microemulsions

A microemulsion forming formula can serve in the pretreating step (D) or as the detergent used during washing at stage E of FIG. 1. Preferably, the microemulsion forming formula includes an extended surfactant as described above.

Tables 2-7, illustrated below, illustrate certain microemulsion forming formulas that can be used. Table 2 illustrates formulas including 15%, 20% and 25% EDTA.

TABLE 2

| | 15% EDTA | 20% EDTA | 25% EDTA |
|---|---|---|---|
| DI Water | 57.34 | 52.34 | 47.34 |
| X-AES, 23% | 14.36 | 14.36 | 14.36 |
| Plurafac SL-42 | 3.30 | 3.30 | 3.30 |
| Barlox 12, 30% | 10.00 | 10.00 | 10.00 |
| EDTA, 40% | 15.00 | 20.00 | 25.00 |
| TOTAL | 100.00 | 100.00 | 100.00 |
| Cloud Point, ° F. | 132 | 114 | 99 |
| % Active Chelant | 6 | 8 | 10 |
| % Active Surfactant | 9.6 | 9.6 | 9.6 |

Table 3 illustrates formulas including 10%, 15% and 20% MGDA.

TABLE 3

| | 10% MGDA | 15% MGDA | 20% MGDA |
|---|---|---|---|
| DI Water | 62.34 | 57.34 | 52.34 |
| X-AES, 23% | 14.36 | 14.36 | 14.36 |
| Plurafac SL-42 | 3.30 | 3.30 | 3.30 |
| Barlox 12, 30% | 10.00 | 10.00 | 10.00 |
| MGDA, 40% | 10.00 | 15.00 | 20.00 |
| TOTAL | 100.00 | 100.00 | 100.00 |
| Cloud Point, ° F. | 146 | 124 | 115 |
| % Active Chelant | 4 | 6 | 8 |
| % Active Surfactant | 9.6 | 9.6 | 9.6 |

Table 4 illustrates formulas including 10% and 20% GLDA.

TABLE 4

| | 10% GLDA | 20% GLDA |
|---|---|---|
| DI Water | 62.34 | 52.34 |
| X-AES, 23% | 14.36 | 14.36 |
| Plurafac SL-42 | 3.30 | 3.30 |
| Barlox 12, 30% | 10.00 | 10.00 |
| GLDA, 38% | 10.00 | 20.00 |
| TOTAL | 100.00 | 100.00 |
| Cloud Point, ° F. | 131 | ~90 |
| % Active Chelant | 3.8 | 7.6 |
| % Active Surfactant | 9.6 | 9.6 |

Table 5 illustrates formulas containing monoethanolamine which acts as a weak base to add alkalinity to the formula for enhanced performance and cleaning and also a linker to boost the efficacy of the surfactants.

TABLE 5

| | μEM #9 Forming formula | μEM #10 Forming formula | μEM #11 Forming formula | μEM #12 Forming formula | μEM #13 Forming formula |
|---|---|---|---|---|---|
| DI Water | 52.34 | 47.34 | 42.34 | 66.70 | 76.70 |
| X-AES, 23% | 14.36 | 14.36 | 14.36 | | |
| EH-6 | 3.30 | 3.30 | 3.30 | 23.30 | 23.30 |
| Barlox 12, 30% | 10.00 | 10.00 | 10.00 | | |
| GLDA, 38% | 10.00 | 10.00 | 10.00 | | |
| MGDA, 40% | 10.00 | 10.00 | 10.00 | | |
| MEA | | 5.00 | 10.00 | | |
| Tegin ISO | | | | 10.00 | |
| TOTAL | 100.00 | 100.00 | 100.00 | 100.00 | 100.00 |
| Cloud Point, ° F. | 112 | 116 | 120 | | |
| % Active Chelant | 7.8 | 7.8 | 7.8 | | |
| % Active Surfactant | 9.6 | 9.6 | 9.6 | 23.3 | 23.3 |

Tables 6 and 7 illustrate maximum concentration microemulsion forming formulas incorporating an anionic surfactant to work in synergy with the non-ionic surfactant.

TABLE 6

| | MCF (Maximum Concentration Formula) | MCF-A | MCF-B | MCF-C | MCF-D | MCF-E |
|---|---|---|---|---|---|---|
| DI Water | 2.25 | 13.3 | 13.3 | 37.52 | 37.52 | 37.52 |
| EH-6 | 10.89 | 10.89 | 10.89 | 10.89 | 10.89 | 10.89 |
| X-AES, 23% | 47.39 | | | | | |
| Alfoterra 123-4S, 30% | | 36.33 | | | | |
| Alfoterra 123-8S, 30% | | | 36.33 | | | |
| Marlowet 4561, 90% | | | | 12.11 | | |
| Marlowet 4560, 90% | | | | | 12.11 | |
| Marlowet 4539, 90% | | | | | | 12.11 |
| Barlox 12, 30% | 33.00 | 33.00 | 33.00 | 33.00 | 33.00 | 33.00 |
| Dissolvine GL-38S | 2.78 | 2.78 | 2.78 | 2.78 | 2.78 | 2.78 |
| Trilon M, 40% | 2.64 | 2.64 | 2.64 | 2.64 | 2.64 | 2.64 |
| MEA | 1.06 | 1.06 | 1.06 | 1.06 | 1.06 | 1.06 |
| TOTAL | 100.01 | 100.00 | 100.00 | 100.00 | 100.00 | 100.00 |
| Foam Ht, ml (1500 ppm active surfactant) | 60 | 75 | 59 | 53 | 40 | 54 |
| % Active Chelant | 2.11 | 2.11 | 2.11 | 2.11 | 2.11 | 2.11 |
| % Active Surfactant | 31.69 | 31.69 | 31.69 | 31.69 | 31.69 | 31.69 |
| 100% pH | 10.98 | 11.24 | 11.17 | 10.16 | 9.84 | 8.88 |

These formulas have been tested to quickly and efficiently form microemulsions with soybean oil at room temperature and higher temperatures such as 150° F. These formulas can therefore be preferentially used as pre-spotting or pre-soaking formulas on heavily soiled items (step D in FIG. 1) or as washwheel formulas (step E in FIG. 1).

Use of Extended Surfactants and Microemulsions for the Reduction of Smoking in Laundry Fabrics There have been reports of undesirable smoking issues for laundry particularly when a washed fabric comes in contact with a hot iron. This is due to a switch from nonyl phenol ethoxylate (NPE) based detergents to alcohol phenol ethoxylate (APE) based detergents. The problem is due to the residual unreacted long chain alcohols which are highly soluble in APE based detergents. It is well known in the surfactant industry that APEs are more monodisperse and have less unreacted alcohol than the AEs, because the starting alkyl phenols are more reactive than the starting linear alcohols. The use solution cannot suspend all the highly insoluble unreacted alcohol, which deposits onto a washed fabric and can cause smoking when the fabric comes in contact with a hot iron.

The extended surfactants and microemulsions of the present invention undergo two steps of alkoxylation (first propoxylation or butoxylation, then followed with ethoxylation) and therefore have reduced levels of residual (unreacted) alcohol, specifically below 0.1%. Thus after the laundry process, the extended surfactants and microemulsions of the present invention leave less residue from the highly insoluble long chain alcohols onto the washed fabric, which in turn greatly reduces the smoking when these washed fabrics come in contact with hot irons.

Optional Surfactants

Optional surfactants may be included in the soil release composition of the present invention. The surfactant or surfactant admixture can be selected from water soluble or water

TABLE 7

| | MCF (Maximum Concentration Formula) | MCF-F | MCF-G | MCF-H | MCF-J | MCF-K | MCF-L |
|---|---|---|---|---|---|---|---|
| DI Water | 2.25 | 13.3 | 13.3 | 37.52 | 37.52 | 40.05 | 35.22 |
| EH-6, 100% | 10.89 | 10.89 | 10.89 | 10.89 | 10.89 | 10.89 | 10.89 |
| X-AES, 23% | 47.39 | | | | | | |
| Naxon DIL, 35% | | 31.14 | | | | | |
| Colatrope, 45% | | | 24.22 | | | | |
| SLA, 70% | | | | 15.57 | | | |
| Dowfax 3B2, 47% | | | | | 23.19 | | |
| Isononanoic Acid, 99% | | | | | | 9.58 | 9.58 |
| Barlox 12, 30% | 33.00 | 33.00 | 33.00 | 33.00 | 33.00 | 33.00 | 33.00 |
| Sodium Hydroxide, 50% | | | | | | | 4.83 |
| Dissolvine GL-38S | 2.78 | 2.78 | 2.78 | 2.78 | 2.78 | 2.78 | 2.78 |
| Trilon M, 40% | 2.64 | 2.64 | 2.64 | 2.64 | 2.64 | 2.64 | 2.64 |
| MEA | 1.06 | 1.06 | 1.06 | 1.06 | 1.06 | 1.06 | 1.06 |
| TOTAL | 100.00 | 100.00 | 100.00 | 100.00 | 100.00 | 100.00 | 100.00 |
| Foam Ht, ml (1500 ppm active surfactant) | 60 | 66 | 61 | 60 | 71 | 27 | 59 |
| % Active Chelant | 2.11 | 2.11 | 2.11 | 2.11 | 2.11 | 2.11 | 2.11 |
| % Active Surfactant | 31.69 | 31.69 | 31.69 | 31.69 | 31.69 | 30.27 | 30.27 |
| 100% pH | 10.98 | 11.20 | 11.29 | 10.43 | 11.35 | 7.62 | 11.29 |

dispersible nonionic, semi-polar nonionic, anionic, cationic, amphoteric, or zwitterionic surface-active agents; or any combination thereof. The particular surfactant or surfactant mixture chosen can depend on the conditions of final utility, including method of manufacture, physical product form, use pH, use temperature, foam control, and soil type. Surfactants incorporated into the stabilized enzyme cleaning compositions of the present invention are preferably enzyme compatible, not substrates for the enzyme, and not inhibitors or inactivators of the enzyme. For example, when proteases and amylases are employed in the present compositions, the surfactant is preferably free of peptide and glycosidic bonds. In addition, certain cationic surfactants are known in the art to decrease enzyme effectiveness.

A preferred surfactant system of the invention can be selected from amphoteric species of surface-active agents, which offer diverse and comprehensive commercial selection, low price; and, most important, excellent detersive effect—meaning surface wetting, soil penetration, soil removal from the surface being cleaned, and soil suspension in the detergent solution. Despite this preference the present composition can include one or more of nonionic surfactants, anionic surfactants, cationic surfactants, the sub-class of nonionic entitled semi-polar nonionics, or those surface-active agents which are characterized by persistent cationic and anionic double ion behavior, thus differing from classical amphoteric, and which are classified as zwitterionic surfactants.

Generally, the concentration of surfactant or surfactant mixture useful in stabilized liquid enzyme compositions of the present invention fall in the range of from about 0.5% to about 40% by weight of the composition, preferably about 2% to about 10%, preferably about 5% to about 8%. These percentages can refer to percentages of the commercially available surfactant composition, which can contain solvents, dyes, odorants, and the like in addition to the actual surfactant. In this case, the percentage of the actual surfactant chemical can be less than the percentages listed. These percentages can refer to the percentage of the actual surfactant chemical.

Preferred surfactants for the compositions of the invention include amphoteric surfactants, such as dicarboxylic coconut derivative sodium salts.

A typical listing of the classes and species of surfactants useful herein appears in U.S. Pat. No. 3,664,961 issued May 23, 1972, to Norris.

Surface Modifying Agents

Surface Modifying Agents may be optionally included in the soil release composition of the present invention. Exemplary commercially available surface modifying agents include, but are not limited to: sodium silicate, sodium metasilicate, sodium orthosilicate, potassium silicate, potassium metasilicate, potassium orthosilicate, lithium silicate, lithium metasilicate, lithium orthosilicate, aluminosilicates and other alkali metal salts and ammonium salts of silicates. Exemplary commercially available acrylic type polymers include acrylic acid polymers, methacrylic acid polymers, acrylic acid-methacrylic acid copolymers, and water-soluble salts of the said polymers. These include polyelectrolytes such as water soluble acrylic polymers such as polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, hydrolyzed methacrylamide, hydrolyzed acrylamide-methacrylamide copolymers, and combinations thereof. Such polymers, or mixtures thereof, include water soluble salts or partial salts of these polymers such as their respective alkali metal (for example, sodium or potassium) or ammonium salts can also be used. The weight average molecular weight of the polymers is from about 2000 to about 20,000.

Optional Cleaning Enhancement Agents

Optional cleaning enhancement agents can be included, such as sulfite and peroxygen based compounds. In some embodiments, sulfite sources are included, such as water soluble salts of sulfite ion ($SO_3^{-2}$), bisulfite ion ($HSO_3$), meta bisulfite ion ($S_2O_5^{-2}$) and hydrosulfite ion ($S_2O_4^{-2}$) and mixtures thereof. In other embodiments, peroxygen compounds are included. Peroxygen compounds, include, but are not limited to, hydrogen peroxide, peroxides and various percarboxylic acids, including percarbonates, can be used with the methods of the present invention. Peroxycarboxylic (or percarboxylic) acids generally have the formula $R(CO_3H)n$, where, for example, R is an alkyl, arylalkyl, cycloalkyl, aromatic, or heterocyclic group, and n is one, two, or three, and named by prefixing the parent acid with peroxy. The R group can be saturated or unsaturated as well as substituted or unsubstituted. Medium chain peroxycarboxylic (or percarboxylic) acids can have the formula $R(CO_3H)n$, where R is a $C_5$-$C_{11}$ alkyl group, a $C_5$-$C_{11}$ cycloalkyl, a $C_5$-$C_{11}$ arylalkyl group, $C_5$-$C_{11}$ aryl group, or a $C_5$-$C_{11}$ heterocyclic group; and n is one, two, or three. Short chain perfatty acids can have the formula $R(CO_3H)n$ where R is $C_1$-$C_4$ and n is one, two, or three.

Exemplary peroxycarboxylic acids for use with the present invention include, but are not limited to, peroxypentanoic, peroxyhexanoic, peroxyheptanoic, peroxyoctanoic, peroxynonanoic, peroxyisononanoic, peroxydecanoic, peroxyundecanoic, peroxydodecanoic, peroxyascorbic, peroxyadipic, peroxycitric, peroxypimelic, or peroxysuberic acid, mixtures thereof, or the like. Branched chain peroxycarboxylic acids include peroxyisopentanoic, peroxyisononanoic, peroxyisohexanoic, peroxyisoheptanoic, peroxyisooctanoic, peroxyisonananoic, peroxyisodecanoic, peroxyisoundecanoic, peroxyisododecanoic, peroxyneopentanoic, peroxyneohexanoic, peroxyneoheptanoic, peroxyneooctanoic, peroxyneononanoic, peroxyneodecanoic, peroxyneoundecanoic, peroxyneododecanoic, mixtures thereof, or the like.

Additional exemplary peroxygen compounds include hydrogen peroxide ($H_2O_2$), peracetic acid, peroctanoic acid, a persulphate, a perborate, or a percarbonate. In some embodiments, the active oxygen use solution cleaning composition comprises at least two, at least three, or at least four active oxygen sources. In other embodiments, the cleaning composition can include multiple active oxygen sources, for example, active oxygen sources that have a broad carbon chain length distribution. In still yet other embodiments, For example, combinations of active oxygen sources for use with the methods of the present invention can include, but are not limited to, peroxide/peracid combinations, and peracid/peracid combinations. In other embodiments, the active oxygen use solution comprises a peroxide/acid or a peracid/acid composition.

Optional Thickening Agents

Optional thickening agents can be included to enhance residence time on the laundry. Suitable thickening agents include, but are not limited to, natural polysaccharides such as xanthan gum, carrageenan and the like; or cellulosic type thickeners such as carboxymethyl cellulose, and hydroxymethyl-, hydroxyethyl-, and hydroxypropyl cellulose; or, polycarboxylate thickeners such as high molecular weight polyacrylates or carboxyvinyl polymers and copolymers; or, naturally occurring and synthetic clays; and finely divided fumed or precipitated silica, to list a few.

Diluent(s)

The composition of the present invention can be formulated in a concentrated form which then may be diluted to the desired concentration merely with water at the intended use location. Ordinary tap water, softened water or process water may be employed. The composition concentrates and various dilutions of these concentrates (typically can be used at full strength concentrate down to a 1:100 concentrate: water dilution) can be used on polymerized non-trans fat soils of various difficulties to remove. (A more difficult to remove polymerized non-trans fat soil will generally have a higher level of polymerization.) A variety of mixing methods may be employed (such as automated or manual dilutions) and various levels of additives, such as thickening agents, can be mixed in with the diluted composition depending on the specific needs of the cleaning operation.

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques. All references cited herein are hereby incorporated in their entirety by reference.

EXAMPLES

Test Procedures

Differential Scanning Calorimetry Technique (DSC)

Applicant used an isothermal differential scanning calorimetry technique (DSC) in certain test methods described below. DSC is a thermoanalytical technique that measures the difference in heat flow rate between a test fabric sample and reference fabric sample as a function of time and temperature. In Applicant's DSC method, Applicant sealed test samples in hermetic DSC pans to trap oxygen with each sample. Applicant also sealed a control sample in a hermetic DSC pan. Applicant then held each sample at a constant temperature (e.g., 130° C.) for an extended period of time (e.g., 120 minutes) while performing a DSC on each sample, using a DSC calorimeter (e.g., a DSC from TA Instruments Q200). The DSC calorimeter measured the rate and amount of heat released by each sample at the constant temperature as a function of time. Applicant then generated DSC curves by plotting heat flow (W/g) versus time (minutes). Applicant used the reference sample to establish a baseline. For each test sample, Applicant chose a flat region of the baseline after heat release is complete and extrapolated the baseline back towards zero minutes. Applicant then quantified the amount of heat released by the sample (i.e., the area of exotherm) by integrating the area between the heat flow curve and extrapolated baseline. Also, instrument thermal lag causes an initial start-up hook in the DSC curve before heat flow stabilizes. Applicant used the heat released by the control sample to quantify the instrument thermal lag contribution to actual test samples and to determine the time of peak heat flow.

By using DSC, Applicant simulated the Differential Mackey Test, ASTM D3523, which measures the spontaneous heating value of a liquid or solid that is expected to occur upon exposure of the sample to air at a test temperature. Applicant's DSC curves allowed Applicant to study the tendency of a test fabric to self-heat to the point of spontaneous combustion. The area of exotherm and time of peak heat flow of a sample is believed to be directly related to its propensity to spontaneously combust.

Tergotometer Test

Additionally, Applicant used a tergotometer test in certain test methods. A tergotometer test evaluates laundry products in the lab for soil removal and/or soil redeposition by the use of a tergotometer. In this test, soiled swatches are read on a HunterLab UltraScan. Then, they are washed for ten minutes in a tergotometer, rinsed, air dried and re-read. A standard detergent is always run for comparison.

Commercial Detergent Used for Testing

Applicant uses the terms "commercial detergent A" and "commercial detergent B". Commercial detergent A is an alcohol ethoxylated based composition and Commercial Detergent B is a NPE based composition.

Examples of Non-Trans Fat Soil Removal

Applicant has identified several reasons for the sudden increase in frequency of laundry fires. The food industry now uses almost exclusively non-trans fats for cooking. Applicant has concluded that a link exists between these non-trans fats and laundry fires. In order to explore this link, Applicant compared certain properties of linseed oil, soybean oil, olive oil, lard, and trans fat. These properties are summarized in Table 8 below. Linseed oil is a drying oil commonly used in paints, which is well known for its ability to cause a large, compact mass of rags soaked in the oil to ignite spontaneously. Soybean oil and olive oil are non-trans fat oils commonly used by the food industry. Lard has a large percentage of saturated fatty acid triglyceride and trans fats are unsaturated fatty acids in a lower energy state in the trans configuration.

TABLE 8

| | Oleic Acid 18:1 | Linoleic Acid 18:2 | Linolenic Acid 18.3 | Iodine Value | Heat of Poly-merization |
|---|---|---|---|---|---|
| Linseed Oil | 19 | 24 | 47 | 178 | High |
| Soybean Oil | 24 | 54 | 7 | 130 | High |
| Olive Oil | 71 | 10 | 1 | 81 | Medium to Low |
| Lard | 44 | 10 | 0 | 65 | Low |
| Trans fat | ~100 (trans configuration) | | | | Very Low |

As shown in Table 8, soybean oil has similarities to linseed oil. Both contain higher concentrations of linoleic acid and linolenic acid triglycerides. Linoleic acid contains two conjugated double bonds and linolenic acid contains three conjugated double bonds. When linolenic acid reaches auto-ignition temperature, the heat from one double bond heats up the next double bond, causing a chain reaction. As a result, laundry textiles soaked in oils high in linolenic acid can spontaneously combust. The more linolenic acid present on the textile, the greater the chance of spontaneous combustion. Additionally, both oils have an iodine value of 130 or higher. Oils with this iodine value are considered drying oils that have a high number of conjugated double bonds that can lead to polymerization. Finally, both oils have a high heat of polymerization. Here, Applicant established that laundry textiles bearing non-trans fat oils such as soybean oil have a greater chance of spontaneously combusting. On the other hand, a highly saturated fat such as lard has a lower concentration of linoleic acid and linolenic acid, a low iodine value and a low heat of polymerization. A trans fat is created with a catalyzed partial hydrogenation process that eliminates most of the double bonds with the remaining double bonds in a lower energy state trans configuration. As such, textiles bearing trans fat oils are far less likely to spontaneously combust.

Figure 2:
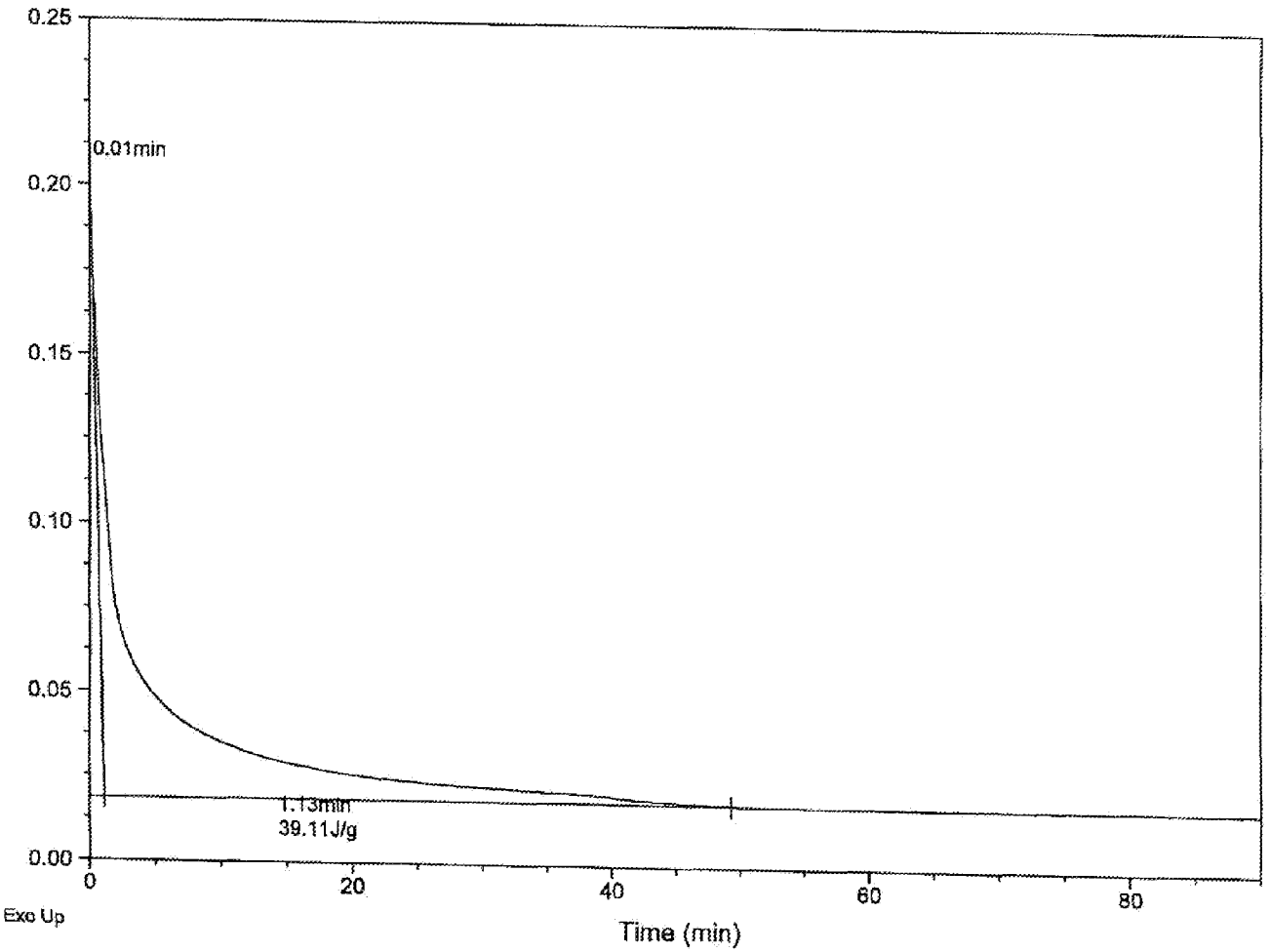
FIG. 2 is a DSC chart for a cotton terry swatch containing oleic acid.
Figure 3:
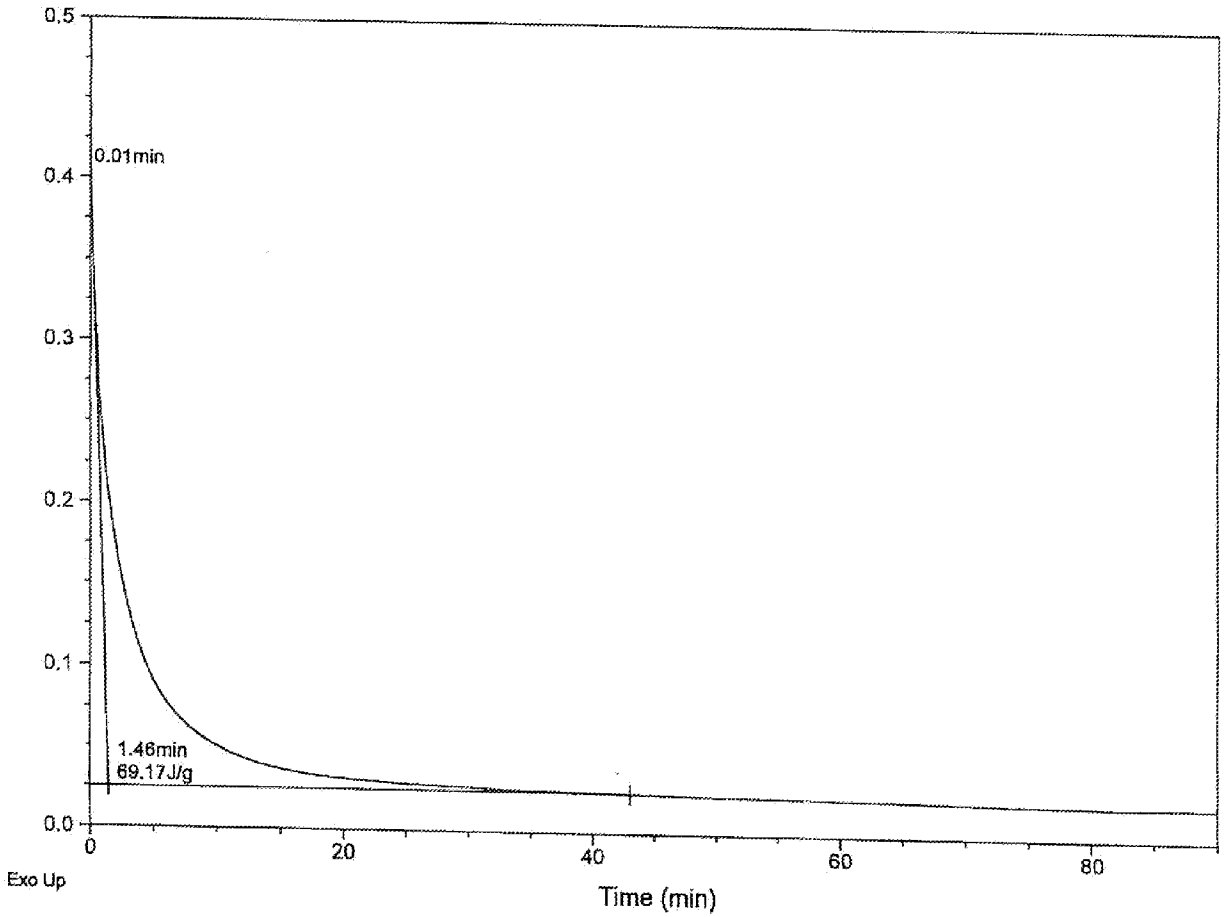
FIG. 3 is a DSC chart for a cotton terry swatch containing linoleic acid.
Figure 4:
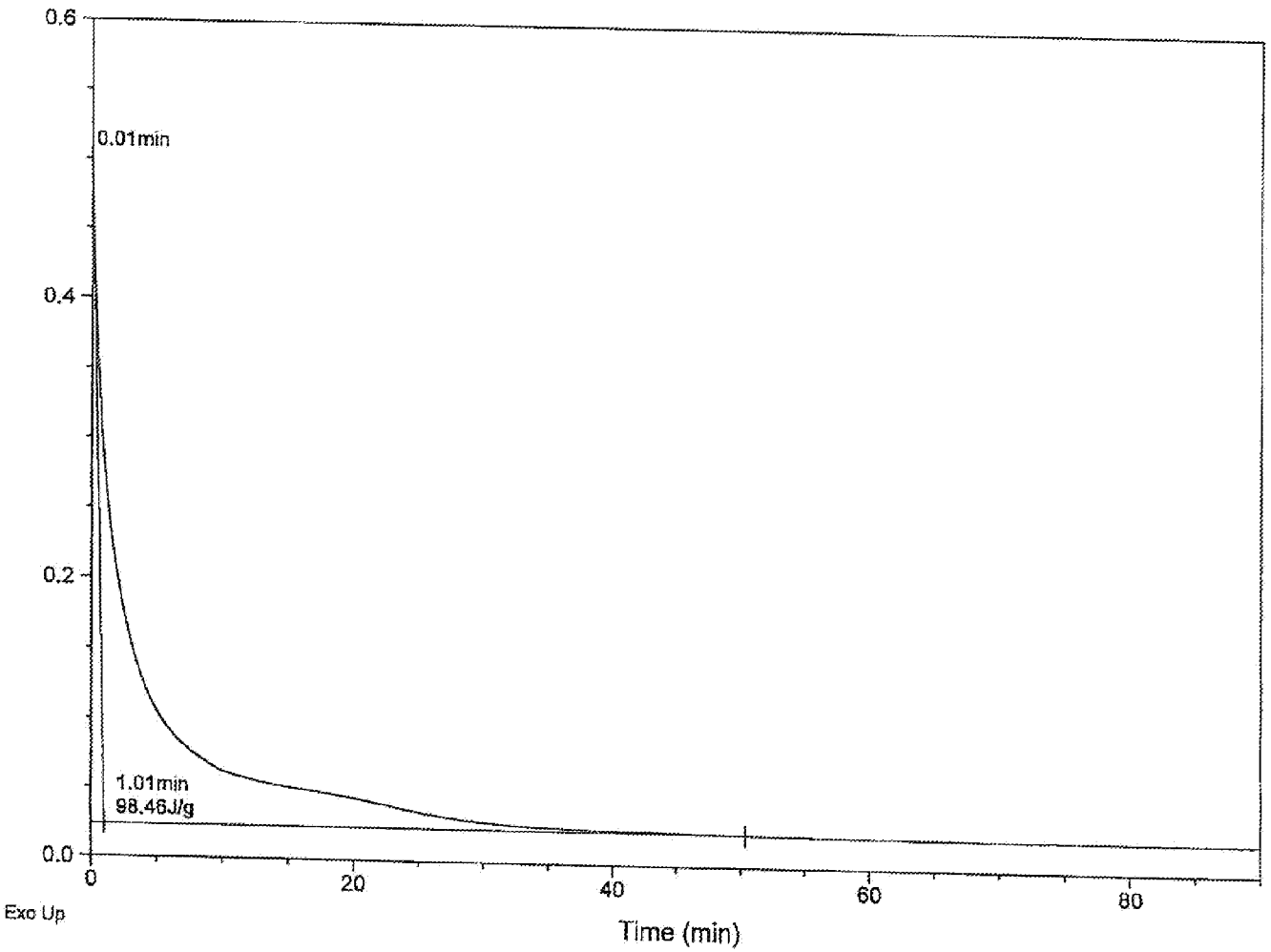
FIG. 4 is a DSC chart for a cotton terry swatch containing linolenic acid.

Applicant used a DSC technique to determine the area of exotherm and time of peak values for oleic acid, linoleic acid and linolenic acid. The DSC charts obtained for oleic acid, linoleic acid and linolenic acid are illustrated in FIGS. 2, 3 and 4, respectively. The area of exotherm values are summarized in Table 9 below. As shown, linolenic acid has a higher area of exotherm than both oleic acid and linoleic acid. The higher the area of exotherm, the more likely an acid is to spontaneously combust. Thus, non-trans fats such as soybean oil contain more linoleic and linolenic acids, making them more likely to combust and thus contributing to the high frequency of laundry fires. More importantly, the free unsaturated fatty acids exotherm immediately and with much higher magnitude than the triglycerides, suggesting they can be a more problematic by product in a spent triglyceride (for example, by hydrolysis).

TABLE 9

| | Area of Exotherm (J/g) |
|---|---|
| Oleic Acid | 38.7 |
| Linoleic Acid | 102.6 |
| Linolenic Acid | 120.9 |

Applicant also discovered that non-trans fat oils contain heavy metal ions that act as oxidative catalysts in polymerization. There also appears to be a link between these heavy metal ions and the frequency of laundry fires. Skilled artisan previously did not explore such a link, because non-trans fat oils are initially treated and purified to remove heavy metal ions. However, Applicant noted that these purification processes are not always complete, allowing some heavy metal ions to remain in the oil. Applicant also discovered that non-trans fat oils pick up additional heavy metal ions from cooking processes. For example, oils cooked in metals (e.g. metal pots and pans) have more heavy metal ions than oils cooked in non-metals. In one example, Applicant observed the effect on the rate of polymerization from the cooking of soybean oil in stainless steel, ceramic and glass. Equal amount of soybean oil was spread on stainless steel, ceramic and glass substrates and subjected to different durations of baking in an oven maintained at 375° F. The rate of polymerization of the soybean oil was compared immediately after taking the substrates out of the oven. The test results showed a trend of stainless steel>ceramic>glass in the rate of polymerization of the oil.

Thus, non-trans fat oils indeed pick up additional heavy metal ions from cooking processes. Cooking processes can also produce more free fatty acids, making non-trans fat oils even more combustible. The free fatty acids can also form lime soaps, making it more difficult to remove oils from laundry textiles. In turn, operators use old rags and towels to clean additional non-trans fat oil soils and spills. Upon repeated laundry processes, old laundry textiles appear to have accumulated heavy metal ions that aid in polymerization.

After discovering that heavy metal ions increase the rate of polymerization in non-trans fat oils, Applicant sought out a way to pacify these metal ions as catalysts. Applicant tested various approaches, such as enhancing redeposition agents, using antioxidants, adding alkalinity, adding solvents, adding surfactants, including enzymes, providing an oxygen barrier to fabrics, adding fire retardants, adding free radical depolymerizers, and adding chelating agents. Applicant has surprisingly found great success using chelating agents. Applicant has now discovered that by treating non-trans fats with a chelating agent, the heavy metal oxidizing catalysts are pacified, thus reducing or hindering polymerization. The following examples illustrate the effect of treating non-trans fat oil with a chelating agent.

Figure 22:
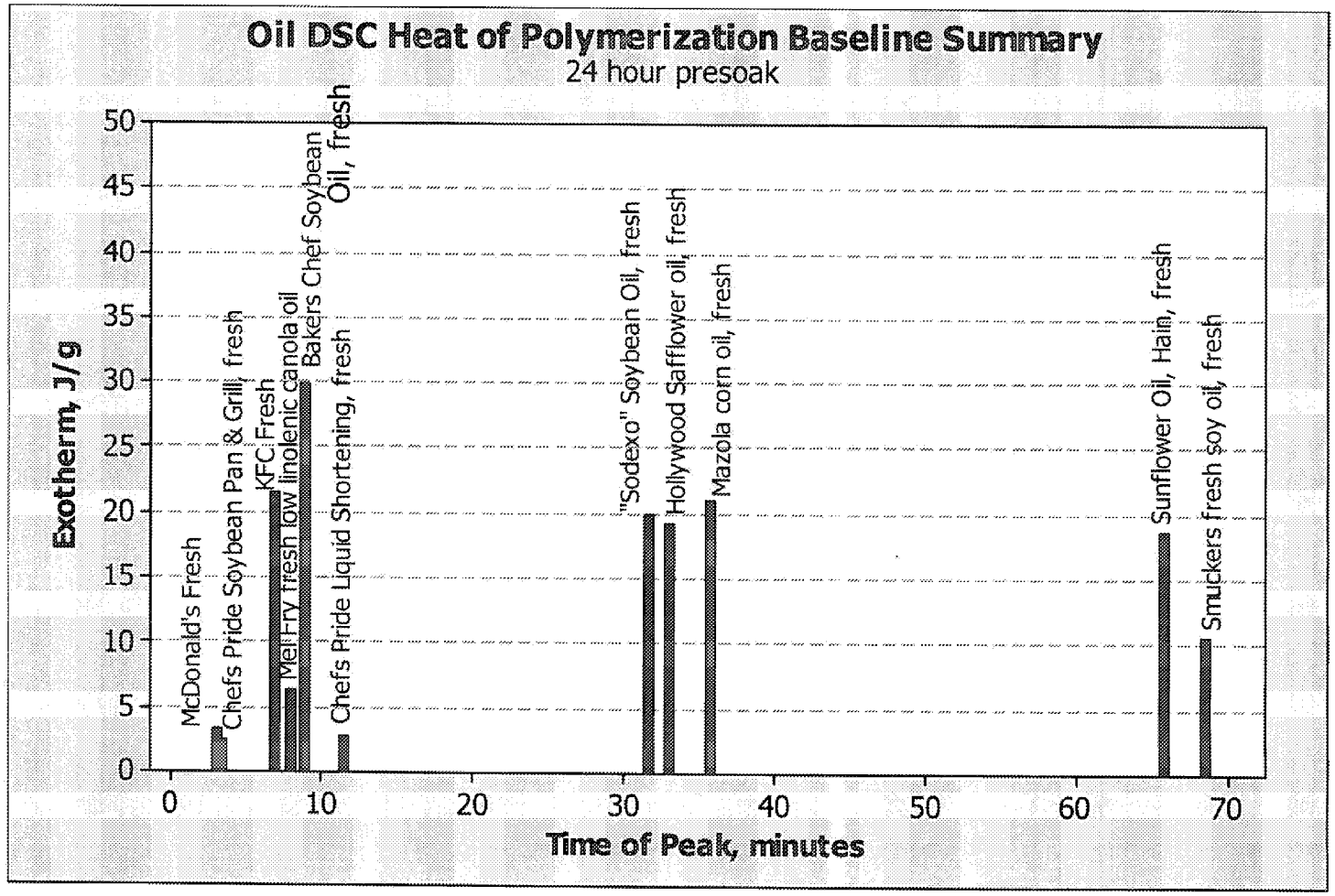
FIG. 22 is a graph showing area of exotherm and time of peak values for certain fresh soybean oils.
Figure 31:
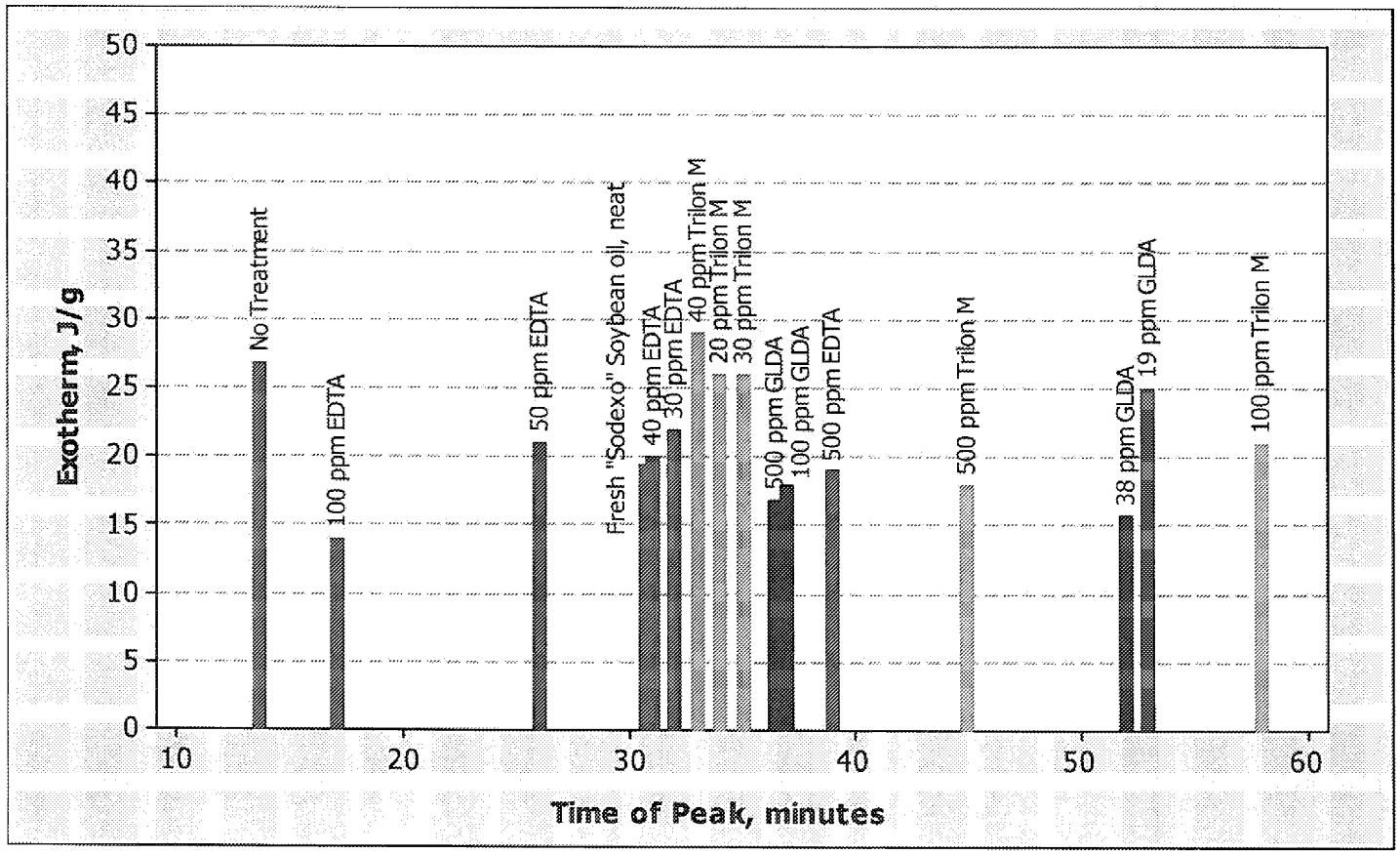
FIG. 31 is a graph showing area of exotherm and time of peak values for cotton terry swatches soiled with fresh soybean oil and washed in a detergent solution and different concentrations of chelating agents.
Figure 32:
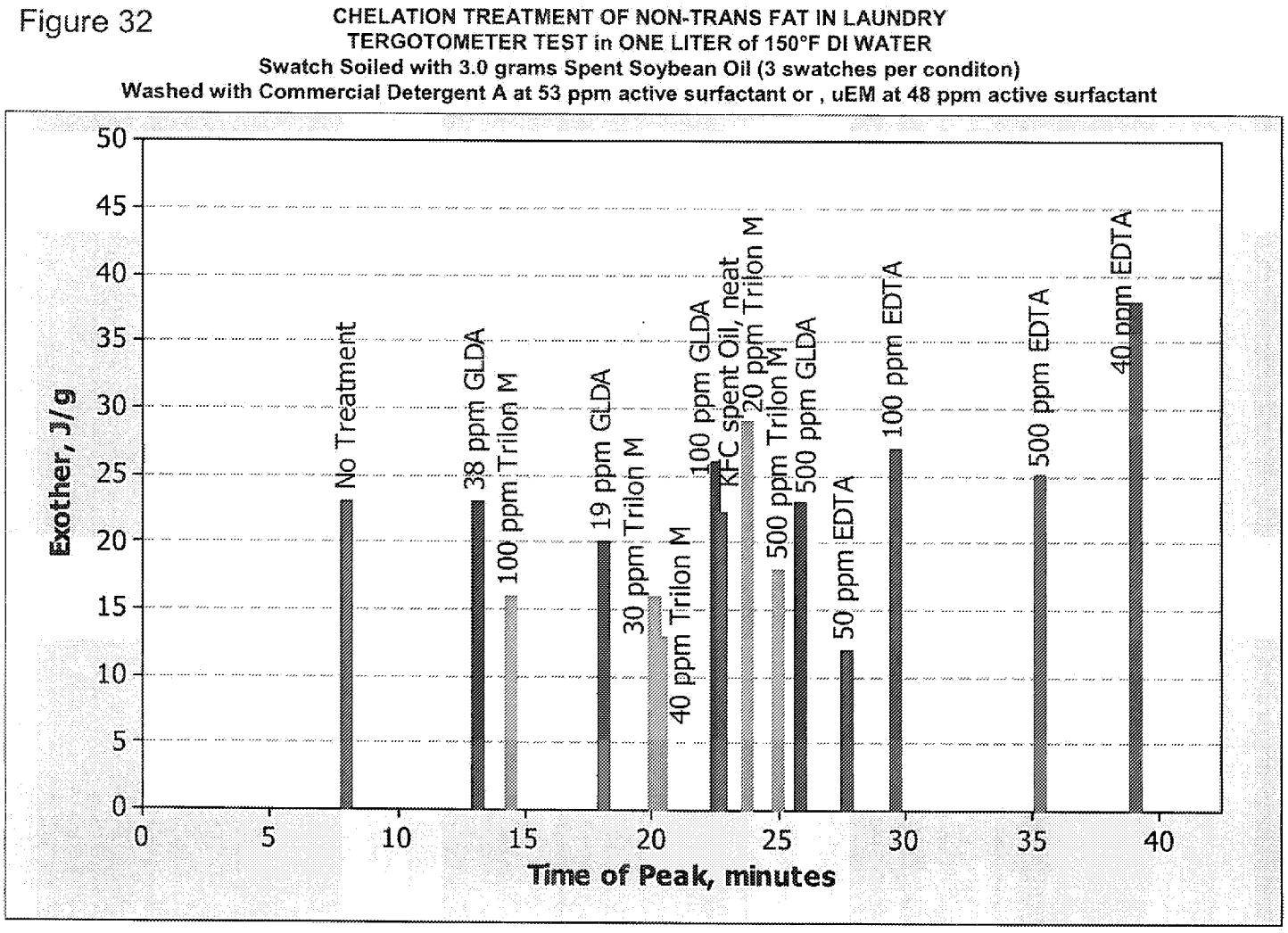
FIG. 32 is a graph showing area of exotherm and time of peak values for cotton terry swatches soiled with spent soybean oil and washed in a detergent solution and different concentrations of chelating agent.

Applicants have studied many different non-trans fat oils with the DSC method. These values are illustrated in FIG. 22. These appear to correlate with the compositions of polyunsaturation. For example, the Mel Fry oil is a low linolenic canola oil and shows a very low exotherm (low fire hazard). Thus, Applicant can analyze the oil compositions and design a cleaning and treatment program accordingly.

Example #1

Applicant first sought to determine the effect on polymerization when a cotton terry swatch ("swatch") soiled with soybean oil was treated with three different chelating agents (EDTA (ethylenediaminetraacetic acid), MGDA (methylglycinediacetic acid) or GLDA (tetrasodium L-glutamic acid, N, N-diacetic acid)). Applicant compared the following five swatch types:

1. Unsoiled, no soybean oil, no treatment.
2. Soybean oil soiled only, no treatment.
3. Soybean oil soiled, treated with ~40% EDTA.
4. Soybean oil soiled, treated with ~40% MGDA.
5. Soybean oil soiled, treated with ~38% GLDA.

Applicant soiled swatch types 2-5 with 0.5 grams of soybean oil. Applicant also applied a chelating agent at equal active (0.5% active) in swatch types 3-5. The soybean oil and chelating agents were allowed to soak in the swatches for 24 hours and then rinsed with DI water. The swatches were then allowed to air dry for 24 hours. Finally, Applicant generated a DSC curve for each swatch. These curves are shown in FIGS. 5-9 and the data obtained from each of these curves are summarized in Table 10 below. It should be noted that the Time of Peak Heat Flow is either (1) the time at which a peak takes place, or (2) if no peak takes place, the time of the midpoint of the area under the DSC curve.

TABLE 10

| Swatch Type | FIG. Showing DSC | Time of Peak Heat Flow (mins) | Area of Exotherm (J/g) |
|---|---|---|---|
| 1. Unsoiled | FIG. 5 | 2 | 3.103 |
| 2. Soybean Oil Only | FIG. 6 | 30-35 | 20.32 |
| 3. Soybean Oil Treated With EDTA | FIG. 7 | 70-75 | 25.77 |
| 4. Soybean Oil Treated With MGDA | FIG. 8 | 45 | 21.87 |
| 5. Soybean Oil Treated With GLDA | FIG. 9 | 5 | 6.420 |

Figure 5:
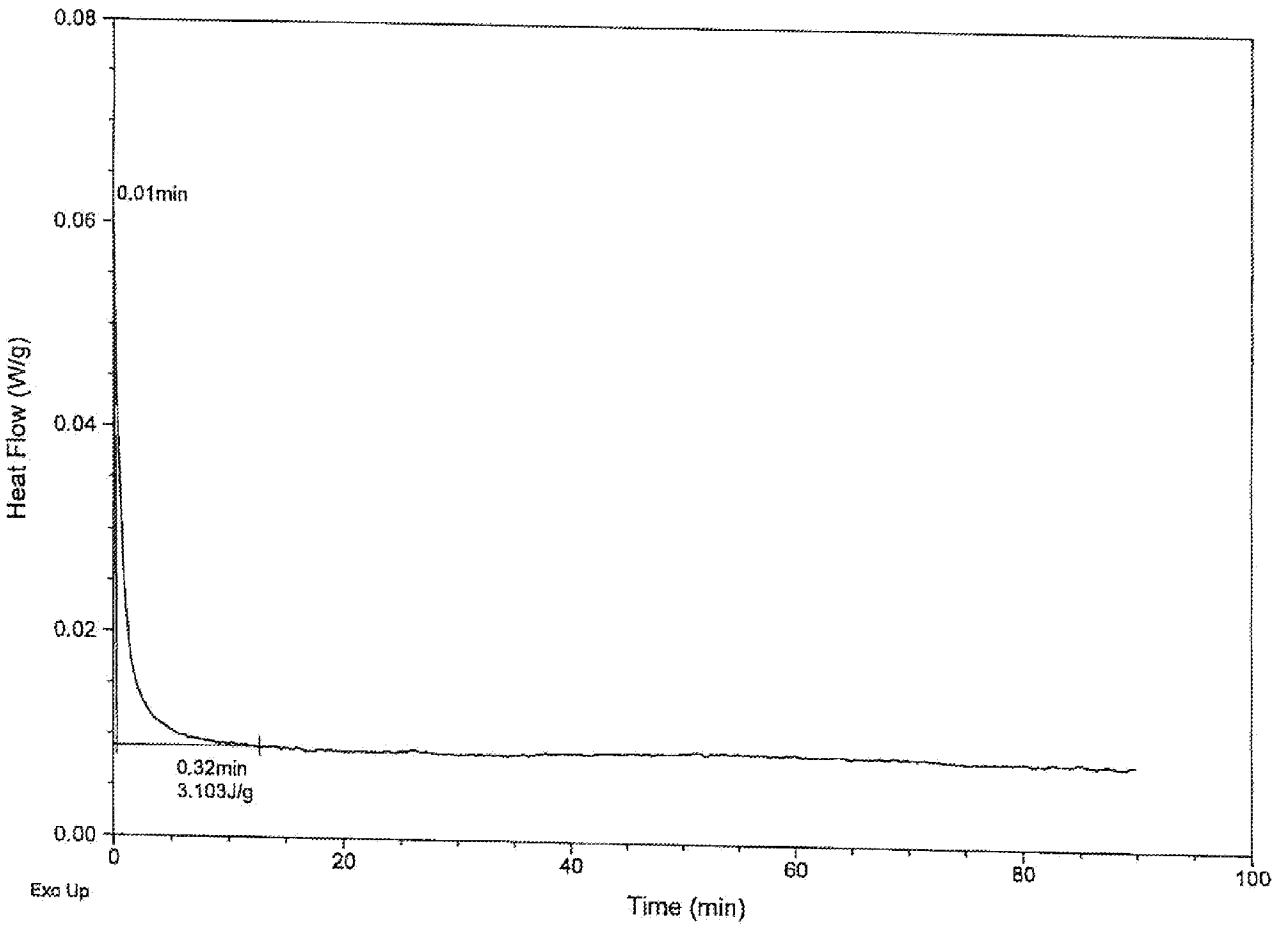
FIG. 5 is a DSC chart for an unsoiled cotton terry swatch.
Figure 6:
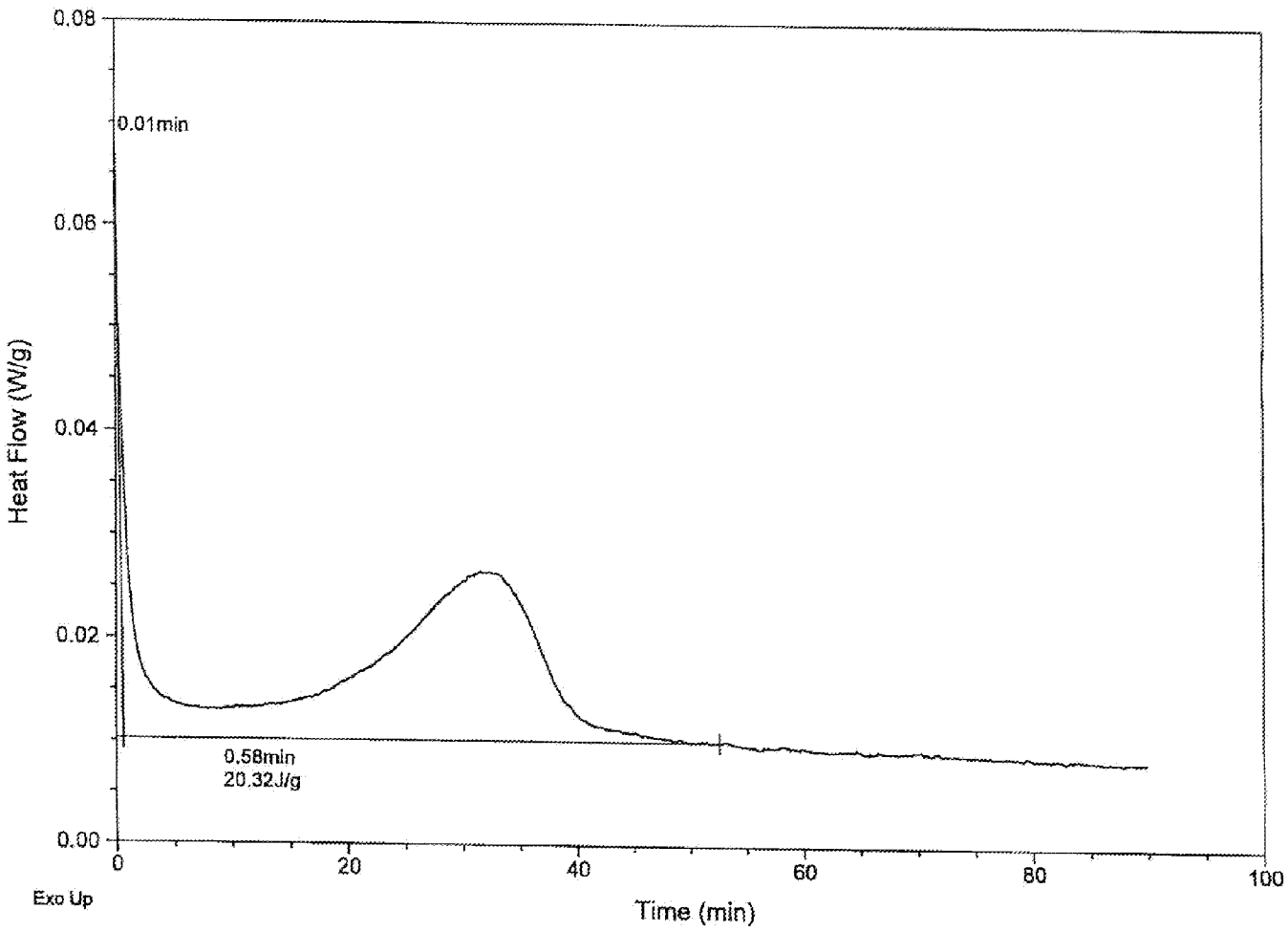
FIG. 6 is a DSC chart for a cotton terry swatch containing soybean oil.
Figure 7:
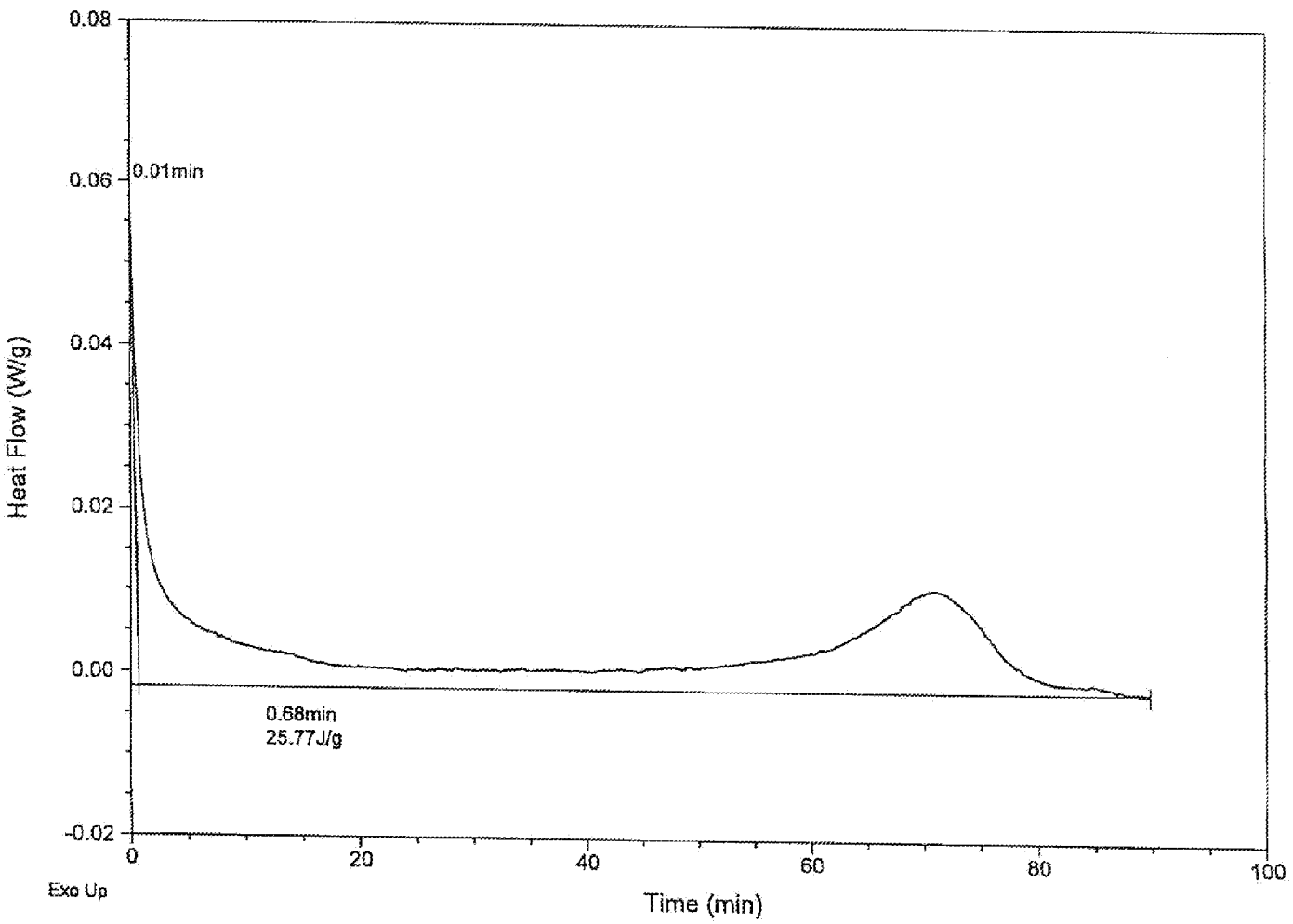
FIG. 7 is a DSC chart for a cotton terry swatch containing soybean oil and EDTA.
Figure 8:
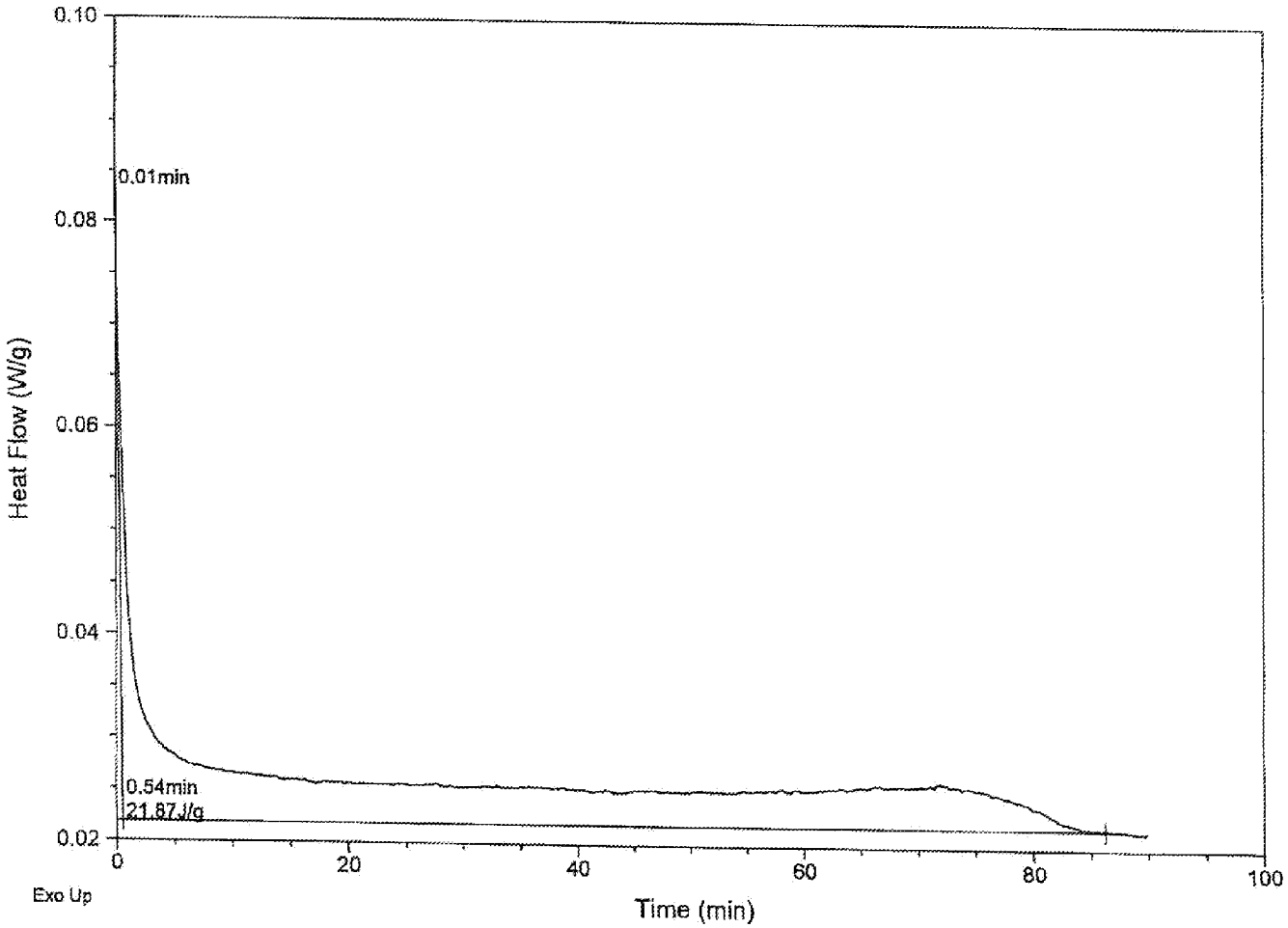
FIG. 8 is a DSC chart for a cotton terry swatch containing soybean oil and MGDA.

FIG. 5 shows an unsoiled swatch, which serves as a baseline. No exothermic reaction takes place. FIG. 6 shows that in a soybean soiled swatch, an exothermic reaction, shown as a peak, takes place between 30-35 minutes. FIG. 7 shows that when a soybean soiled swatch is treated with EDTA, an exothermic reaction takes place between 70-75 minutes. FIG.

Figure 9:
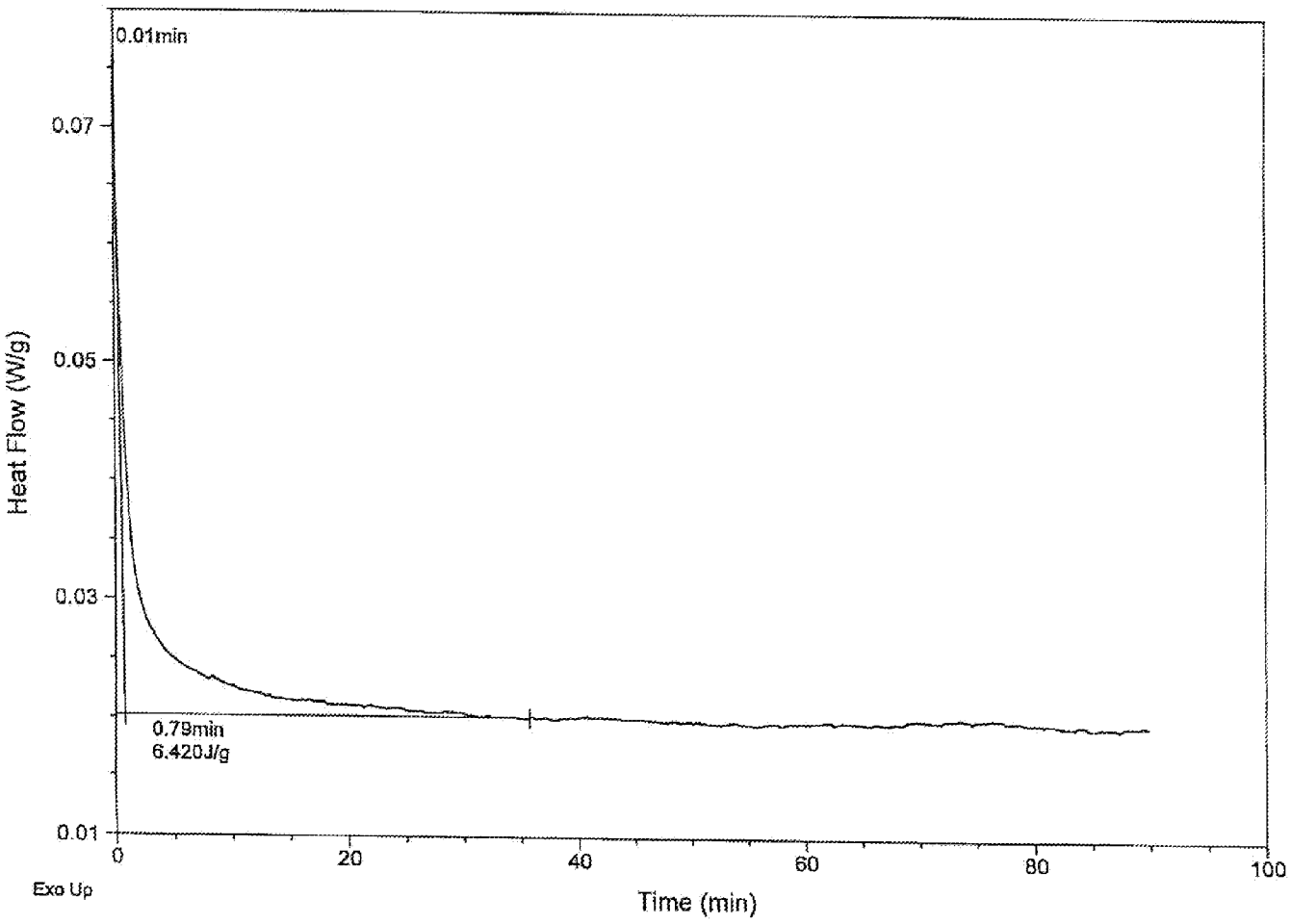
FIG. 9 is a DSC chart for a cotton terry swatch containing soybean oil and GLDA.

8 shows that when a soybean soiled swatch is treated with MGDA, a peak is eliminated. Finally, FIG. 9 shows that when a soybean soiled swatch is treated with GLDA, a peak is eliminated and the overall peak was greatly reduced.

These results suggest that the chelating agents strongly hinder the polymerization of the soybean oil. A very good result was obtained with GLDA, where the peak was eliminated and the overall area of exotherm was greatly reduced. Another good result was obtained with MGDA, where the peak was eliminated. The result with EDTA is still considered as highly beneficial since the peak was reduced in size and moved to a much longer time, meaning that the heat of polymerization can be dissipated over a much longer time. Thus, by applying a chelating agent to a laundry textile soiled with soybean oil, polymerization is hindered and the chance of spontaneous combustion of that textile is reduced.

Example #2

Applicant also sought to determine the effect on polymerization when swatches soiled with heavy metal spiked soybean oil was treated with various concentrations of EDTA. The following fourteen swatch types were compared:

1. Soybean oil, no spiking, no treatment.
2. Soybean oil, no spiking, treated with 0.5 grams active EDTA.
3. Soybean oil spiked with 0.5 ppm iron, no treatment.
4. Soybean oil spiked with 1 ppm iron, no treatment.
5. Soybean oil spiked with 2 ppm iron, no treatment.
6. Soybean oil spiked with 0.5 ppm iron and treated with 0.5 grams active EDTA.
7. Soybean oil spiked with 1.0 ppm iron and treated with 0.5 grams active EDTA.
8. Soybean oil spiked with 2.0 ppm iron and treated with 0.5 grams active EDTA.
9. Soybean oil spiked with 0.5 ppm copper, no treatment.
10. Soybean oil spiked with 1.0 ppm copper, no treatment.
11. Soybean oil spiked with 2.0 ppm copper, no treatment.
12. Soybean oil spiked with 0.5 ppm copper and treated with 0.5 grams active EDTA.
13. Soybean oil spiked with 1.0 ppm copper and treated with 0.5 grams active EDTA.
14. Soybean oil spiked with 2.0 ppm copper and treated with 0.5 grams active EDTA.

Applicant soiled each swatch with 1.0 grams soybean oil. Applicant also spiked the soybean oil in swatch types 3-8 with various concentrations of iron and in swatch types 9-14 with various concentrations of copper. Applicant finally treated swatch types 6-8 and 12-14 with 0.5 grams equal active EDTA. All of the swatches soaked in the soybean oil and EDTA for 18-24 hours and then were rinsed with de-ionized water. The swatches then air dried for 24 hours. Finally, Applicant performed a DSC. The results are shown in FIGS. 6-7 and 10-21 and summarized in Table 11 below.

TABLE 11

| Swatch Type | FIG. | Time of Peak Heat Flow (mins) | Area of Exotherm (J/g) |
|---|---|---|---|
| 1. Soybean Oil Only | FIG. 6 | 30-35 | 20.32 |
| 2. Soybean Oil Treated With EDTA | FIG. 7 | 70-75 | 25.77 |
| 3. Soybean Oil Spiked with 0.5 ppm Iron | FIG. 10 | 10-15 | 38.14 |
| 4. Soybean Oil Spiked with 1.0 ppm Iron | FIG. 11 | 5-10 | 18.11 |
| 5. Soybean Oil Spiked with 2.0 ppm Iron | FIG. 12 | 5-10 | 21.09 |
| 6. Soybean Oil Spiked with 0.5 ppm Iron, Treated with EDTA | FIG. 13 | 40-45 | 17.43 |
| 7. Soybean Oil Spiked with 1.0 ppm Iron, Treated with EDTA | FIG. 14 | 53-58 | 20.17 |
| 8. Soybean Oil Spiked with 2.0 ppm Iron, Treated with EDTA | FIG. 15 | 25-30 | 15.65 |
| 9. Soybean Oil Spiked with 0.5 ppm Copper | FIG. 16 | 10-15 | 18.42 |
| 10. Soybean Oil Spiked with 1.0 ppm Copper | FIG. 17 | 5-10 | 18.11 |
| 11. Soybean Oil Spiked with 2.0 ppm Copper | FIG. 18 | 10-15 | 16.14 |
| 12. Soybean Oil Spiked with 0.5 ppm Copper, Treated with EDTA | FIG. 19 | 50-55 | 17.72 |
| 13. Soybean Oil Spiked with 1.0 ppm Copper, Treated with EDTA | FIG. 20 | 30-35 | 19.21 |
| 14. Soybean Oil Spiked with 2.0 ppm Copper, Treated with EDTA | FIG. 21 | 20-25 | 21.66 |

Figure 10:
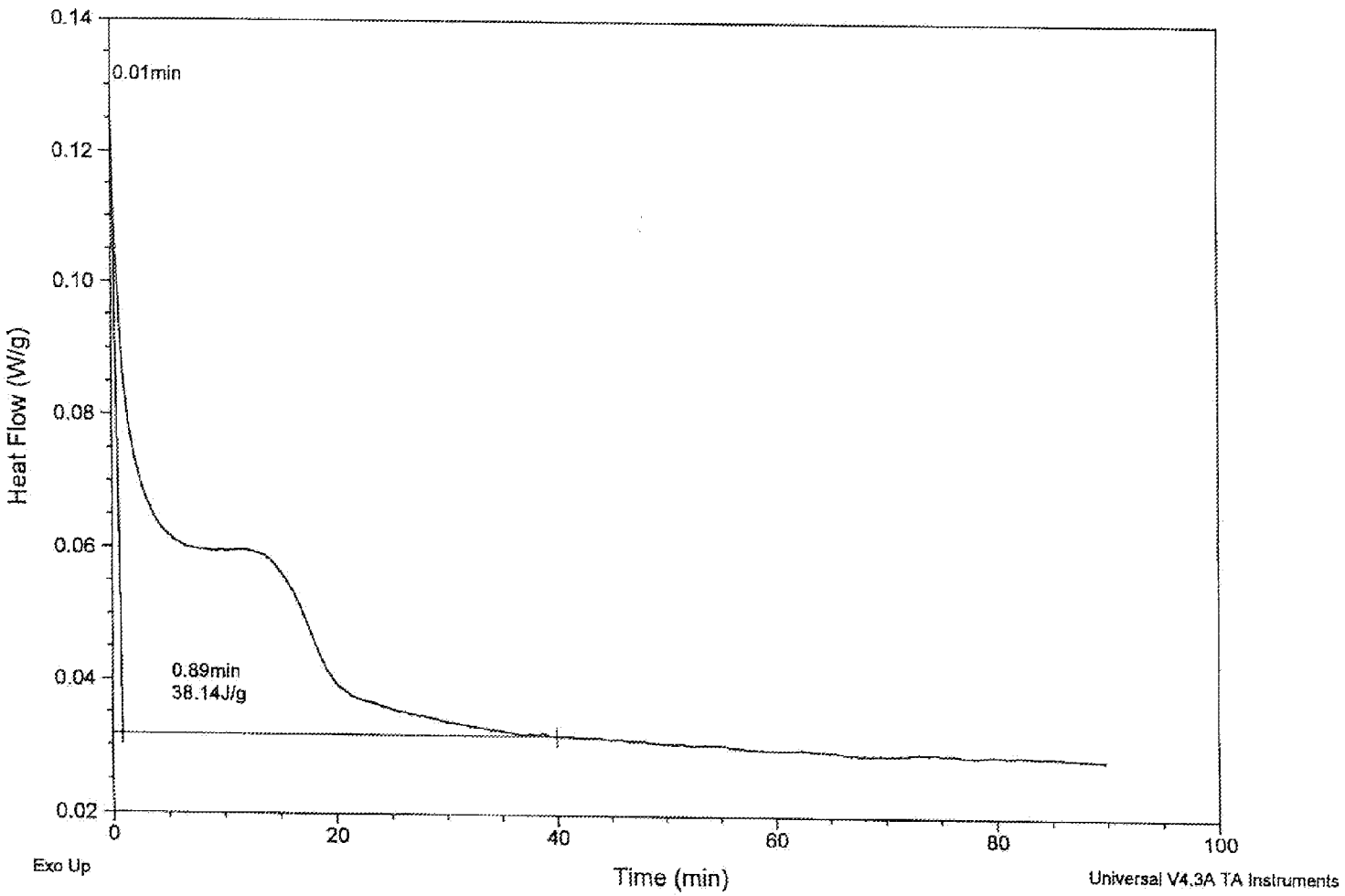
FIG. 10 is a DSC chart for a cotton terry swatch containing soybean oil spiked with 0.5 ppm iron.
Figure 11:
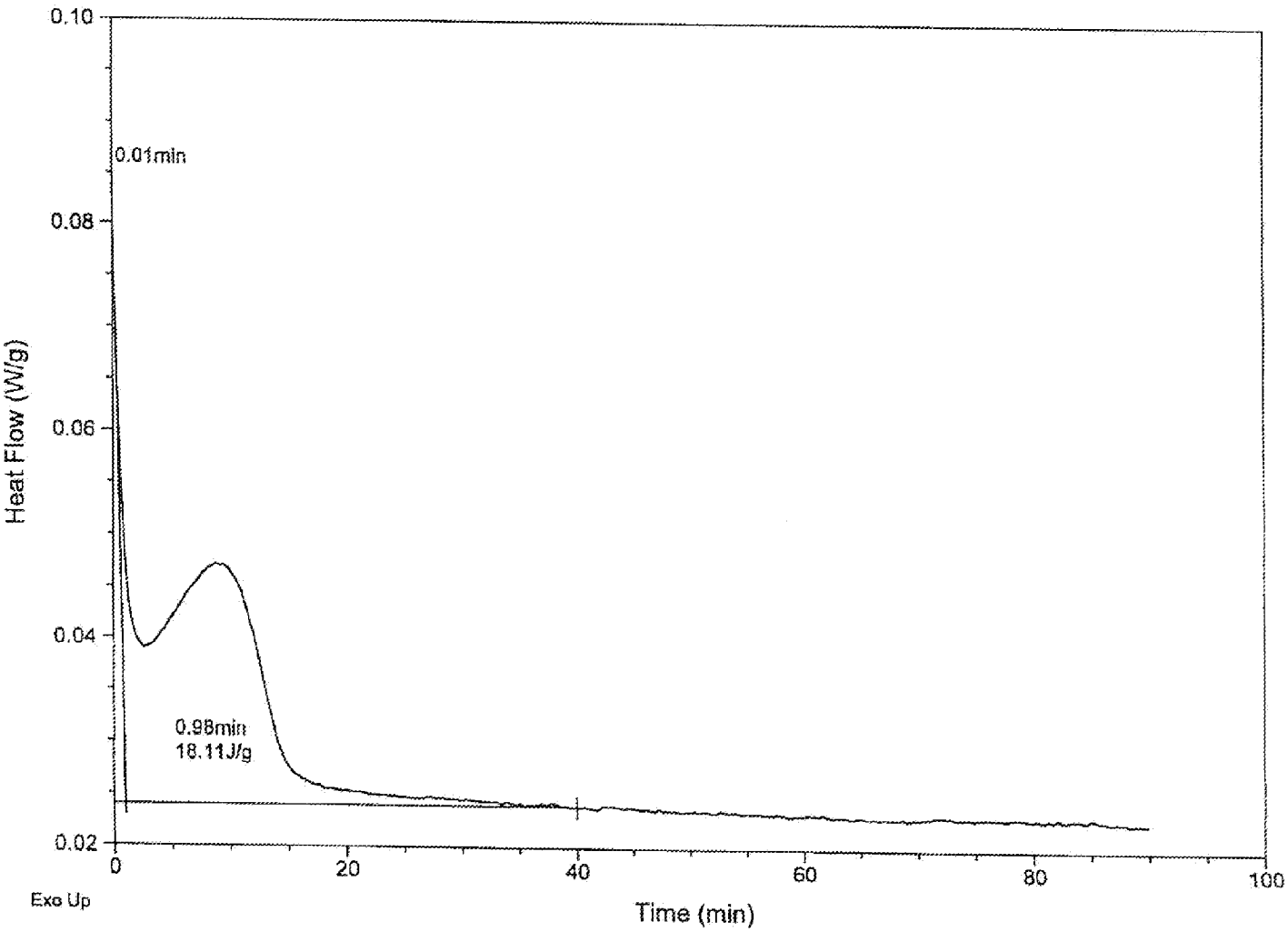
FIG. 11 is a DSC chart for a cotton terry swatch containing soybean oil spiked with 1.0 ppm iron.
Figure 12:
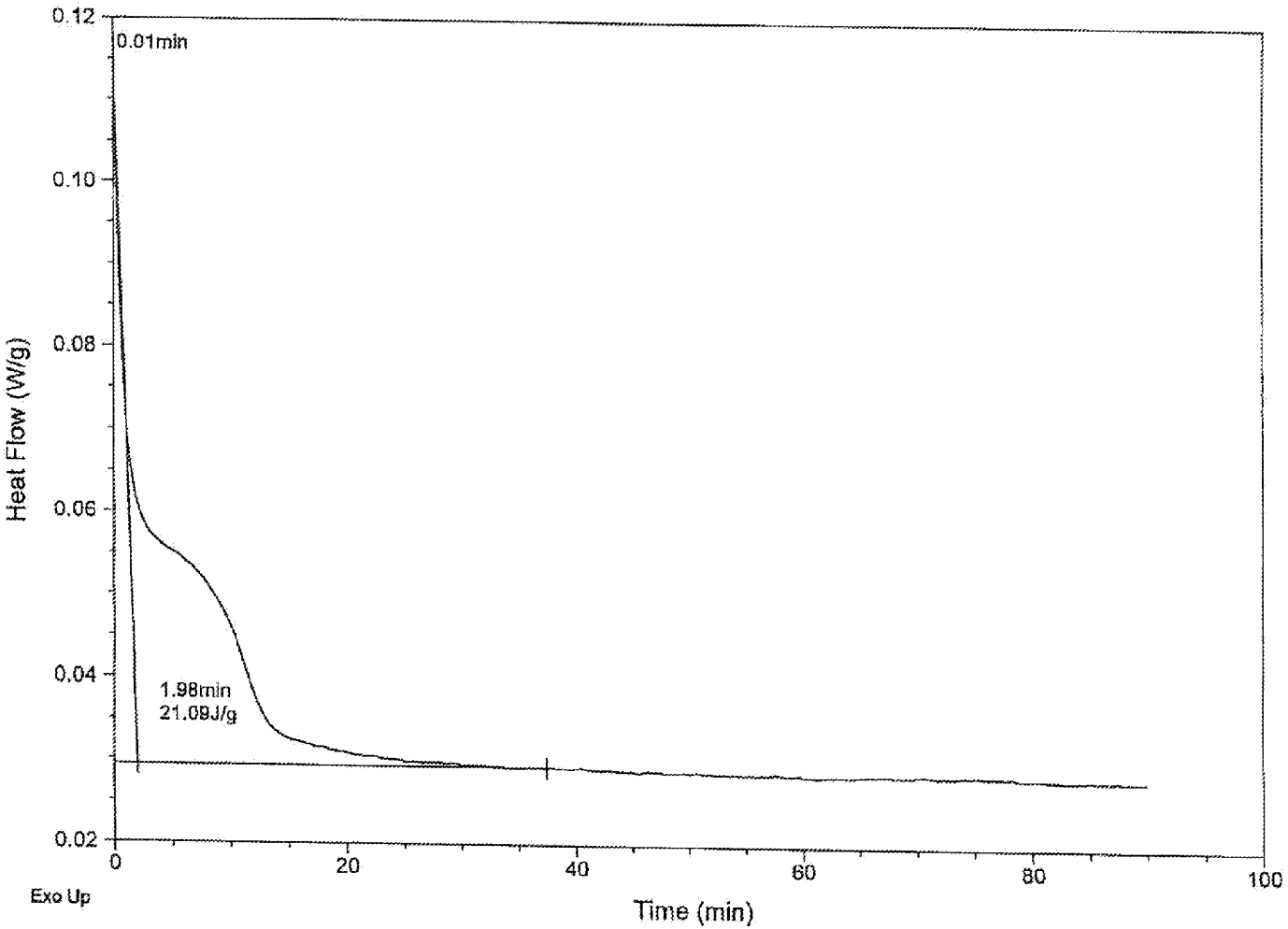
FIG. 12 is a DSC chart for a cotton terry swatch containing soybean oil spiked with 2.0 ppm iron.
Figure 13:
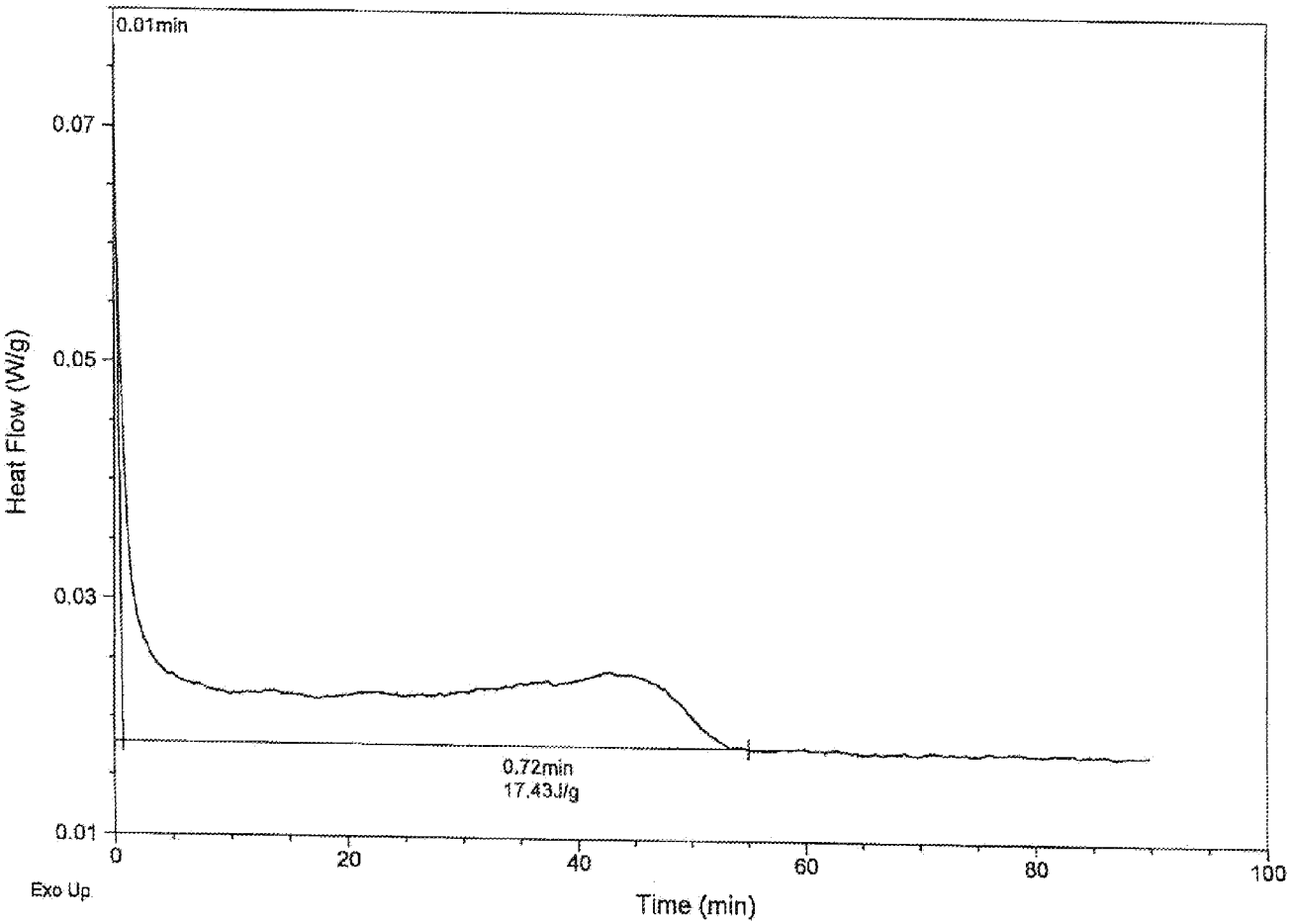
FIG. 13 is a DSC chart for a cotton terry swatch containing soybean oil spiked with 0.5 ppm iron and treated with 0.5 grams of active EDTA.
Figure 14:
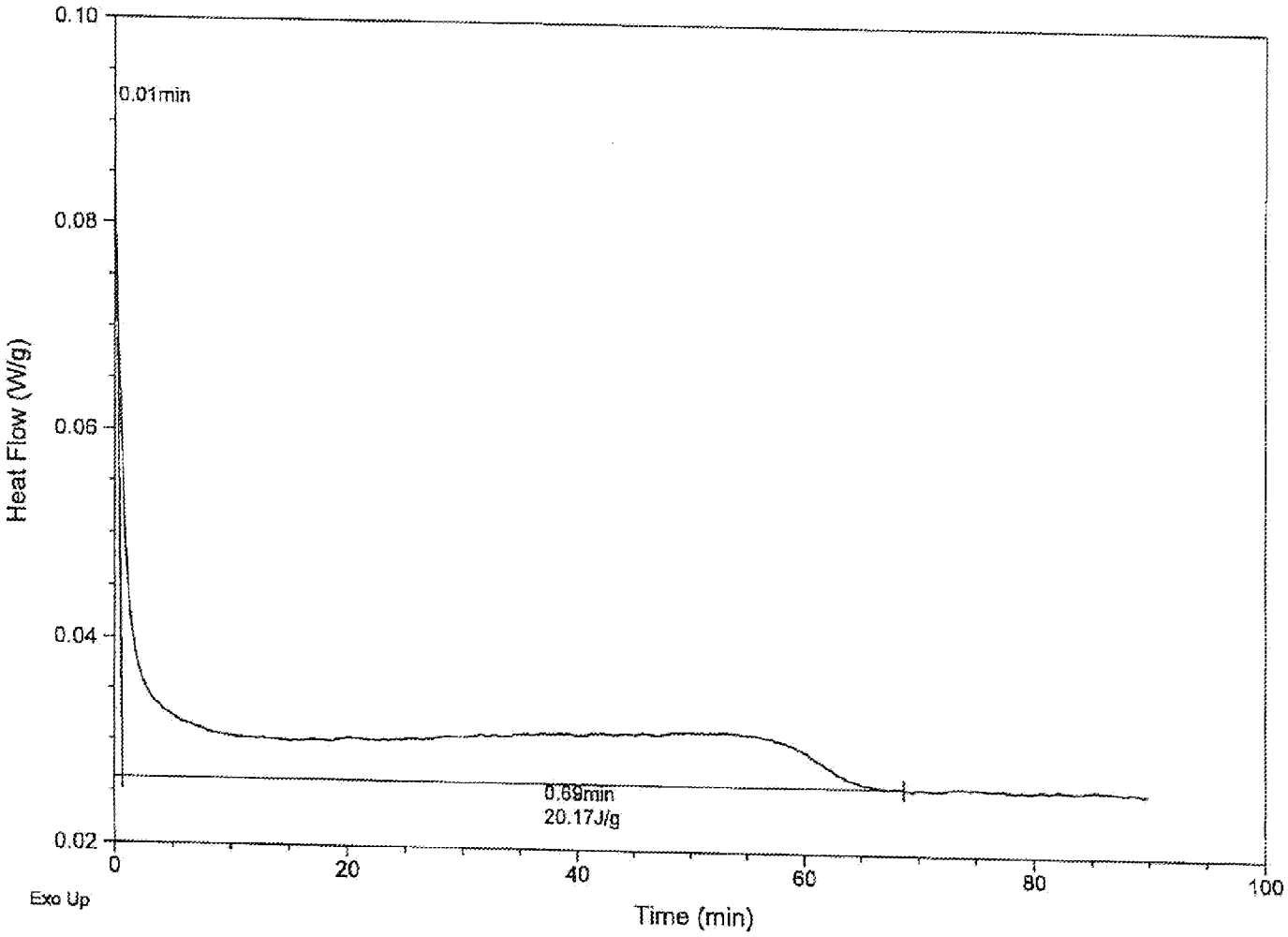
FIG. 14 is a DSC chart for a cotton terry swatch containing soybean oil spiked with 1.0 ppm iron and treated with 0.5 grams of active EDTA.
Figure 15:
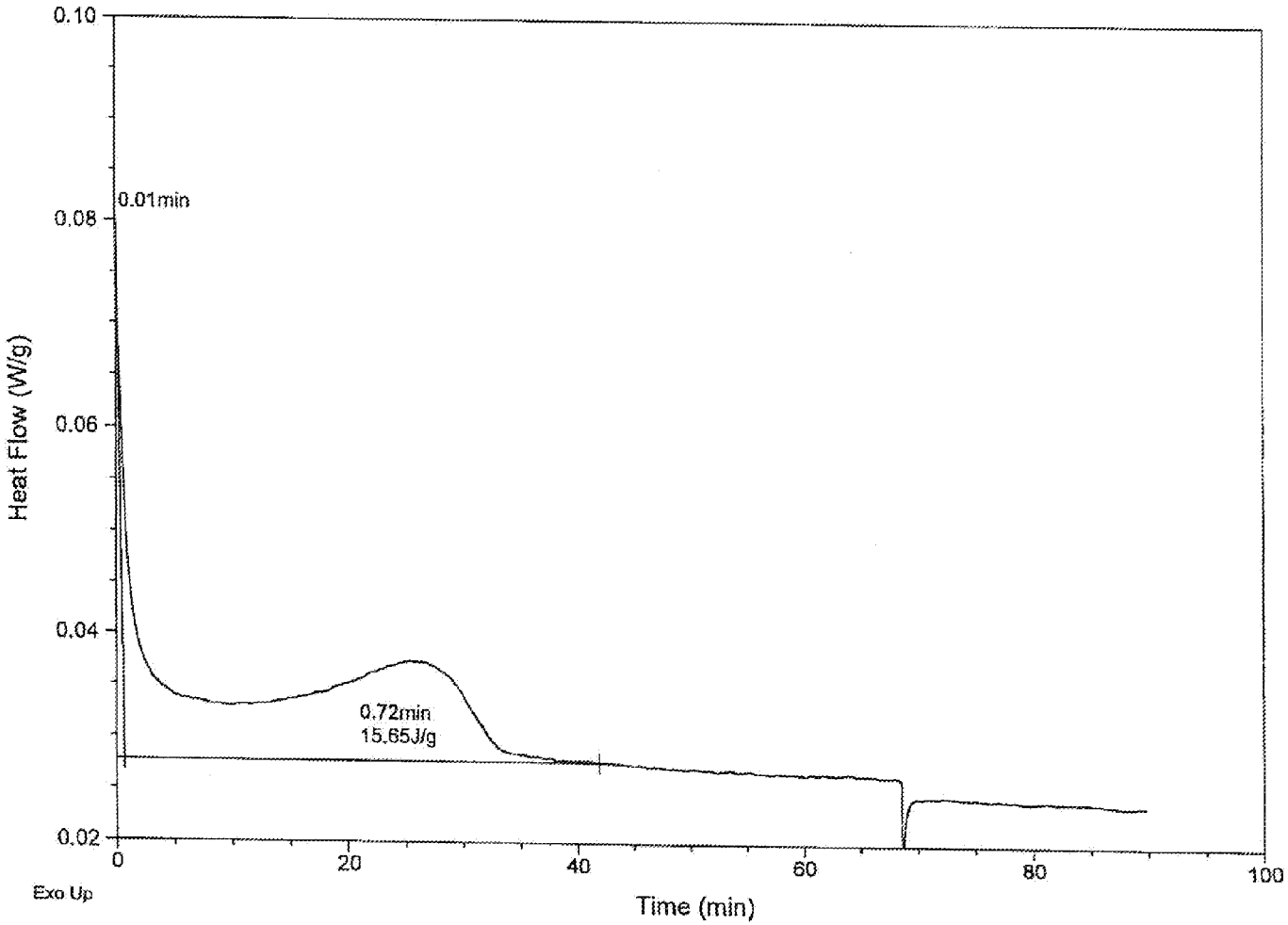
FIG. 15 is a DSC chart for a cotton terry swatch containing soybean oil spiked with 2.0 ppm iron and treated with 0.5 grams of active EDTA.
Figure 16:
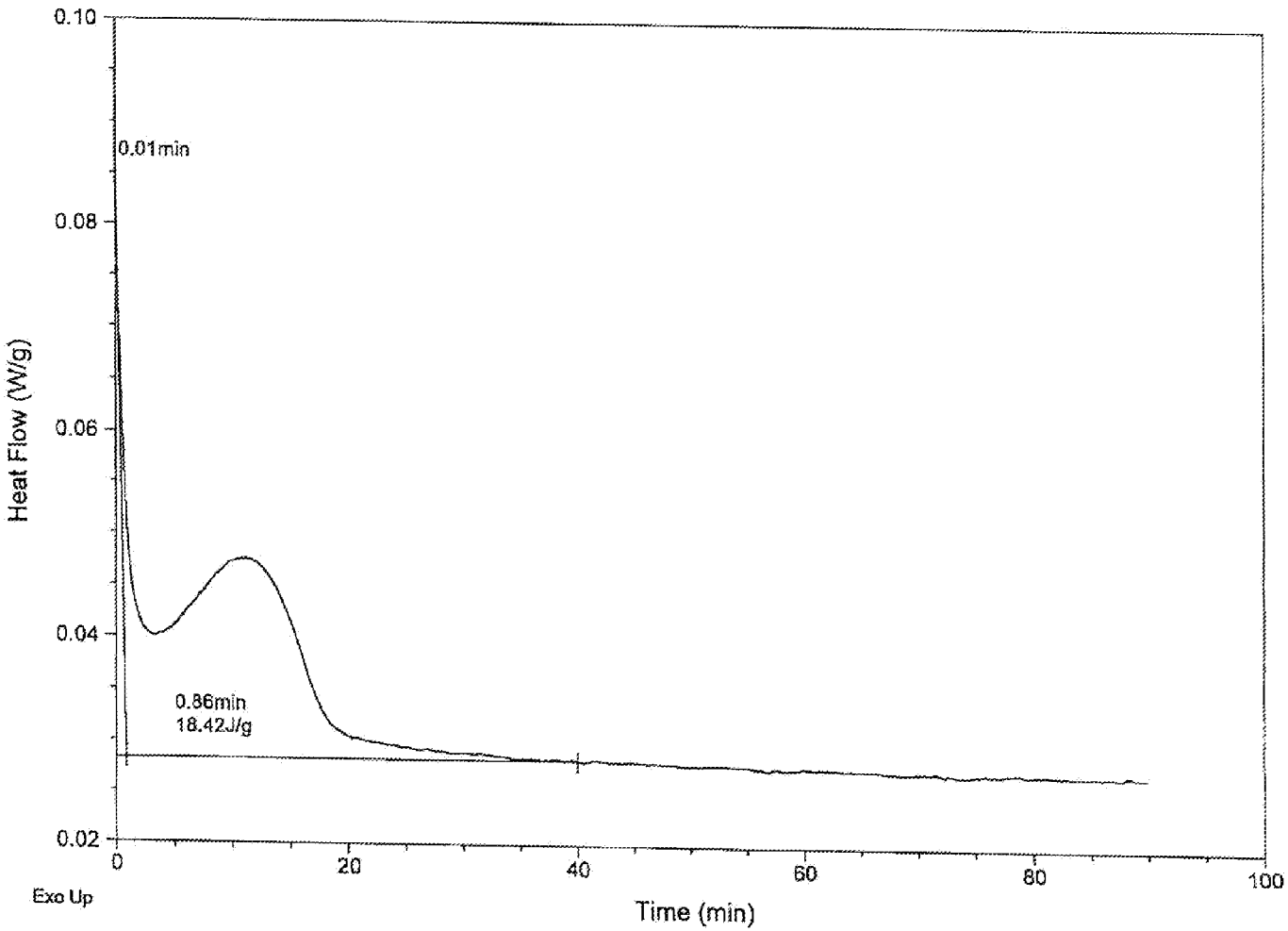
FIG. 16 is a DSC chart for a cotton terry swatch containing soybean oil spiked with 0.5 ppm copper.
Figure 17:
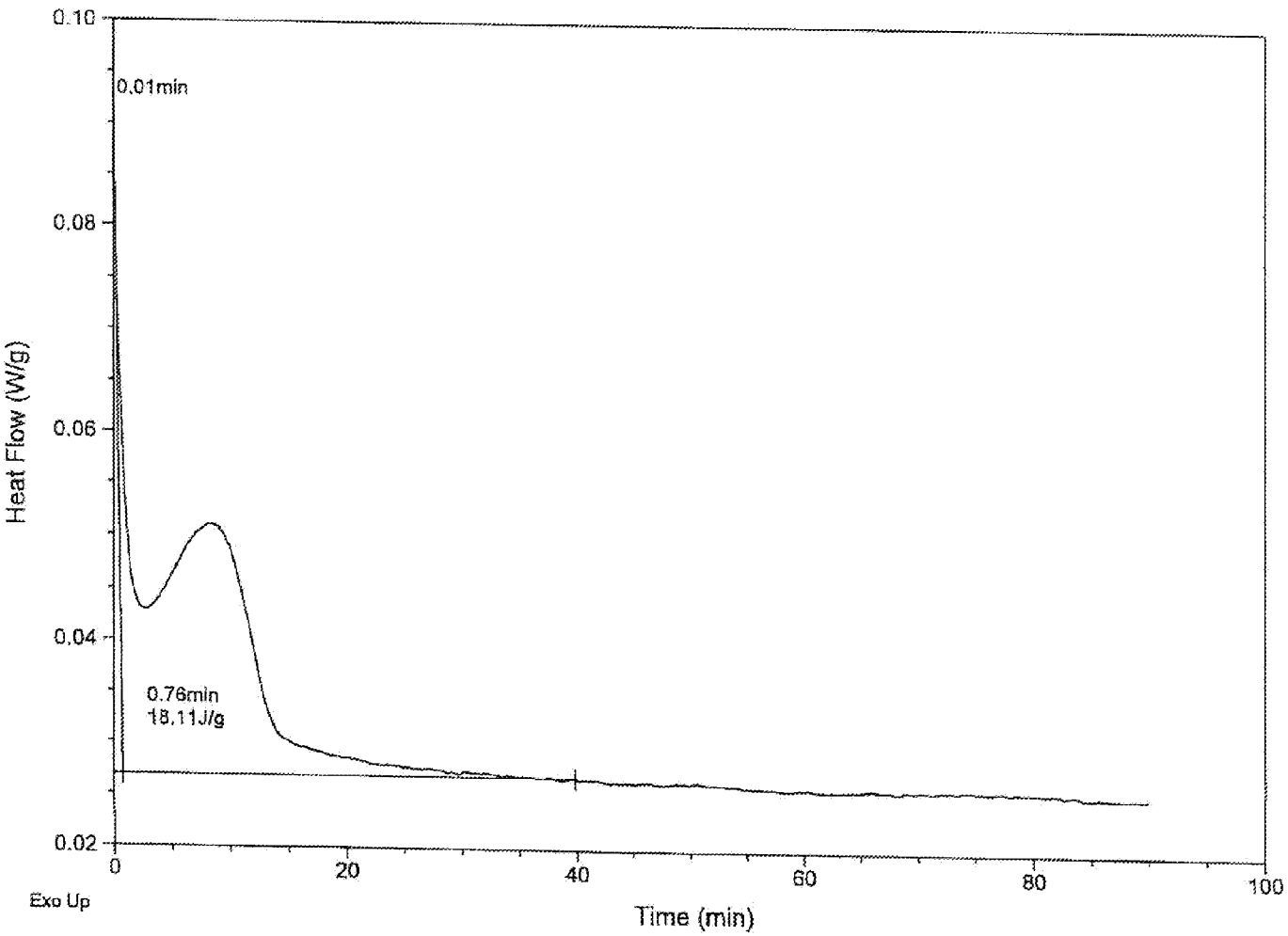
FIG. 17 is a DSC chart for a cotton terry swatch containing soybean oil spiked with 1.0 ppm copper.
Figure 18:
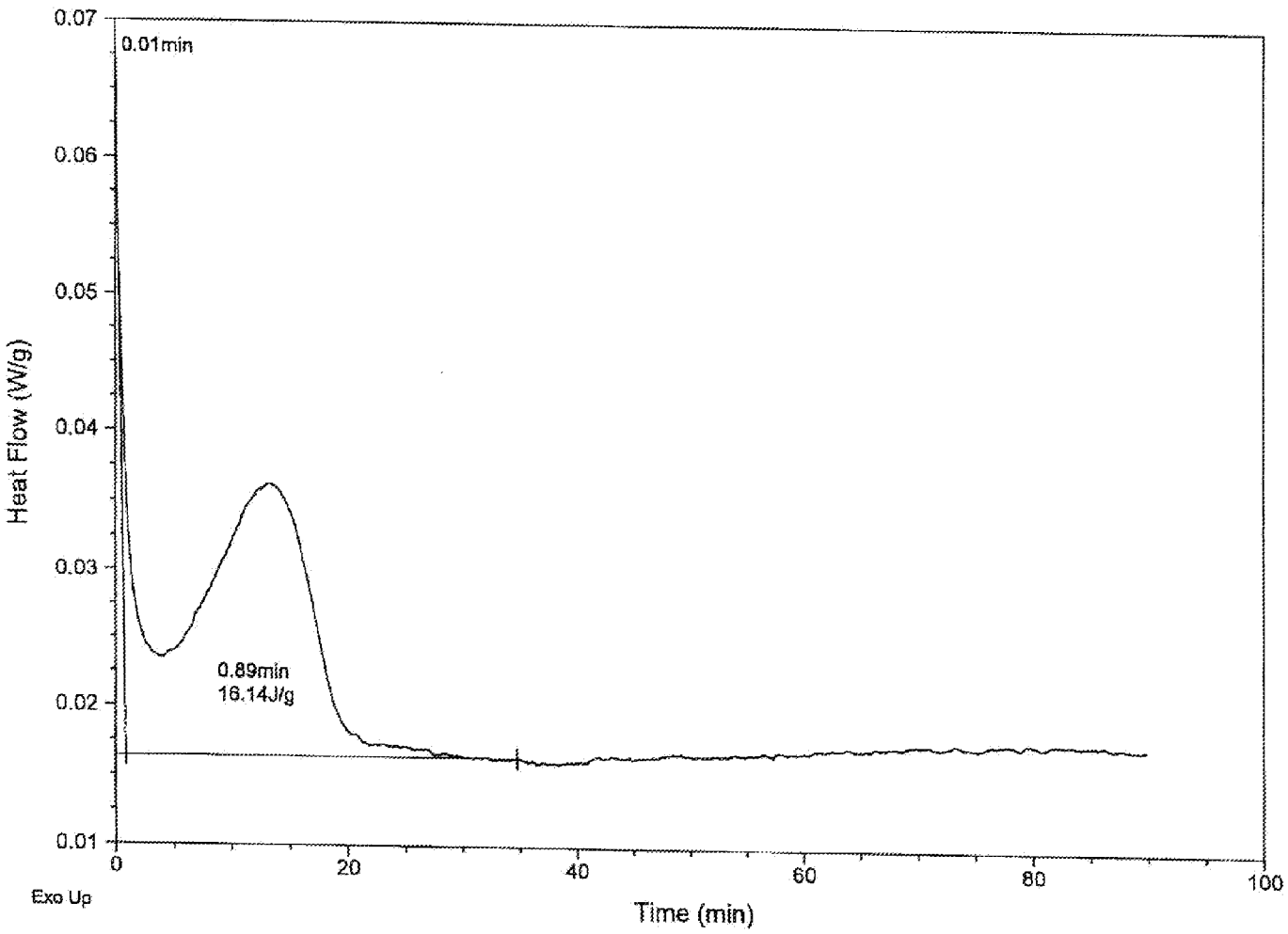
FIG. 18 is a DSC chart for a cotton terry swatch containing soybean oil spiked with 2.0 ppm copper.
Figure 19:
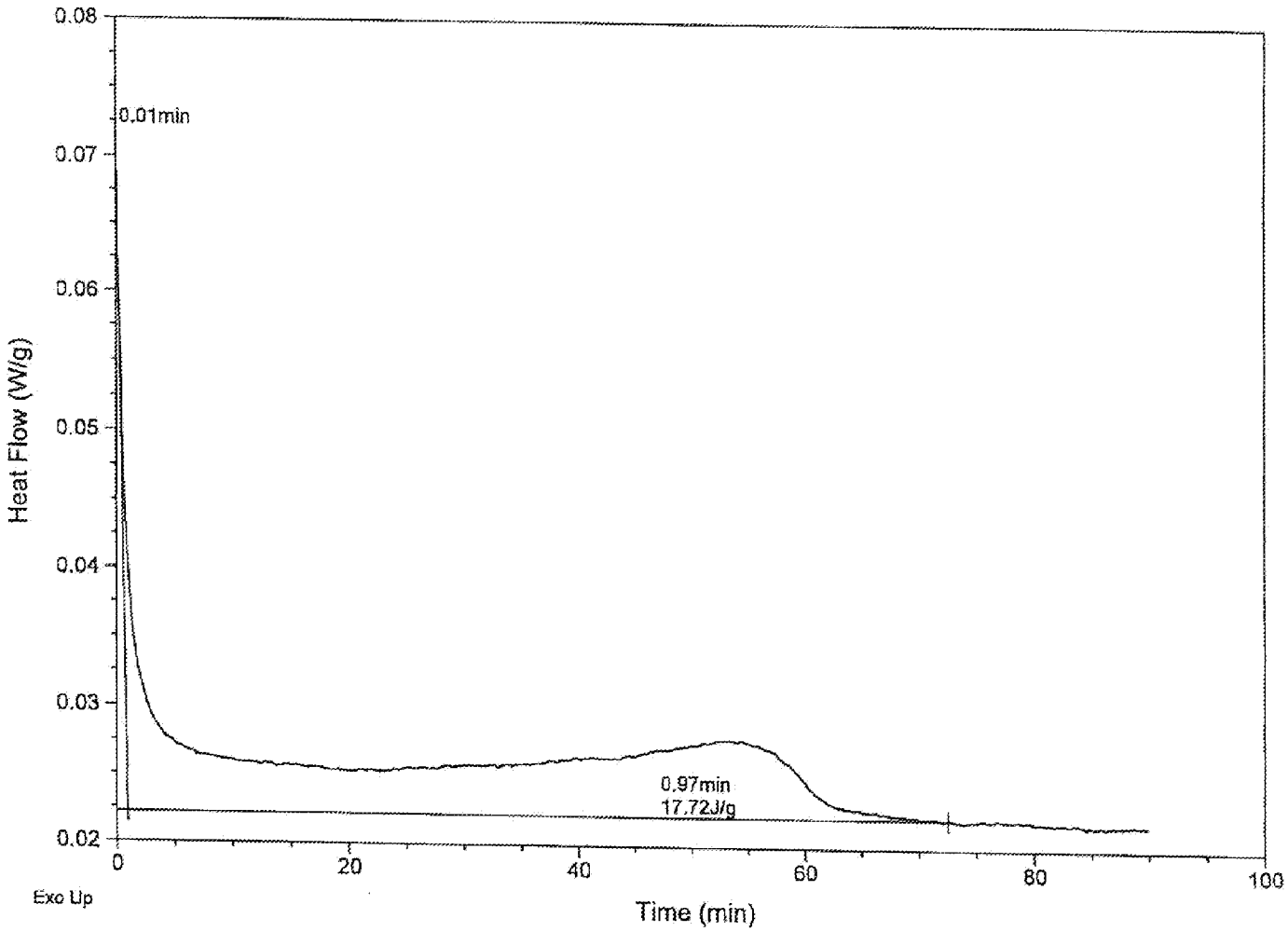
FIG. 19 is a DSC chart for a cotton terry swatch containing soybean oil spiked with 0.5 ppm copper and treated with 0.5 grams of active EDTA.
Figure 20:
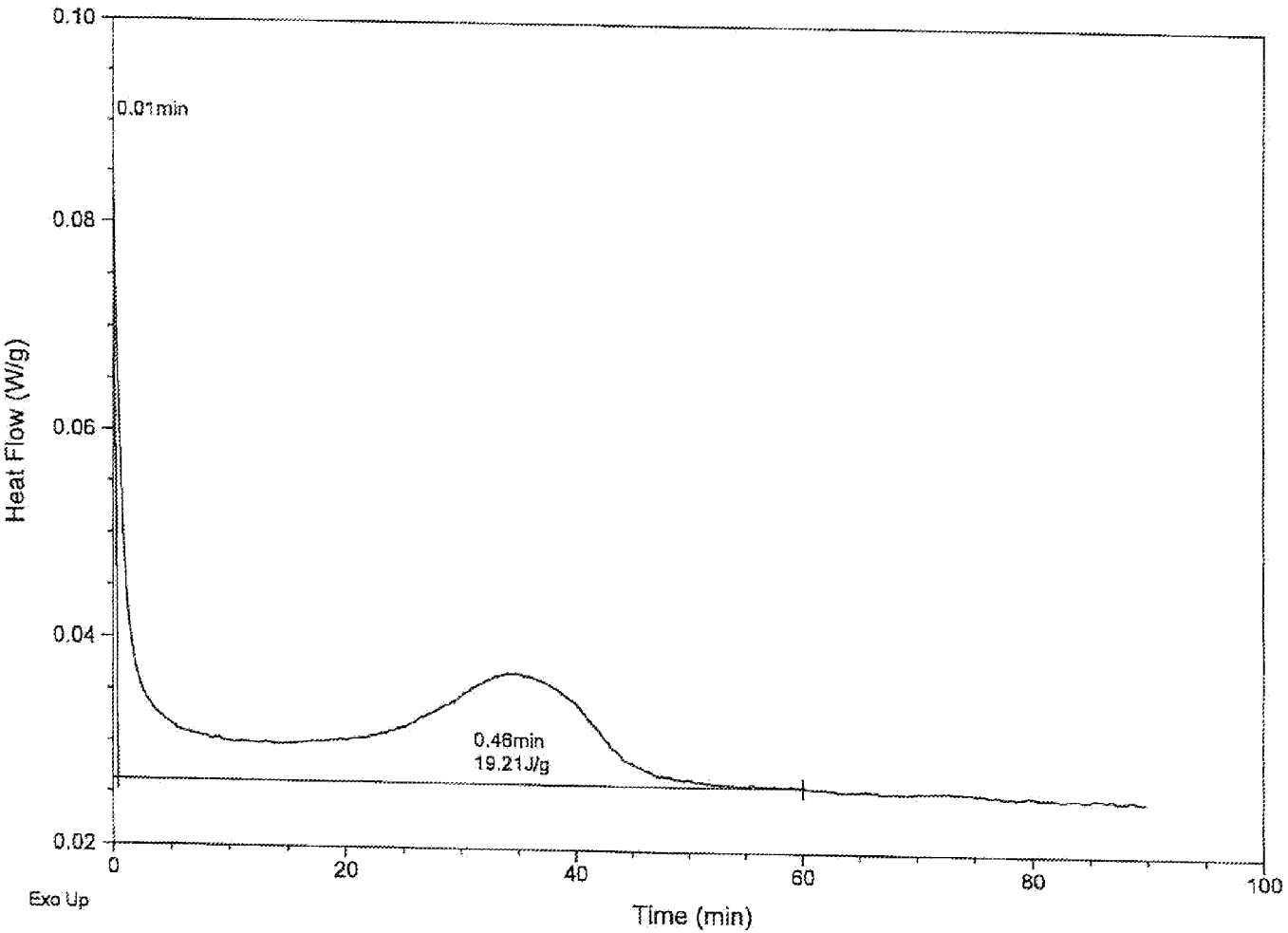
FIG. 20 is a DSC chart for a cotton terry swatch containing soybean oil spiked with 1.0 ppm copper and treated with 0.5 grams of active EDTA.
Figure 21:
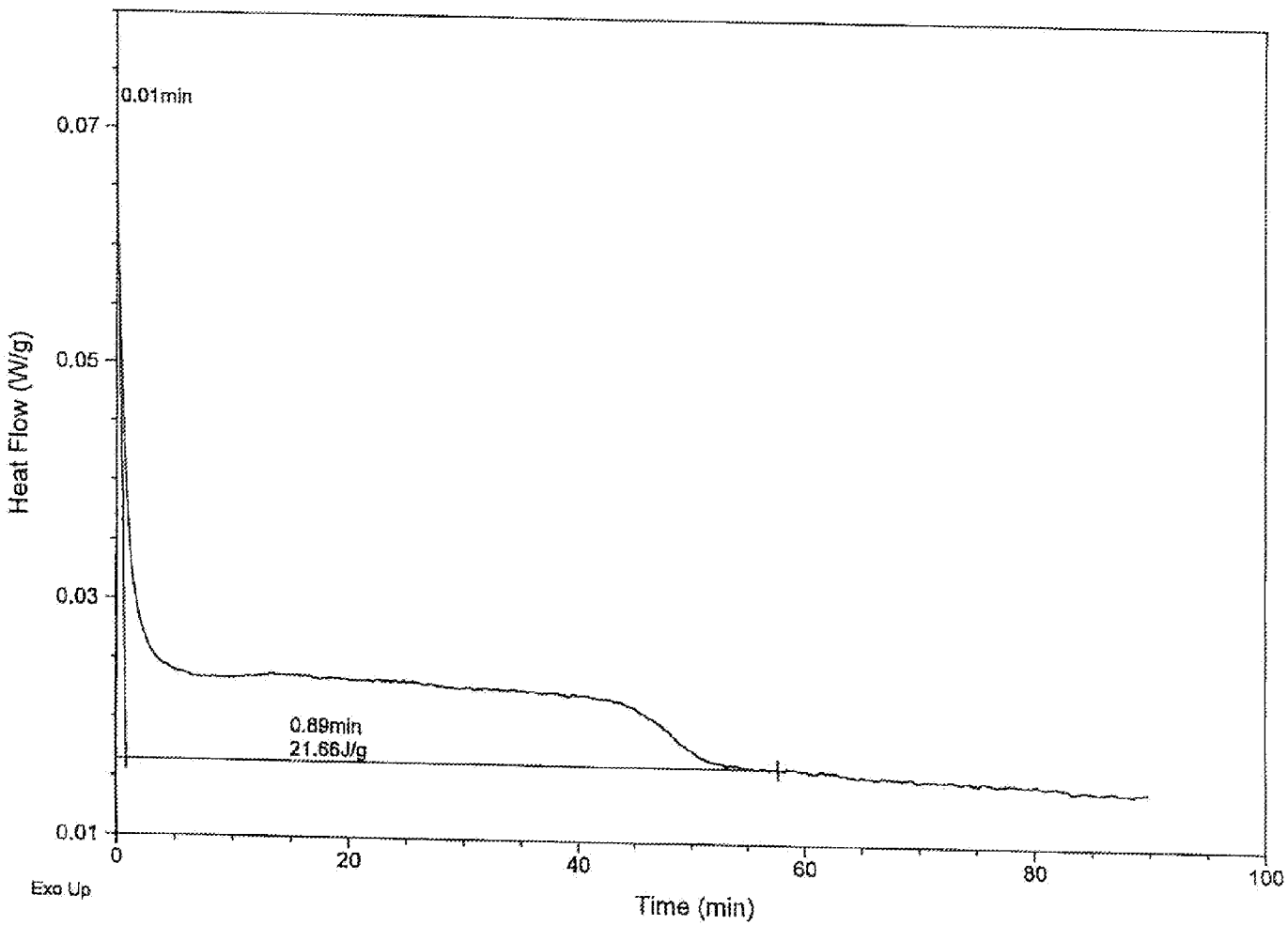
FIG. 21 is a DSC chart for a cotton terry swatch containing soybean oil spiked with 2.0 ppm copper and treated with 0.5 grams of active EDTA.

FIG. 6 shows that in a soybean soiled swatch (without metal spiking), an exothermic reaction (i.e., a peak) takes place between 30-35 minutes. FIGS. 10-12 show that in a soybean oil soiled swatch spiked with iron, an exothermic reaction takes place even sooner, such as between 10-15 minutes (when spiked with 0.5 ppm iron) or 5-10 minutes (when spiked with 1.0 ppm iron). FIGS. 13-15 show that when these swatches are treated with EDTA, the time it takes for an exothermic reaction to take place is delayed or the exothermic reaction is eliminated. For example, FIGS. 10 and 13 show that an exothermic reaction for soybean oil spiked with 0.5 ppm iron occurs at 10-15 minutes, but is delayed to 40-45 minutes when EDTA is used. Likewise, FIGS. 11 and 14 show that an exothermic reaction for soybean oil spiked with 1.0 ppm iron takes place at 5-10 minutes but is eliminated when EDTA is used. Further, FIGS. 16-18 show that spiking a soybean oil soiled swatch with copper causes an exothermic reaction to take place quickly, such as between 10-15 minutes (when spiked with 0.5 ppm copper) or 5-10 minutes (when spiked with 1.0 ppm iron). FIGS. 19-21 show that when these swatches are treated with EDTA, the exothermic reaction is either delayed or eliminated. For example, FIGS. 16 and 19 show that an exothermic reaction for soybean oil spiked with 0.5 ppm copper occurs at 10-15 minutes, but is delayed to 50-55 minutes when treated with EDTA. FIGS. 17 and 20 show that an exothermic reaction time for soybean oil spiked with 1.0 ppm copper occurs at 5-10 minutes but is delayed to 30-35 minutes when treated with EDTA.

Example #3

Applicant also compared the effect on polymerization when swatches soiled with soybean oil were treated with a chelating agent. Applicant compared the following swatch types:

1. No oil, no treatment.
2. Soybean oil soiled, no treatment.
3. Soybean oil soiled, treated with 0.5 grams active EDTA.
4. Soybean oil soiled, treated with 0.5 grams active MGDA, 40%.
5. Soybean oil soiled, treated with 0.5 grams active GLDA, 38%.

Applicant soiled swatch types 2-5 with 0.5 grams of fresh Sodexo soybean oil. Next, Applicant applied chelating agents to swatch types 3-5. Once the various treatments were applied, Applicant allowed the swatches to stand for 24 hours. After standing, Applicant rinsed the swatches with de-ionized water. Finally, Applicant performed a DSC on each swatch and the results are summarized in Table 12 below.

TABLE 12

| Swatch Type | Area of Exotherm (J/g) | Time of Peak (min) |
|---|---|---|
| 1. No Oil, No Treatment | 3.103 | 2 |
| 2. Soybean Oil Soiled, No Treatment | 20.32 | 33 |
| 3. Soybean Oil Soiled, Treated With 0.5 grams active EDTA | 25.77 | 72 |
| 4. Soybean Oil Soiled, Treated With 0.5 grams active MGDA, 40% | 21.87 | 45 |
| 5. Soybean Oil Soiled, Treated With 0.5 grams active GLDA, 38% | 6.42 | 5 |

As shown, the area of exotherm of the soiled swatches (swatch types 2-5) was much higher than with an unsoiled swatch (swatch type 1). Also, when a soiled swatch is treated with EDTA or MGDA, the time of peak is much delayed (from 33 minutes in swatch type 2 to 72 minutes in swatch type 3 or 45 minutes in swatch type 4). Further, when a soiled swatch is treated with GLDA, the area of exotherm is reduced (from 20.32 J/g in swatch type 2 to 6.42 J/g in swatch type 5).

Example #4

Applicant also sought to determine the effect on polymerization on swatches soiled with fresh oil compared to swatches soiled with spent oil, after being washed with a detergent solution and a chelating agent. These experiments were laundered under stress conditions, (e.g., extremely high soil loading and low detergent levels) so that a relatively high level of soil remained (about 10%-15%). The goal was to determine the effect of chelating agent on the remaining soil. Applicant compared the following swatch types:

1. Fresh oil soiled, washed in a solution of commercial detergent A and no chelating agent.
2. Fresh oil soiled, washed in a solution of commercial detergent A and 19 ppm GLDA.
3. Fresh oil soiled, washed in a solution of commercial detergent A and 38 ppm GLDA.
4. Fresh oil soiled, washed in a solution of commercial detergent A and 100 ppm GLDA.
5. Fresh oil soiled, washed in a solution of commercial detergent A and 500 ppm GLDA.
6. Fresh oil soiled, washed in a solution of commercial detergent A and 30 ppm EDTA.
7. Fresh oil soiled, washed in a solution of commercial detergent A and 40 ppm EDTA.
8. Fresh oil soiled, washed in a solution of commercial detergent A and 50 ppm EDTA.
9. Fresh oil soiled, washed in a solution of commercial detergent A and 100 ppm EDTA.
10. Fresh oil soiled, washed in a solution of commercial detergent A and 500 ppm EDTA.
11. Fresh oil soiled, washed in a solution of commercial detergent A and 20 ppm MGDA.
12. Fresh oil soiled, washed in a solution of commercial detergent A and 30 ppm MGDA.
13. Fresh oil soiled, washed in a solution of commercial detergent A and 40 ppm MGDA.
14. Fresh oil soiled, washed in a solution of commercial detergent A and 100 ppm MGDA.
15. Fresh oil soiled, washed in a solution of commercial detergent A and 500 ppm MGDA.
16. Spent oil soiled, washed in a solution of commercial detergent A and no chelating agent.
17. Spent oil soiled, washed in a solution of commercial detergent A and 19 ppm GLDA.
18. Spent oil soiled, washed in a solution of commercial detergent A and 38 ppm GLDA.
19. Spent oil soiled, washed in a solution of commercial detergent A and 100 ppm GLDA.
20. Spent oil soiled, washed in a solution of commercial detergent A and 500 ppm GLDA.
21. Spent oil soiled, washed in a solution of commercial detergent A and 40 ppm EDTA.
22. Spent oil soiled, washed in a solution of commercial detergent A and 50 ppm EDTA.
23. Spent oil soiled, washed in a solution of commercial detergent A and 100 ppm EDTA.
24. Spent oil soiled, washed in a solution of commercial detergent A and 500 ppm EDTA.
25. Spent oil soiled, washed in a solution of commercial detergent A and 20 ppm MGDA.
26. Spent oil soiled, washed in a solution of commercial detergent A and 30 ppm MGDA.
27. Spent oil soiled, washed in a solution of commercial detergent A and 40 ppm MGDA.
28. Spent oil soiled, washed in a solution of commercial detergent A and 100 ppm MGDA.
29. Spent oil soiled, washed in a solution of commercial detergent A and 500 ppm MGDA.

First, Applicant soiled swatch types 1-15 with about 3 grams of fresh Sodexo soybean oil and swatch types 16-29 with spent KFC soybean oil. The swatches were washed for 10 minutes in de-ionized water at 150° F. with both 0.1 grams of commercial detergent A and the selected concentration of chelating agent. Next, the swatches were rinsed for two minutes in cold, de-ionized water. Applicant allowed the swatches to dry for 24 hours and then generated DSC curves. The results are displayed in FIGS. 23-32. These results clearly demonstrate that after washing with chelating agents, the area of exotherm of the remaining soybean oil was much reduced and the time of peak was delayed under the DSC test method, suggesting that the remaining oil has been rendered less reactive and less dangerous.

Example #5

Applicant also compared the effects of polymerization on swatches washed with a detergent solution, a chelating agent and sodium hydroxide. Applicant compared the following eight swatch types:

1. Fresh oil soiled only, no treatment.
2. Fresh oil soiled, washed with 100 ppm GLDA.
3. Fresh oil soiled, washed with 250 ppm NaOH.
4. Fresh oil soiled, washed with 100 ppm GLDA and 250 ppm NaOH.
5. Spent oil soiled only, no treatment.
6. Spent oil soiled, washed with 100 ppm GLDA.
7. Spent oil soiled, washed with 250 ppm NaOH.
8. Spent oil soiled, washed with 100 ppm GLDA and 250 ppm NaOH.

Figure 33:
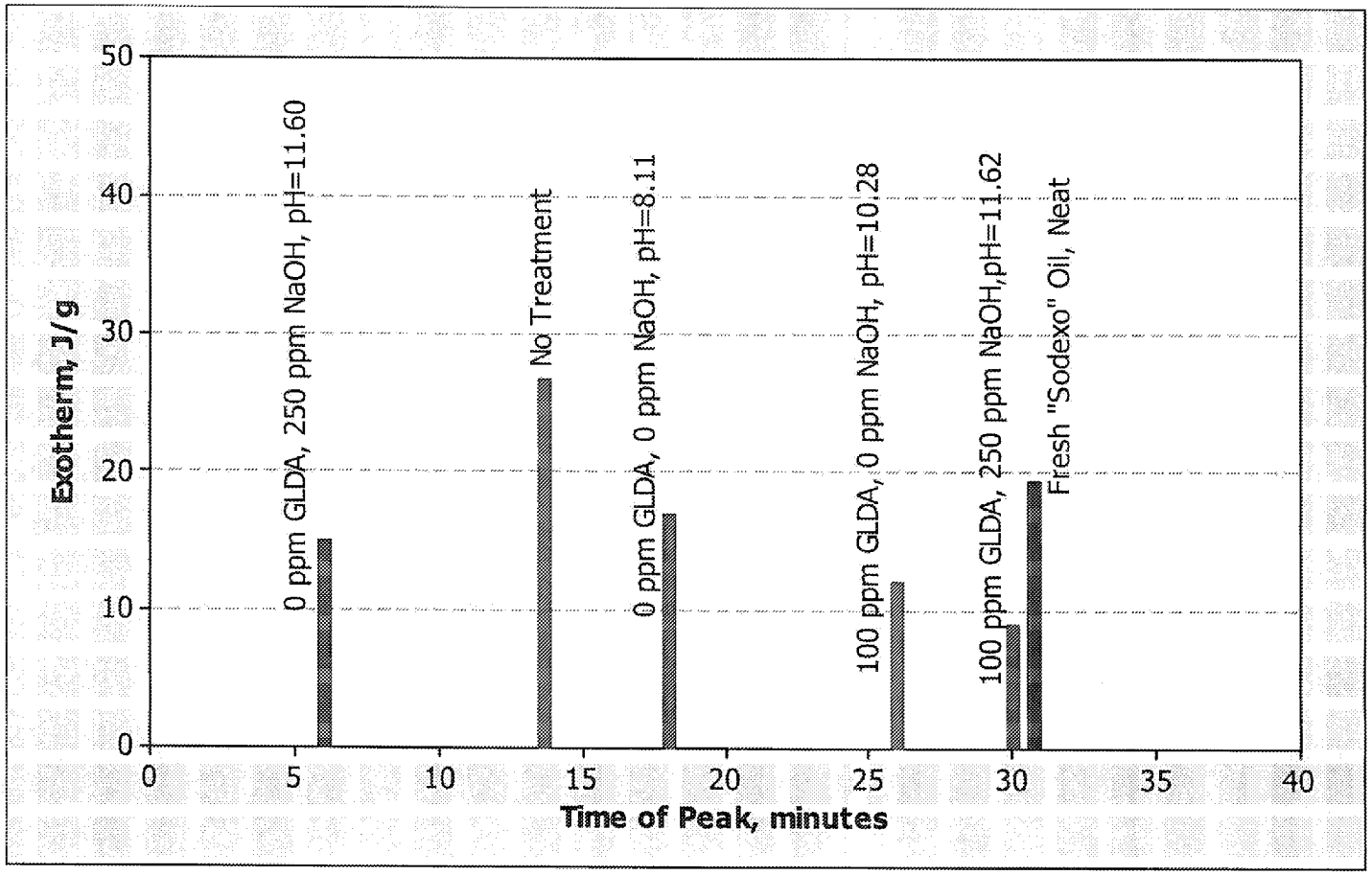
FIG. 33 is a graph showing area of exotherm and time of peak values for cotton terry swatches soiled with fresh soybean oil and treated with a chelating agent and sodium hydroxide and washed in a detergent solution.
Figure 34:
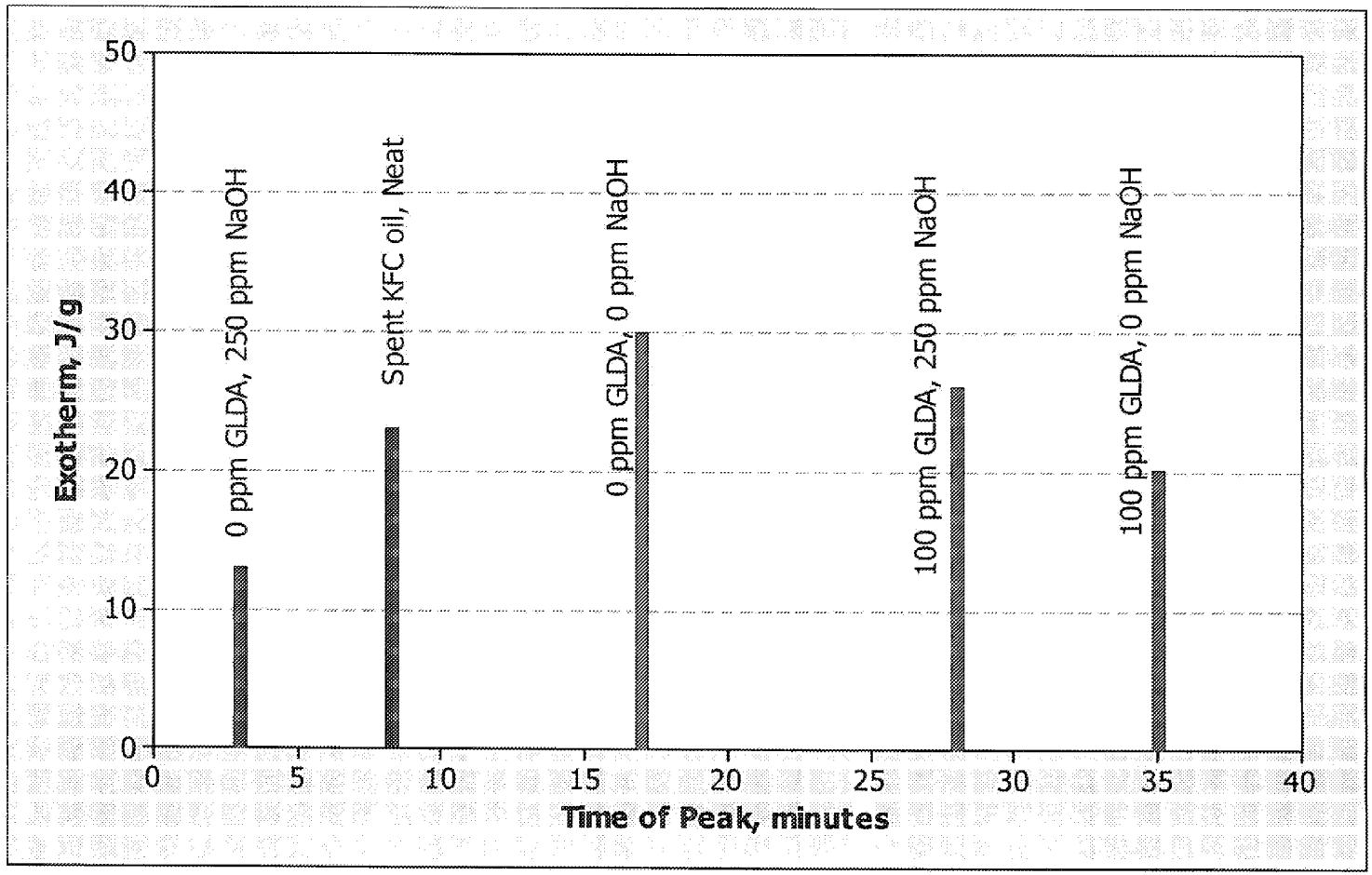
FIG. 34 is a graph showing area of exotherm and time of peak values for cotton terry swatches soiled with spent soybean oil and treated with a chelating agent and sodium hydroxide, and washed in a detergent solution.

First, Applicant soiled swatch types 1-4 with about 2.0 grams of fresh Sodexo soybean oil and swatch types 5-8 with about 2.0 grams of spent KFC oil. Next, swatches were then washed for 10 minutes in de-ionized water at 150° F. with 0.1 grams of commercial detergent A, 100 ppm GLDA (for swatch types 2 and 6), 250 ppm NaOH (for swatch types 3 and 7) and 100 ppm GLDA and 250 ppm NaOH (for swatch types 4 and 8). Next, the swatches were rinsed for two minutes in cold, de-ionized water. Applicant allowed the swatches to dry for 24 hours and then generated DSC curves. The results are displayed in Table 13 below and also illustrated in FIGS. 33 and 34. The results confirm again that the chelating agent is the key element.

TABLE 13

| Swatch Type | Average Area of Exotherm (g/L) | Average Time of Peak (min) |
|---|---|---|
| 1. Fresh oil soiled only, no treatment. | 26.7 | 13.6 |
| 2. Fresh oil soiled, washed with 100 ppm GLDA. | 11.97 | 25.5 |
| 3. Fresh oil soiled, washed with 250 ppm NaOH. | 15.06 | 6 |
| 4. Fresh oil soiled, washed with 100 ppm GLDA and 250 ppm NaOH. | 8.86 | 30 |
| 5. Spent oil soiled only, no treatment. | 23.0 | 8.3 |
| 6. Spent oil soiled, washed with 100 ppm GLDA. | 20.43 | 36 |
| 7. Spent oil soiled, washed with 250 ppm NaOH. | 13.23 | 3 |
| 8. Spent oil soiled, washed with 100 ppm GLDA and 250 ppm NaOH. | 25.76 | 28 |

Example #6

Applicant evaluated the heat of polymerization when soil is applied to swatches impregnated with various chelating agents. The process of impregnation of chelating agent is carried out by soaking the cotton terry swatch in a solution of specific concentration of chelating agent. Afterwards, the excess liquid is allowed to drain and the bar mops are air dried. Applicant compared the following swatch types:

1. Impregnated with GLDA, soiled with soybean oil and washed in a solution of commercial detergent A.
2. Impregnated with EDTA, soiled with soybean oil and washed in a solution of commercial detergent A.
3. Impregnated with MGDA, soiled with soybean oil and washed in a solution of commercial detergent A.
4. Impregnated with GLDA, soiled with soybean oil and washed without detergent.
5. Impregnated with EDTA, soiled with soybean oil and washed without detergent.
6. Impregnated with MGDA, soiled with soybean oil and washed without detergent.
7. Impregnated with GLDA, soiled with soybean oil and washed in a solution of commercial detergent B.
8. Impregnated with EDTA, soiled with soybean oil and washed in a solution of commercial detergent B.
9. Impregnated with MGDA, soiled with soybean oil and washed in a solution of commercial detergent B.

Applicant first weighed each swatch type. Then, Applicant impregnated each swatch type with a chelating type (GLDA for swatch types 1, 4 and 7, EDTA for swatch types 2, 5 and 8 and MGDA for swatch types 3, 6 and 9). The swatches were then air dried and reweighed. Applicant then applied about 0.55 grams of Sodexo fresh soybean oil to each swatch. Swatch types 1-3 and 7-9 were then washed for 10 minutes at 150° F. in de-ionized water with detergent solution (100 ppm commercial detergent A for swatch types 1-3 and 100 ppm commercial detergent B for swatch types 7-9). Swatch types 4-6 were washed without detergent solution. Applicant rinsed the swatches for two minutes in 90° F. de-ionized water and allowed them to air dry.

Figure 35:
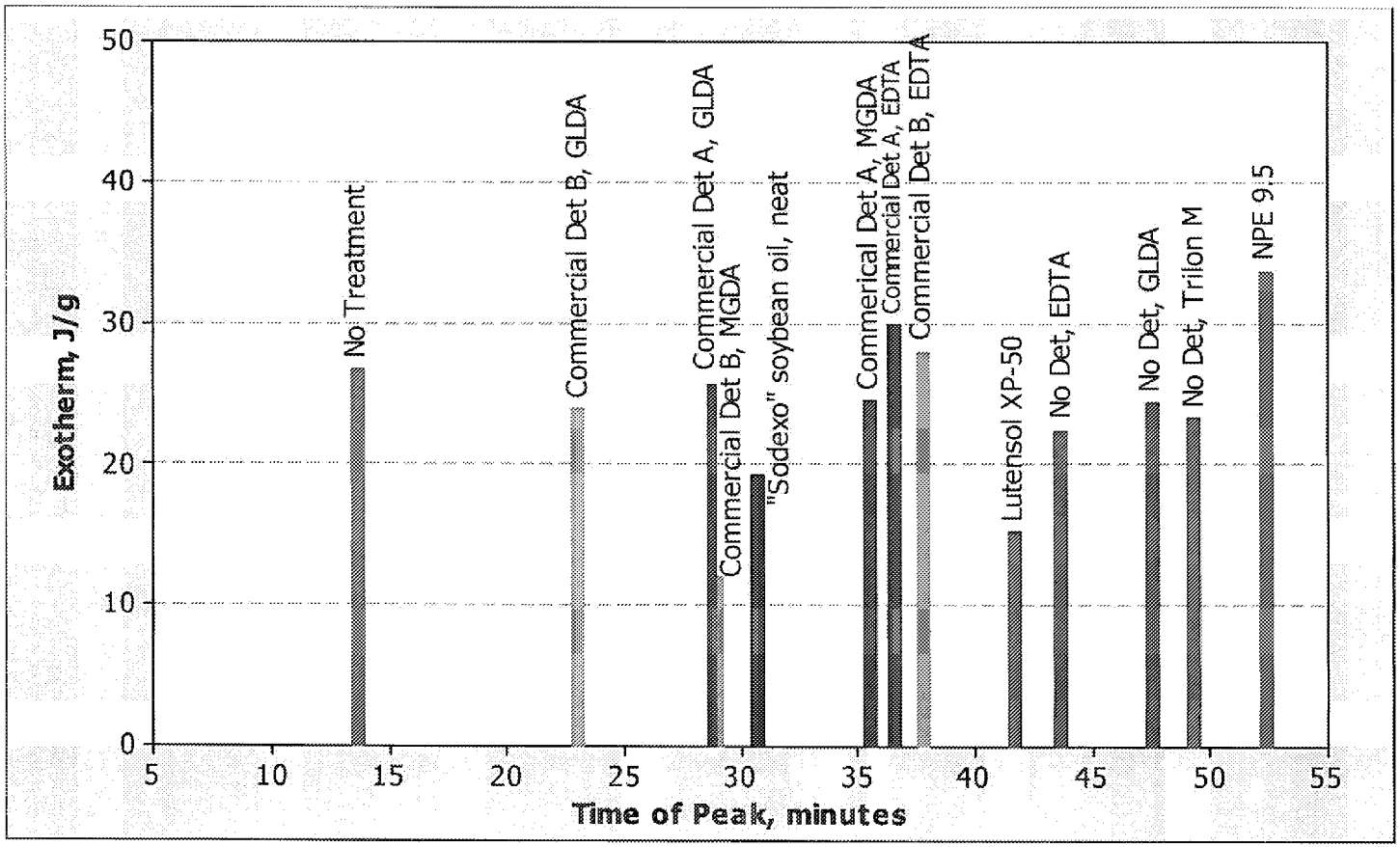
FIG. 35 is a graph showing area of exotherm and time of peak values for cotton terry swatches impregnated with a chelating agent, soiled with soybean oil and washed immediately in a detergent solution.

Applicant prepared DSC curves for each of these swatches and these results are illustrated in FIG. 35. FIG. 35 shows chelating treatment extends time of peak or the time at which the exotherm occurs These results suggest that impregnating a fiber substrate with a chelating agent can retard the exotherm of soybean oil later deposited on the fiber substrate, reducing the fire hazard.

Example #7

Applicant evaluated the heat of polymerization when soil is applied to swatches impregnated with various chelating agents and left to stand one hour before washing. The process of impregnation of chelating agent is carried out by soaking the cotton terry swatch in a solution of specific concentration of chelating agent. Afterwards, the excess liquid is allowed to drain and the bar mops are air dried. Applicant compared the following swatch types:

1. Impregnated with GLDA, soiled with soybean oil, left to stand for one hour and then washed in a solution of commercial detergent A.
2. Impregnated with EDTA, soiled with soybean oil, left to stand for one hour and then washed in a solution of commercial detergent A.
3. Impregnated with MGDA, soiled with soybean oil, left to stand for one hour and then washed in a solution of commercial detergent A.
4. Impregnated with GLDA, soiled with soybean oil, left to stand for one hour and then rinsed only with de-ionized water.
5. Impregnated with EDTA, soiled with soybean oil, left to stand for one hour and then rinsed only with de-ionized water.
6. Impregnated with MGDA, soiled with soybean oil, left to stand for one hour and then rinsed only with de-ionized water.

Applicant first weighed each swatch type. Then, Applicant impregnated each swatch type with a chelating agent (GLDA for swatch types 1 and 4, EDTA for swatch types 2 and 5 and MGDA for swatch types 3 and 6). The swatches were then air dried and reweighed. Applicant then applied about 0.55 grams of Sodexo fresh soybean oil to each swatch. Applicant then let swatches stand for one hour and then washed swatch types 1-3 for 10 minutes at 150° F. in de-ionized water with 100 ppm commercial detergent A. Swatch types 4-6 were washed without detergent solution. Applicant then rinsed the swatches for two minutes in 90° F. de-ionized water and allowed them to air dry.

Figure 36:
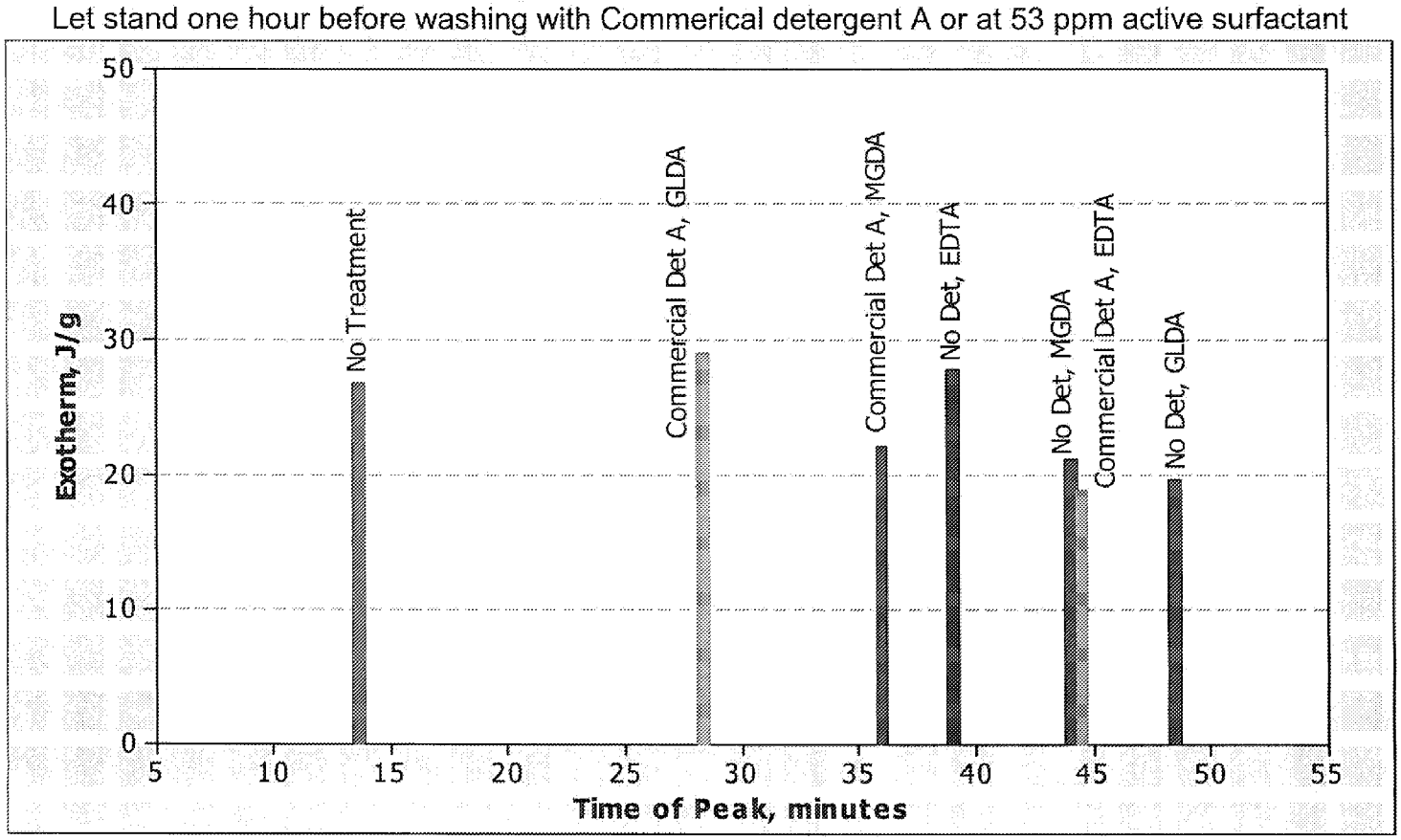
FIG. 36 is a graph showing area of exotherm and time of peak values for cotton terry swatches impregnated with a chelating agent, soiled with soybean oil and left to stand for one hour and then washed in a detergent solution.

Applicant prepared DSC curves for each of these swatches and these results are illustrated in FIG. 36. Chelating treatment is effective at decreasing the exotherm and delaying the time at which the peak or exotherm occurs. These results suggest that impregnating a fiber substrate with chelating agent can retard the exotherm of fresh soybean oil later deposited on the fiber substrate, reducing the fire hazard.

Example #8

Figure 37:
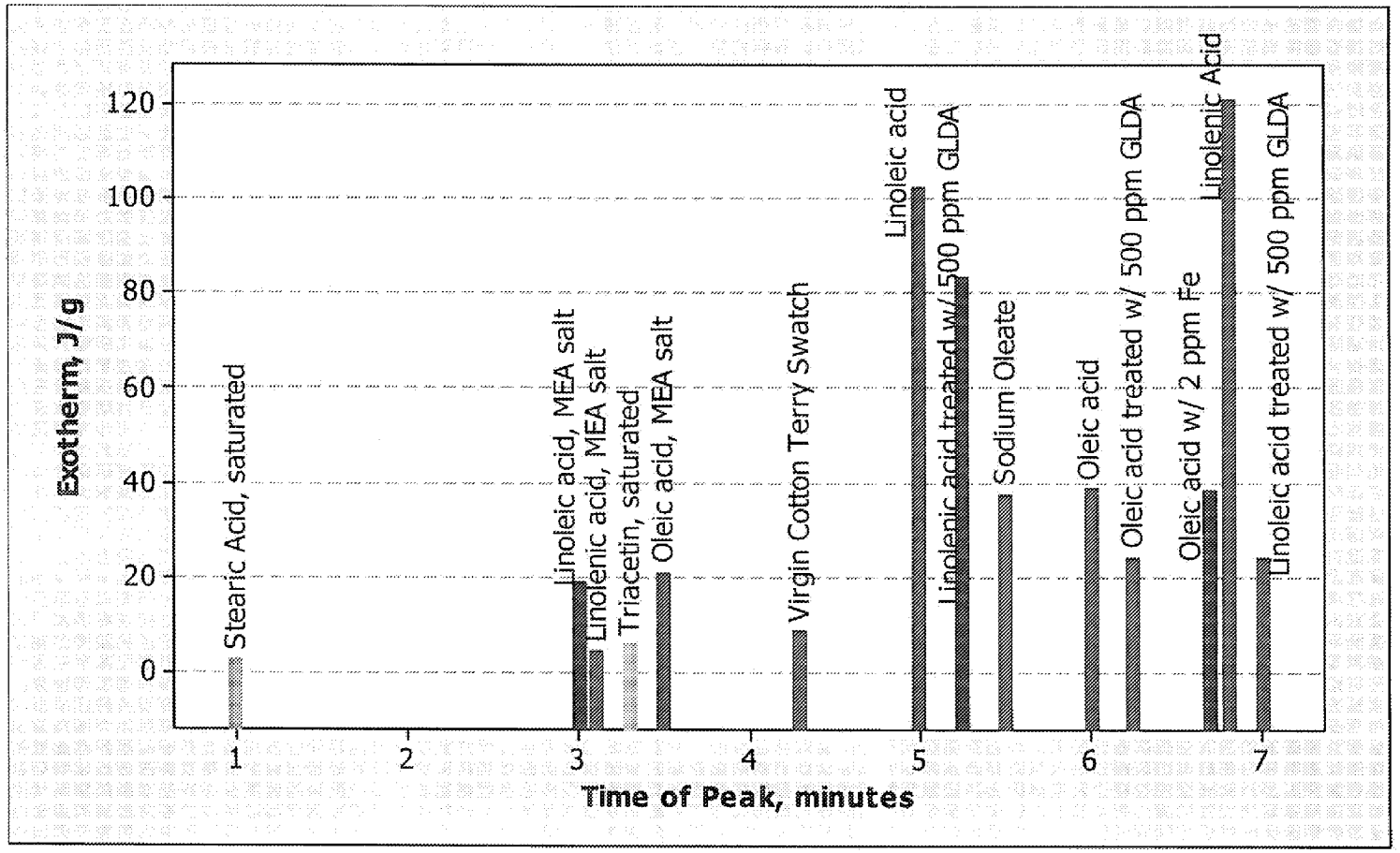
FIG. 37 is a graph showing area of exotherm and time of peak values for cotton terry swatches soiled with free fatty acids treated variously and left to stand overnight.

Applicant compared unsaturated free fatty acids (oleic acid, linoleic acid and linolenic acid) treated with 500 ppm GLDA. Applicant applied one gram of treated fatty acid to a swatch. The swatches were allowed to air dry for 24 hours and then DSC curves were generated. The results are displayed in Table 14 below and FIG. 37. This example shows that chelating agent treatment works on unsaturated free fatty acid by lowering the magnitude of the exotherm.

TABLE 14

| Acid Type | Average of Untreated Fatty Acid | | Average of Treated Fatty Acid | |
|---|---|---|---|---|
| | Area of Exotherm (g/L) | Time of Peak (min) | Area of Exotherm (g/L) | Time of Peak (min |
| Oleic Acid | 38.7 | 6 | 24.1 | 7 |
| Linoleic Acid | 102.6 | 5 | 29.6 | 6 |
| Linolenic Acid | 120.9 | 7 | 83.6 | 5 |

Example #9

Applicant ran DSC curves on the following saturated triglyceride and saturated fatty acid: Triacetin and Stearic Acid. The results are displayed in Table 15 below and FIG. 37. As can be seen from examples #8 and #9, the saturated triglyceride and saturated free fatty acid are less dangerous than the unsaturated fatty acids, which have a much lower magnitude of exotherm.

TABLE 15

| Acid Type | Average | |
|---|---|---|
| | Area of Exotherm (g/L) | Time of Peak (min) |
| Triacetin | 5.59 | 4.25 |
| Stearic Acid | 2.33 | 1.0 |

Example #10

Applicant compared unsaturated free fatty acids (oleic acid, linoleic acid and linolenic acid) treated (neutralized) with MEA or sodium hydroxide. Applicant applied one gram of treated (neutralized) free fatty acid to a swatch. The swatches were allowed to air dry for 24 hours and then DSC curves were generated. Results are displayed in table 16 and FIG. 37. This shows that the salt of the fatty acid lowers the magnitude of exotherm and extends the time of peak.

TABLE 16

| Acid Type | Average of Untreated Fatty Acid | | Average of MEA Treated Fatty Acid | | Average of NaOH Treated Fatty Acid | |
|---|---|---|---|---|---|---|
| | Area of Exotherm (g/L) | Time of Peak (min) | Area of Exotherm (g/L) | Time of Peak (min | Area of Exotherm (g/L) | Time of Peak (min |
| Oleic Acid | 38.7 | 6 | 20.8 | 3 | 37.6 | 6 |
| Linoleic Acid | 102.6 | 5 | 18.7 | 3 | | |
| Linolenic Acid | 120.9 | 7 | 4.4 | 3 | | |

Example #11

Applicant also compared the effects on polymerization on swatches washed with a detergent solution, a chelating agent and either monoethanolamine (MEA) or sodium hydroxide. Applicant compared the following eight swatch types:

1. Fresh oil soiled only, no treatment.
2. Fresh oil soiled, washed with 100 ppm GLDA.
3. Fresh oil soiled, washed with 500 ppm GLDA.
4. Fresh oil soiled, washed with 2000 ppm NaOH.
5. Fresh oil soiled, washed with 500 ppm GLDA and 2000 ppm NaOH.
6. Fresh oil soiled, washed with 500 ppm GLDA and 2000 ppm MEA.
7. Fresh oil soiled, washed with 2000 ppm MEA.

Figure 38:
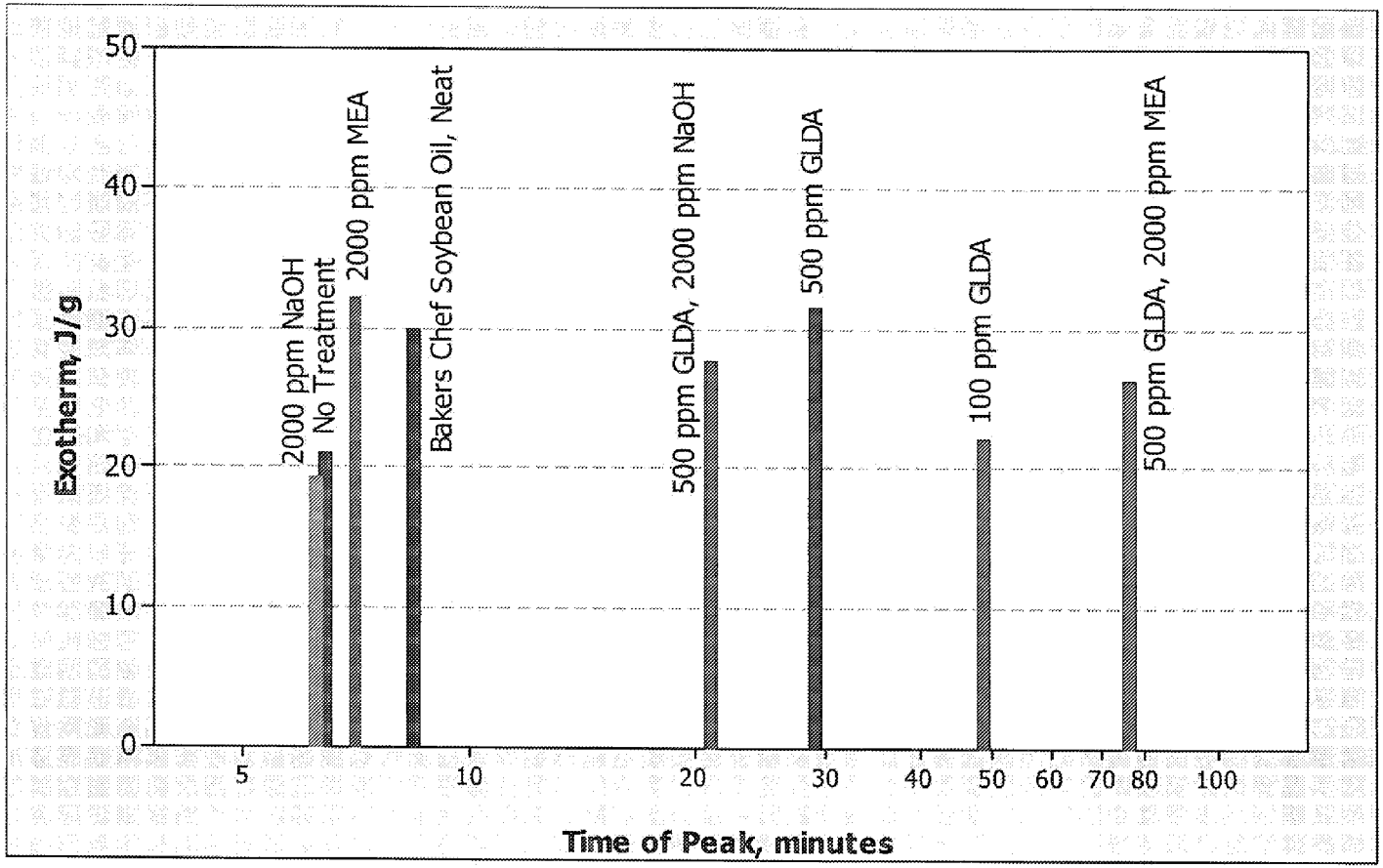
FIG. 38 is a graph showing area of exotherm and time of peak values for cotton terry swatches soiled with fresh soybean oil, and washed in a detergent solution with a chelating agent and either monoethanolamine or sodium hydroxide for comparison.

First, Applicant soiled swatches with about 2.2 grams of fresh Bakers Chef soybean oil and cured overnight at ambient temperature. Swatches were then washed for 10 minutes in de-ionized water at 150° F. with 0.1 grams of commercial detergent A, 100 ppm GLDA (for swatch 2), 500 ppm GLDA (for swatch 3), 2000 ppm NaOH (for swatch 4), 500 ppm GLDA and 2000 ppm NaOH (for swatch 5), 500 ppm GLDA and 2000 ppm MEA (for swatch 6), and 2000 ppm MEA (for swatch 7). Next, the swatches were rinsed for two minutes in cold, de-ionized water. Applicant allowed the swatches to dry for 24 hours and then generated DSC curves. DSC results are displayed in FIG. 38. These results show that MEA has a greater effect on extending the time of peak than sodium hydroxide, and MEA with GLDA is a more effective combination than sodium hydroxide and GLDA.

Example #12

Applicant performed a spontaneous combustion testing to validate the results shown in the above examples using DSC curves. In this example, Applicant determined the time at which cotton bar mops soiled with either linseed oil or soybean oil spontaneously combusted. Applicant also determined whether impregnating bar mops with a chelating agent prolonged the time at which these bar mops spontaneously combusted. Applicant obtained cotton bar mops weighing approximately 60 grams each. Some of the bar mops were soiled with linseed oil and others were soiled with soybean oil. The amount of oil applied to each bar mop was 30% of the weight of the bar mop. The oils were allowed to set on the bar mops overnight. Applicant then loosely packed four bar mops (containing the same oil) into a paint can with holes punched in the side toward the bottom for greater air flow. A thermocouple was also placed in the paint can. The paint can was then placed on top of a hot plate set at a desired temperature. Applicant then monitored the bar mops and thermocouple and ended the experiment once one of the following takes place: (1) the temperature of the bar mops reaches 400° F., (2) smoke appears, or (3) eight to eleven hours passes without (1) or (2) occurring. Applicant performed this experiment for the following bar mop types:

1. 20% soiled with linseed oil.
2. 20% soiled with linseed oil.
3. 26% soiled with linseed oil.
4. 40% soiled with linseed oil.
5. 19% soiled with soybean oil.
6. 25% soiled with soybean oil.
7. 30% soiled with soybean oil.
8. 30% soiled with soybean oil.
9. 30% soiled with soybean oil.
10. Baseline; no oil.

Figure 39:
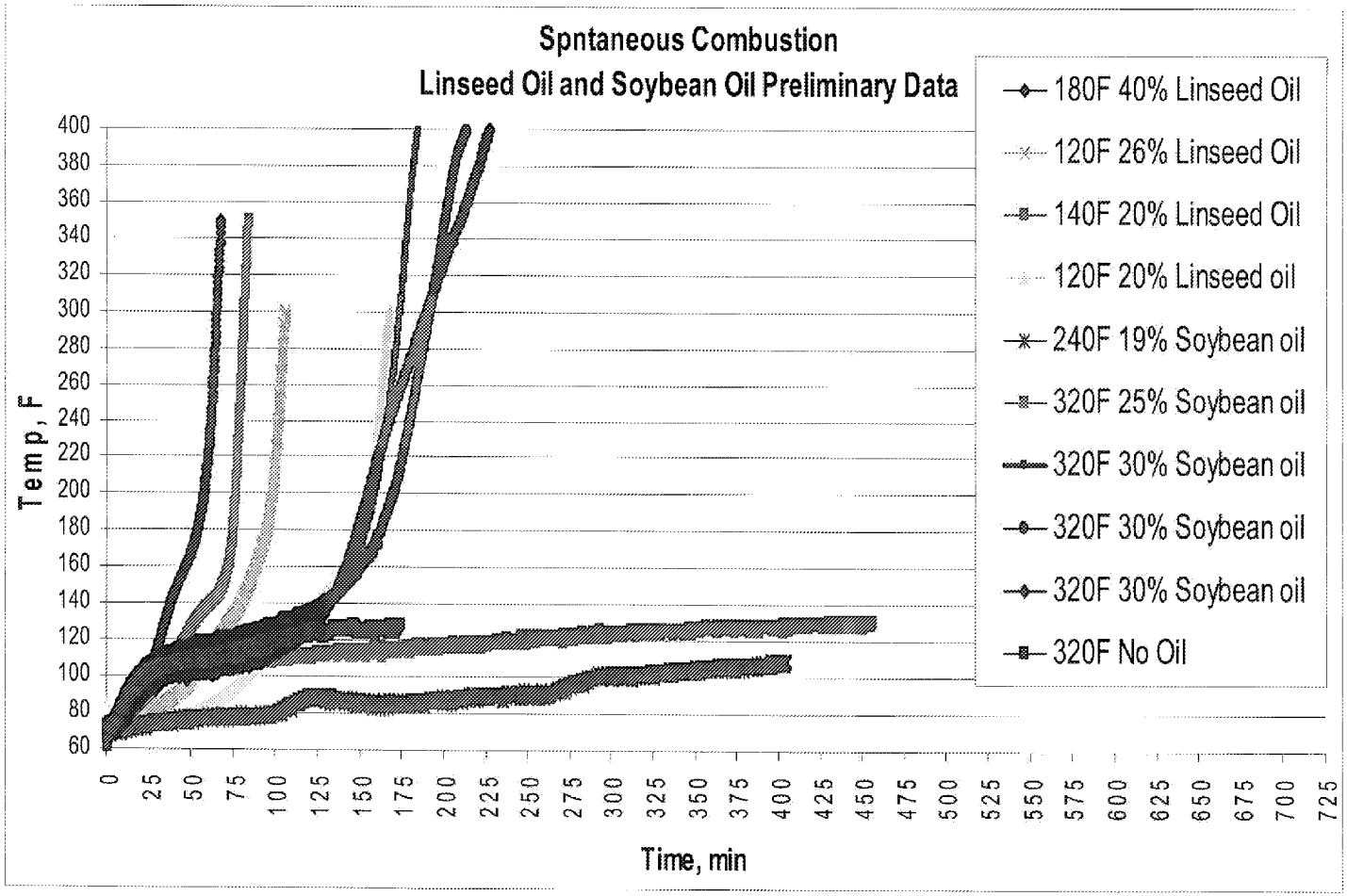
FIG. 39 is a graph showing time spontaneous combustion occurs for bar mops soiled with linseed and soybean oils.

The results are shown on FIG. 39.

Example #13

In this example, Applicant determined whether impregnating bar mops with a chelating agent prolonged the time at which at which these bar mops spontaneously combusted reducing the fire hazard. Specifically, Applicant determined the time at which cotton bar mop previously impregnated with a chelating agent and then soiled with soybean oil spontaneously combusted. Applicant obtained cotton bar mops weighing approximately 60 grams each. The process of impregnation of chelating agent is carried out by soaking the bar mops in a solution of specific concentration of chelating agent. Afterwards, the excess liquid was squeezed out and the bar mops are air dried. Applicant impregnated some of the bar mops with a 25 ppm solution of chelating agent and other with a 100 ppm solution of chelating agent, and others with a 500 ppm solution of chelating agent, specifically a 50/50 blend of Triton M and Dissolvine GL-38S. Some bar mops were impregnated with a 250 ppm solution of Dissolving GL-38S. Some bar mops were not impregnated with a chelating agent. Applicant then soiled each of these bar mops with soybean oil. The amount of oil applied to each bar mop was 30% of the weight of the bar mop. Applicant then set aside some bar mops that did not include a chelating agent or soybean oil to be used as a baseline. Applicant then loosely packed four bar mops of the same type into a paint can. A thermocouple was also placed in the paint can. The paint can was then placed on top of a hot plate set at a desired temperature. Applicant then monitored the bar mops and thermocouple and ended the experiment once one of the following takes place: (1) the temperature of the bar mops reaches 400° F., (2) smoke appears, or (3) eight to eleven hours passes without (1) or (2) occurring. Applicant performed this experiment for the following bar mop types:

1. Baseline; no oil, no chelating agent treatment.
2. 30% soiled with soybean oil, no chelating agent treatment (set #1).
3. 30% soiled with soybean oil, no chelating agent treatment (set #2).
4. 30% soiled with soybean oil, no chelating agent treatment (set #3).
5. Impregnated with a 25 ppm solution of chelating agent blend, (after drying) 30% soiled with soybean oil.
6. Impregnated with a 100 ppm solution of chelating agent blend, (after drying) 30% soiled with soybean oil.
7. Impregnated with a 500 ppm solution of chelating agent blend, (after drying) 30% soiled with soybean oil.
8. Impregnated with a 500 ppm solution of chelating agent blend, (after drying) 38% soiled with soybean oil.
9. Impregnated with a 250 ppm solution of chelating agent (GLDA), (after drying) 30% soiled with soybean oil.
10. Impregnated with a 500 ppm solution of chelating agent (GLDA), (after drying) 30% soiled with soybean oil.

The following Table 17 shows the chelating concentration applied to the above bar mops.

TABLE 17

| Bar mop, wt dry, g | Bar mop, wt wet, g | Chelator solution concentration, ppm | Amount of chelator on bar mop, g | Amount of soybean oil on bar mop, g |
|---|---|---|---|---|
| 60 | 260 | 500 | 0.100 | 18 |
| 60 | 260 | 250 | 0.050 | 18 |
| 60 | 260 | 100 | 0.020 | 18 |
| 60 | 260 | 25 | 0.005 | 18 |

Figure 40:
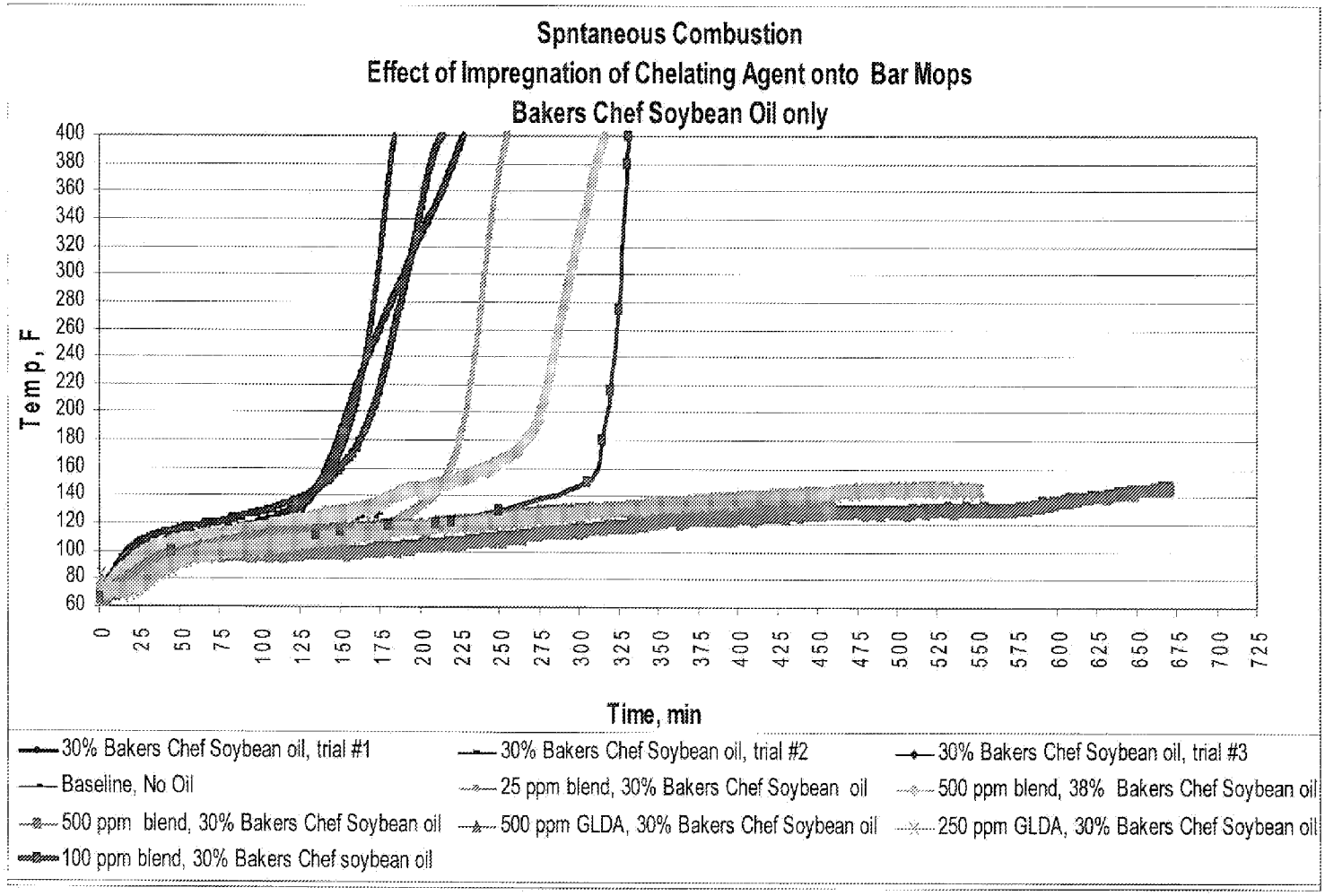
FIG. 40 is a graph showing time spontaneous combustion occurs for bar mops impregnated with a chelating agent and soiled with soybean oil.

The results are shown on FIG. 40. These results also show that just 0.005 grams of chelating agent on a 60 gram bar mop helps to significantly increase the time at which spontaneous combustion occurs (in other words, significantly delay the spontaneous combustion). As such, Applicant has shown that by impregnating 0.000083 grams of chelating agent per 1 gram of fabric is effective at prolonging the temperature at which spontaneous combustion would have occurred without the chelating agent (reducing the fire hazard).

Example #14

In this example, Applicant sought to determine the effect on spontaneous combustion in which the chelating agent was applied to the swatch either before or after the swatch was soiled with heavy metal spiked soybean oil, specifically iron. Applicant obtained cotton bar mops weighing approximately 60 grams each. Applicant impregnated some of the bar mops with a 250 ppm chelating agent solution and others with a 500 ppm of chelating agent solution, specifically Dissolvine GL-38S. The bar mops were allowed to air dry overnight. Applicant then soiled each of these bar mops with heavy metal spiked, 2 ppm, soybean oil. Applicant then soiled some bar mops with heavy metal spiked, 2 ppm, soybean oil and then treated the bar mop with a 250 ppm chelating agent solution, specifically Dissolvine GL-38S. The amount of oil applied to each towel was 30% of the weight of the bar towel. Applicant then set aside some bar mops that did not include a chelating agent or soybean oil to be used as a baseline. Applicant then loosely packed four bar mops of the same type into a paint can. A thermocouple was also placed in the paint can. The paint can was then placed on top of a hot plate set at a desired temperature. Applicant then monitored the bar mops and thermocouple and ended the experiment once one of the following takes place: (1) the temperature of the bar mops reaches 400° F., (2) smoke appears, or (3) eight to eleven hours passes without (1) or (2) occurring. Applicant performed this experiment for the following bar mop types:

1. Baseline; no oil, no chelating agent treatment.
2. 30% soiled with soybean oil, no chelating agent treatment (set #1).
3. 30% soiled with soybean oil, no chelating agent treatment (set #2).
4. 30% soiled with soybean oil, no chelating agent treatment (set #3).
5. 30% soiled with 2 ppm spiked soybean oil, no chelating agent treatment.
6. Impregnated with a 250 ppm chelating agent solution, (after drying) 30% soiled with 2 ppm spiked soybean oil.
7. Impregnated with a 500 ppm chelating agent solution, (after drying) 30% soiled with 2 ppm spiked soybean oil.
8. 30% soiled with 2 ppm spiked soybean oil, 250 ppm chelating agent solution.

Figure 41:
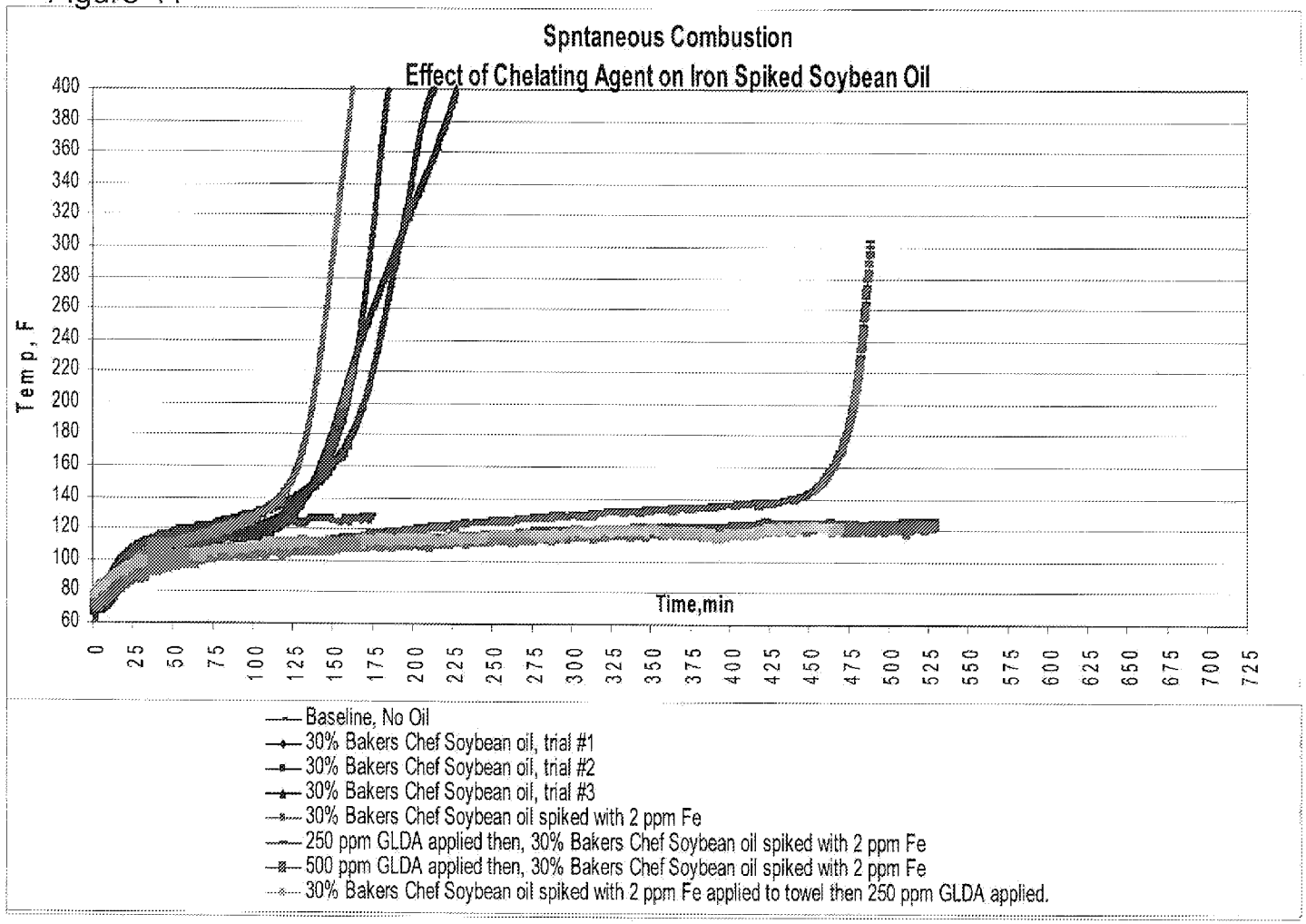
FIG. 41 is a graph showing time spontaneous combustion occurs for bar mops soiled with soybean oil spiked with 2 ppm iron and treated with a chelating agent.

The results are shown in FIG. 41. These results show that the chelating agent significantly delays the time at which spontaneous combustion occurs.

Example #15

Applicant sought to determine the effect on polymerization on swatches soiled with soybean oil and washed in a microemulsion forming formula. First, Applicant soiled swatches with about 2.1 grams fresh soybean oil and the swatches were left stand overnight. The swatches were washed for 10 minutes in de-ionized water at 150° F. with a selected concentration of detergent, chelant, and alkalinity source. Next, the swatches were rinsed for two minutes in cold, de-ionized water. Applicant allowed the swatches to dry for 24 hours and generated DSC curves. This data is shown in Table 18 below and FIG. 42.

TABLE 18

| μEM Formula with Chelating Agent and MEA Treatment | Average Area of Exotherm (g/L) | Average Time of Peak (min) |
|---|---|---|
| Bakers Chef fresh soy oil | 29.93 | 8 |
| Commercial Detergent A: 265 ppm surfactant, 0 ppm chelant, 0 ppm alkalinity | 13.00 | 23 |
| Commercial Detergent A: 265 ppm surfactant, 0 ppm chelant, 50 ppm MEA | 16.00 | 25 |
| Commercial Detergent B: 370 ppm surfactant, 0 ppm chelant, 0 ppm alkalinity | 47.42 | 16 |
| uEM #9: 48 ppm surfactant, 39 ppm chelant, 0 ppm alkalinity | 30.37 | 62 |
| uEM #10: 48 ppm surfactant, 39 ppm chelant, 25 ppm MEA | 13.57 | 97 |
| uEM #11: 370 ppm surfactant, 304 ppm chelant, 385 ppm MEA | 7.24 | 105 |
| uEM #11: 48 ppm surfactant, 39 ppm chelant, 50 ppm MEA | 7.35 | 107 |
| uEM #11: 93 ppm surfactant, 76 ppm chelant, 96 ppm MEA | 17.15 | 87 |
| uEM #11: 185 ppm surfactant, 152 ppm chelant, 193 ppm MEA | 15.06 | 108 |
| uEM #12: 370 ppm Surfactant + Linker | 23.67 | 31 |
| uEM #12: 185 ppm Surfactant + Linker | 26.04 | 28 |
| uEM #13: 370 ppm Surfactant | 17.56 | 32 |

As can be seen, the microemulsion forming formulas with chelating agent are very effective in reducing the area of the exotherm and delays the time of the peak. The microemulsion forming formulas with the combination of chelating agent and monoethanolamine are even more effective.

EXAMPLES

Sunscreen Stain Removal

There have been increasing reports of yellow stains on linen that are believed to be caused by sunscreen formulations. These stains are not visible prior to the wash, but typically appear on the linen (usually cotton towels) as yellow patches after washing with detergent-builder combinations at high pH, especially when using chlorine bleach. In other words, the stains are "set" by alkali and chlorine bleach. If the water quality is poor and high levels of iron are present the yellow spots can even become orange in color.

Attempts in the field to remove these stains using normal combinations of detergents, detergency boosters, and bleach have not been successful. It has been reported that using mild neutral detergent with oxygen bleach does not tend to form the stains, but this combination also does not offer the level of cleaning performance desired. These sunscreen formulations contain a variety of active ingredients, but the ones of most concern are the polyphenyl aromatics Oxybenzone and Avobenzone. Formulations with higher Sun Protective Factors (SPFs) contain more of these actives, and form more severe yellow stains. Whereas, formulations that lack these actives do not tend to form yellow stains. Both of these structures have active (acidic) hydrogen which helps to explain the effect of the alkali, which is believed to react with the actives to form salts that are highly colored. It can also explain the effect of the final sour, in that the acid protonates the colored salts to regenerate the less colored acid forms.

It has been found that iron rich water leads to even more highly colored stains from the sunscreens. The sunscreen actives combine with the iron in the water to form highly colored complexes. The structure of Avobenzone, which contains a 1,3-diketone moiety is known to form strong metal complexes. Applicants have found that it is possible to lessen or remove the yellow stains caused by sunscreen by competitive chelation with chelants added to the laundry process.

Test Procedure

Applicants prepared test samples by coating eight 2" by 3" cotton terry swatches with 0.5 g each of "Coppertone 70 SPF Ultraguard" sunscreen lotion, and allowed the swatches to sit overnight. Applicants then washed the swatches with 25 lbs of cotton fills in a 35 lb front loading I&I industrial washing machine under various conditions. After washing, the swatches were allowed to dry, and then measured with a Hunter Colorimeter to determine the L*a*b* color space. In this color space L* indicates lightness and a* and b* are measured of chromaticity, with +a* being the red direction, −a* the green direction, +B* the yellow direction, and −b* the blue direction. Higher positive b* values therefore denote samples that are more highly yellow, and since the yellow comes from the stain, higher values of b* reflect samples that are more highly stained after the wash treatment. In practice the Applicants report the results as a change in the b* value for a particular treatment −a Δb*—by subtracting the b* of the starting uncoated swatch from the b* of the final washed swatch. These Δb* values can vary from zero—indicating no yellowing after washing (no yellow stain)—to as much as 15 for a strong yellow stain. Smaller values of Δb* therefore indicate treatments that are more successful at removing the yellow stains form sunscreens than treatment with larger values of Δb*.

Wash Procedure

Conditions: Unimac #4 (35 lbs Machine), 25 lbs Cotton Fills with 8 Unwashed Sunscreen Coated Swatches 1. Filled the machine with medium level of 5 grains water at 145° F. Then 5 oz of detergent booster from flush cup was supplied into the machine. Then washed for 10 minutes and drained 2 minutes afterward.
2. Filled the machine with medium level of 5 grains water at 145° F. Added 1 oz of Detergent 1 and varies amount of Builder C to boost up the pH ~11. Both the Detergent 1 and Builder C were added in the Suds step. Then washed for 20 minutes and 2 minutes drained. Note: Most of the time, pH ~11 with 45 g of Builder C was added. The pH was adjusted with Builder C to ensure it pursues pH ~11 before the actual wash.
3. Filled the machine with high level of 5 grains water at 145° F. Washed for 2 minutes and drained for 2 minutes. Next filled the machine with high level of 5 grains water at 145° F. and drained for 2 minutes. Finally filled the machine with high level of 5 grains water at 130° F., drained for 2 minutes, and extracted for 5 minutes with medium spinning.

Stain Setting Procedure

Conditions: Unimac #4 (35 lbs Machine), 25 lbs Cotton Fills with 8 Unwashed Sunscreen Coated Swatches 1. Filled the machine with medium level of 5 grains water at 120° F. Then added 98 g L2000XP detergent from flush cup into the machine. Then washed for 7 minutes and drained 2 minutes afterward.

2. Filled the machine with high level of 5 grains water at 120° F. Then washed for 2 minutes and drained for 2 minutes. Afterward, filled the machine again with low level of 5 grains water at 120 F. Then added 28 g of Laundri Destainer (Chlorine Bleach) into the machine from cup 2 as a Suds step. Washed for 7 minutes and drained for 2 minutes.
3. Finally, filled the machine with high level of 5 grains water at 105° F. Washed for 2 minutes and drained for 2 minutes. Repeat step 3 three more times. Then extracted at 400 rpm for 5 minutes.

Example #16

Applicants tested a variety of chelant types against unwashed sunscreen coated swatches. Applicants added 60 grams of each product to the wash step of the laundry process along with a detergent and a builder. With a volume of about 50 liters of water, there was between 360 and 600 ppm of chelant in the use solution. All the products were washed at a pH of about 11. The results are illustrated below in table 19.

TABLE 19

| Run # | Sample | Δb* |
|---|---|---|
| 1 | Control with no chelant | 10.8 |
| 2 | DEQUEST 2000LC | 5.0 |
| 3 | DISSOLVINE-40 | 10.0 |
| 4 | EDDS | 9.5 |
| 5 | EDTA | 8.9 |

Under these conditions, the control run with no chelant added (Run #1) to the wash cycle developed a yellow stain with a Δb* of 10.8 units compared with the starting swatch. The runs using the Aminocarboxylate chelants, D-40 (Run #3), EDDS (Run #4) and EDTA (Run #5) all removed some of the yellow stains, shown by the slightly reduced Δb* values. But the run using Amino tri(methylene phophonic acid), Dequest 2000 (Run #2) removed much more of the yellow stain, giving a Δb* value of just 5.0. This demonstrates that the addition of chelants to the wash cycle of a laundry process can be effective at reducing the yellow stains associated with sunscreen oils, and that the phosphonic acid chelants are to be preferred.

Example #17

The Applicants then wanted to see how much of the yellow stain removal was dependent on the level of chelant. Additional runs using unwashed sunscreen coated swatches were performed using 60, 30 and 15 g of Amino tri(methylene phophonic acid), Dequest 2000 and 60 and 140 g of Aminocarboxylate chelant, D-40. The results are illustrated below in Table 20.

TABLE 20

| Run # | Sample | Δb* |
|---|---|---|
| 1 | Control no chelant | 10.8 |
| 2 | DEQUEST 2000LC (60 g) | 5.0 |
| 3 | DEQUEST 2000LC (30 g) | 8.2 |
| 4 | DEQUEST 2000LC (15 g) | 7.9 |
| 5 | D-40 (60 g) | 10.0 |
| 6 | D-40 (104 g) | 9.2 |

Under these conditions, when the level of Dequest 2000 was reduced from 60 g (Run #2) the stain removal was reduced as well, with the Δb* increasing from 5.0 at a 60 g dosage to about 8 with a 30 g dosage (Run #3) and 15 g dosage (Run #4). Next the level of D-40 was increased from 60 g (Run #5) to 104 g (Run #6) to give a level that is equi-molar with a 60 g dosage of Dequest 2000, but the result barely improved, dropping from a Δb* of 10 to 9.2. From this we see that again the Phosphonic Acid chelant is preferred, and that lower levels give correspondingly less stain removal.

Example #18

Applicants then wanted to see the effect of the timing of the addition of the chelant to the wash cycle, again using unwashed sunscreen coated swatches. As illustrated below in Table 21, in one run (Run #3) Applicants added 60 g of the Dequest 2000 before the suds step of the wash cycle along with a detergent and a builder. In another run (Run #2) Applicants added 60 g of the Dequest 2000 chelant alone to a 10 minute flush step prior to the suds step in the wash cycle, dumped the wash liquor, and followed the cycle with a normal suds step with a detergent and a builder.

TABLE 21

| Run # | Sample | Δb* |
|---|---|---|
| 1 | Control no chelant | 10.8 |
| 2 | DEQUEST 2000LC (60 g) in flush cycle | 8.0 |
| 3 | DEQUEST 2000LC (60 g) in sud cycle | 5.0 |

Under these conditions, based on the Δb* values the same 60 g dosage of Dequest 2000 was much more effective at reducing the yellow sunscreen stain when added in the suds step along with the detergent and builder than when added in the flush step alone.

Example #19

Applicant then wanted to see if the addition of chelants was effective at removing already set sunscreen stains. It is believed that the stains become much more difficult to remove once they have been set by the heat of drying, so this is a more difficult challenge than removing fresh sunscreen from linen as discussed above. To test this, Applicants created set stain swatches by coating swatches as discussed above, but washed them this time with a combination of a larger amount of detergent coupled with Sodium Hypochlorite bleach. After this treatment the Δb* of the set stain swatches compared with starting uncoated swatches was 8.6 (Run #1). These stained swatches were then washed a second time using the normal wash procedure described above with various treatments. The results are illustrated below in Table 22.

TABLE 22

| Run # | Sample | Δb* |
|---|---|---|
| 1 | Stain after setting | 8.6 |
| 2 | Control with no chelant | 8.5 |
| 3 | DEQUEST 2000LC | 6.2 |
| 4 | D-40 | 6.8 |
| 5 | EDDS | 7.6 |
| 6 | EDTA | 6.8 |

Under these conditions, with no chelant added (Run #2) the Δb* was 8.5, showing little change in the stain level. Additional runs were then performed with set stain swatches using 60 g of several chelants added to the suds step as before. The Dequest 2000 chelant was again the best performance, but the smaller differences in this case show that the chelants had less effect in helping to remove a set stain than as a fresh stain.

Example #20

Applicants then wanted to know whether the addition of chelants would help when use as a prespotter on set stain. To test this, Applicants again prepared set stain swatches as described above. Individual set stain swatches were then treated with 3 g of chelant solution, allowed to sit overnight, and then washed a second time using the normal wash procedure described above. The results are illustrated below in Table 23.

TABLE 23

| Run # | Sample | Δb* |
|---|---|---|
| 1 | Stain after setting | 8.6 |
| 2 | Control with no chelant | 8.5 |
| 3 | DEQUEST 2000LC | 8.0 |
| 4 | EDTA | 8.5 |

Under these conditions, the chelants used as a prespotter (Run #3 and Run #4) showed very little difference from the controls (Run #1 and Run #2), showing that the chelants had little effect when used as pre-spotters.

We claim:

1. A method of laundering an article that is contacted with sunscreen components, the method comprising:

providing an article that has been contacted with a triglyceride sunscreen component;

washing the article;

rinsing the article;

drying the article; and treating the article with an effective amount of carboxylate and/or phosphonic acid chelating agent to competitively chelate with the sunscreen components to reduce or eliminate strong metal complexes formed by the sunscreen components, during or prior to or after the article is laundered in the washing step and wherein the effective amount of chelating agent is about 350 to about 600 ppm.

2. The method of claim 1 wherein a detergent and a builder is also used to treat the article while the article is laundered in the washing step.

3. The method of claim 1 wherein the sunscreen components comprises avobenzone, oxybenzone and/or other components which causes sunscreen stains on an article.

4. The method of claim 1 wherein the chelating agent reduces stains caused by the sunscreen components avobenzone and oxybenzone.

5. The method of claim 1 wherein the article is fabric.

* * * * *